US007553460B2

(12) United States Patent
Stell et al.

(10) Patent No.: US 7,553,460 B2
(45) Date of Patent: Jun. 30, 2009

(54) PROCESS AND APPARATUS FOR CRACKING HYDROCARBON FEEDSTOCK CONTAINING RESID TO IMPROVE VAPOR YIELD FROM VAPOR/LIQUID SEPARATION

(75) Inventors: Richard C. Stell, Houston, TX (US); Jennifer L. Bancroft, Houston, TX (US); Arthur R. Dinicolantonio, Seabrook, TX (US); Subramanian Annamalai, Houston, TX (US); James N. McCoy, Houston, TX (US); Paul F. Keusenkothen, Houston, TX (US); George Stephens, Humble, TX (US); John R. Messinger, Kingwood, TX (US); James Mitchell Frye, Houston, TX (US); Nick G. Vidonic, Seabrook, TX (US); George J. Balinsky, Kingwood, TX (US)

(73) Assignee: Exxonmobil Chemical Patents Inc., Houston, TX (US)

( * ) Notice: Subject to any disclaimer, the term of this patent is extended or adjusted under 35 U.S.C. 154(b) by 315 days.

(21) Appl. No.: 11/713,505

(22) Filed: Mar. 2, 2007

(65) Prior Publication Data

US 2007/0160513 A1 Jul. 12, 2007

Related U.S. Application Data

(62) Division of application No. 11/134,148, filed on May 20, 2005, now Pat. No. 7,193,123.

(60) Provisional application No. 60/573,474, filed on May 21, 2004.

(51) Int. Cl.
*B01J 10/00* (2006.01)
*B01J 23/90* (2006.01)
*B01J 19/00* (2006.01)

(52) U.S. Cl. ..... 422/188; 422/189; 422/193; 422/194; 422/200; 422/223; 422/224; 208/130; 585/648

(58) Field of Classification Search ..... 422/188, 422/189, 193, 194, 200, 223, 224; 208/130; 585/648

See application file for complete search history.

(56) References Cited

U.S. PATENT DOCUMENTS 1,936,699 A 11/1933 Weaver
(Continued)

FOREIGN PATENT DOCUMENTS

DE 1093351 11/1960
(Continued)

OTHER PUBLICATIONS

"Specialty Furnace Design: Steam Reformers and Steam Crackers", presented by T.A. Wells of the M.W. Kellogg Company, 1988 AIChE Spring National Meeting.
(Continued)

*Primary Examiner*—Walter D Griffin
*Assistant Examiner*—Lessanework Seifu

(57) ABSTRACT

A process for cracking hydrocarbon feedstock containing resid comprising: heating the feedstock, mixing the heated feedstock with a fluid and/or a primary dilution steam stream to form a mixture, flashing the mixture to form a vapor phase and a liquid phase which collect as bottoms and removing the liquid phase, separating and cracking the vapor phase, and cooling the product effluent. The process comprises at least two of the following conditions: (1) maintaining the bottoms under conditions to effect at least partial visbreaking; (2) reducing or eliminating partial vapor condensation during flashing by adding a heated vaporous diluent to dilute and superheat the vapor; (3) partially condensing the vapor within said flash/separation vessel by contacting with a condenser; (4) decoking internal surfaces and associated piping of the flash/separation vessel with air and steam; (5) utilizing a flash/separation vessel having an annular, inverted L-shaped baffle; and (6) regulating temperature in furnace tube banks used for heating by utilizing a desuperheater and/or an economizer. An apparatus for carrying out the process is also provided.

10 Claims, 17 Drawing Sheets

U.S. PATENT DOCUMENTS

| | | | |
|---|---|---|---|
| 1,984,569 | A | 12/1934 | Cooke et al. |
| 2,091,261 | A | 8/1937 | Alther |
| 2,158,425 | A | 5/1939 | Ragatz |
| 3,291,573 | A | 12/1966 | Frescoln |
| 3,341,429 | A | 9/1967 | Fondrk |
| 3,413,211 | A | 11/1968 | Becraft et al. |
| 3,487,006 | A | 12/1969 | Newman et al. |
| 3,492,795 | A | 2/1970 | Guerrieri |
| 3,505,210 | A | 4/1970 | Wallace et al. |
| 3,617,493 | A | 11/1971 | Wirth et al. |
| 3,677,234 | A | 7/1972 | Dutkiewicz |
| 3,718,709 | A | 2/1973 | Simonetta |
| 3,900,300 | A | 8/1975 | Lehman |
| 4,199,409 | A | 4/1980 | Skraba |
| 4,264,432 | A | 4/1981 | Gartside |
| 4,300,998 | A | 11/1981 | Gartside |
| 4,311,580 | A | 1/1982 | Bartholic |
| 4,361,478 | A | 11/1982 | Gengler et al. |
| 4,400,182 | A | 8/1983 | Davies et al. |
| 4,426,278 | A | 1/1984 | Kosters |
| 4,543,177 | A | 9/1985 | Murthy et al. |
| 4,615,795 | A | 10/1986 | Woebcke et al. |
| 4,714,109 | A | 12/1987 | Tsao |
| 4,732,740 | A | 3/1988 | Woebcke et al. |
| 4,840,725 | A | 6/1989 | Paspek |
| 4,854,944 | A | 8/1989 | Strong |
| 4,954,247 | A | 9/1990 | Lipkin et al. |
| 5,096,567 | A | 3/1992 | Paspek, Jr. et al. |
| 5,120,892 | A | 6/1992 | Skraba |
| 5,190,634 | A | 3/1993 | Fernandez-Baujin et al. |
| 5,468,367 | A | 11/1995 | Dickakian et al. |
| 5,580,443 | A | 12/1996 | Yoshida et al. |
| 5,817,226 | A | 10/1998 | Lenglet |
| 5,910,440 | A | 6/1999 | Grossman et al. |
| 6,093,310 | A | 7/2000 | Swan |
| 6,123,830 | A | 9/2000 | Gupta et al. |
| 6,179,997 | B1 | 1/2001 | Vedder, Jr. et al. |
| 6,190,533 | B1 | 2/2001 | Bradow et al. |
| 6,210,561 | B1 | 4/2001 | Bradow et al. |
| 6,303,842 | B1 | 10/2001 | Bridges et al. |
| 6,376,732 | B1 | 4/2002 | Ngan et al. |
| 6,632,351 | B1 | 10/2003 | Ngan et al. |
| 6,743,961 | B2 | 6/2004 | Powers |
| 2001/0016673 | A1 | 8/2001 | Bridges et al. |
| 2003/0070963 | A1 | 4/2003 | Zimmermann et al. |
| 2004/0004022 | A1 | 1/2004 | Stell et al. |
| 2004/0004027 | A1 | 1/2004 | Spicer et al. |
| 2004/0004028 | A1 | 1/2004 | Stell et al. |
| 2004/0039240 | A1 | 2/2004 | Powers |
| 2004/0054247 | A1 | 3/2004 | Powers |
| 2005/0010075 | A1 | 1/2005 | Powers |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2006259 | 10/1977 |
| GB | 2012176 | 11/1977 |
| JP | 3111491 | 5/1991 |
| NL | 7410163 | 4/1975 |
| SU | 1491552 | 7/1989 |
| WO | WO 01/55280 | 8/2001 |
| ZA | 907394 | 7/1991 |

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16.

1764
1760
1762
speed
1705
1706
1701
1702
1752
1708
1710
1750
1724
1712
1798
B
1714
1756
1780
1787
1746
1722
1754
D
1748
1716
1726
C
1720
1718
A2
pres. diff.
1732
1744
1742
1728
A1
A3
1730
1736
1734
1740
1703
1704

PROCESS AND APPARATUS FOR CRACKING HYDROCARBON FEEDSTOCK CONTAINING RESID TO IMPROVE VAPOR YIELD FROM VAPOR/LIQUID SEPARATION

CROSS-REFERENCE TO RELATED APPLICATION

This application is a divisional of U.S. patent application Ser. No. 11/134,148 filed May 20, 2005 now U.S. Pat. No. 7,193,123, which claims benefit of U.S. provisional patent application Ser. No. 60/573,474 filed May 21, 2004.

FIELD OF THE INVENTION

The present invention relates to the cracking of hydrocarbons that contain relatively non-volatile hydrocarbons and other contaminants. More particularly, the present invention relates to increasing the amounts and types of feed available to a steam cracker.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light or low molecular weight feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products comprising olefins leave the pyrolysis furnace for further downstream processing, including quenching.

Pyrolysis involves heating the feedstock sufficiently to cause thermal decomposition of the larger molecules. The pyrolysis process, however, produces molecules that tend to combine to form high molecular weight materials known as tar. Tar is a high-boiling point, viscous, reactive material that can foul equipment under certain conditions. In general, feedstocks containing higher boiling materials tend to produce greater quantities of tar.

Conventional steam cracking systems have been effective for cracking high-quality feedstock, which contain a large fraction of light volatile hydrocarbons, such as gas oil and naphtha. However, steam cracking economics sometimes favor cracking lower cost feedstocks containing resids such as, by way of non-limiting examples, atmospheric residue, e.g., atmospheric pipestill bottoms, and crude oil. Crude oil and atmospheric residue often contain high molecular weight, non-volatile components with boiling points in excess of 590° C. (1100° F.). The non-volatile components of these feedstocks lay down as coke in the convection section of conventional pyrolysis furnaces. Only very low levels of non-volatile components can be tolerated in the convection section downstream of the point where the lighter components have fully vaporized.

In most commercial naphtha and gas oil crackers, cooling of the effluent from the cracking furnace is normally achieved using a system of transfer line heat exchangers, a primary fractionator, and a water quench tower or indirect condenser. The steam generated in transfer line exchangers can be used to drive large steam turbines which power the major compressors used elsewhere in the ethylene production unit. To obtain high energy-efficiency and power production in the steam turbines, it is necessary to superheat the steam produced in the transfer line exchangers.

Cracking heavier feeds, such as atmospheric and vacuum gas oils, produces large amounts of tar, which leads to coking in the radiant section of the furnace as well as rapid fouling in the transfer line exchangers preferred in lighter liquid cracking service.

Additionally, during transport some naphthas are contaminated with heavy crude oil containing non-volatile components. Conventional pyrolysis furnaces do not have the flexibility to process residues, crudes, or many residue or crude-contaminated gas oils or naphthas which comprise non-volatile components.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 230 and 590° C. (450 and 1100° F.). The vapors are cracked in the pyrolysis furnace into olefins and the separated liquids from the two flash tanks are removed, stripped with steam, and used as fuel.

U.S. Pat. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

Co-pending U.S. application Ser. No. 10/188,461 filed Jul. 3, 2002, Patent Application Publication US 2004/0004022 A1, published Jan. 8, 2004, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water.

Co-pending U.S. patent application Ser. No. 10/851,878, filed May 21, 2004, which is incorporated herein by reference, discloses a process for reducing fouling during cracking of a hydrocarbon feedstock containing resid which comprises: introducing a mixture stream of heated hydrocarbon feedstock mixed with steam to a flash/separation apparatus to form (i) a vapor phase at its dew point which partially cracks causing a temperature decrease which, in the absence of added heat, causes partial condensation of said vapor phase and (ii) a liquid phase. Partial condensation is reduced or eliminated by adding a heated vaporous diluent, e.g., light hydrocarbon or superheated steam, to the flash/separation apparatus to an extent sufficient to at least partially compensate for the temperature decrease and to dilute and superheat the vapor phase, prior to removing the vapor phase as overhead for subsequent cracking and recovery of cracked product. An apparatus for carrying out the process is also provided.

Co-pending U.S. patent application Ser. No. 10/851,494, filed May 21, 2004, which is incorporated herein by reference, discloses a process for cracking hydrocarbon feedstock containing resid comprising: heating the feedstock; mixing the heated feedstock with steam to form a mixture stream; optionally further heating the mixture; flashing the mixture within a flash/separation vessel to form a vapor phase and a liquid phase; partially condensing the vapor phase within the vessel by contacting the vapor phase with a condenser to condense at least some coke precursors within the vapor while providing condensates which add to the liquid phase; removing the vapor phase of reduced coke precursors content as overhead and the liquid phase as bottoms; heating the vapor phase; cracking the heated vapor phase in a radiant section of a pyrolysis furnace to produce an effluent comprising olefins, and quenching the effluent and recovering cracked product therefrom. An apparatus for carrying out the process is also provided.

Co-pending U.S. patent application Ser. No. 10/851,487, filed May 21, 2004, which is incorporated herein by reference, discloses decoking of a process that cracks hydrocarbon feedstock containing resid and coke precursors, wherein steam is added to the feedstock to form a mixture which is thereafter separated into a vapor phase and a liquid phase by flashing in a flash/separation vessel, separating and cracking the vapor phase, and recovering cracked product. Coking of internal surfaces in and proximally downstream of the vessel is removed by interrupting the feed flow, purging the vessel with steam, introducing an air/steam mixture to at least partially combust the coke, and resuming the feed flow when sufficient coke has been removed. An apparatus for carrying out the process is also provided.

Co-pending U.S. patent application Ser. No. 10/851,434, filed May 21, 2004, which is incorporated herein by reference, discloses a highly efficient vapor/liquid separation apparatus for treating a flow of vapor/liquid mixtures of hydrocarbons and steam, which comprises a substantially cylindrical vertical drum having an upper cap section, a middle section comprising a circular wall, a lower cap section, a tangential inlet to introduce hydrocarbon/steam mixtures, an overhead vapor outlet, and a bottom outlet for liquid. The vessel also comprises an annular structure located in the middle section comprising (i) an annular ceiling section extending from the circular wall and (ii) a concentric internal vertical side wall to which the ceiling section extends. The annular structure blocks upward passage of vapor/liquid mixtures along the circular wall beyond the ceiling section, and surrounds an open core having sufficient cross-sectional area to permit vapor velocity low enough to avoid significant entrainment of liquid.

Co-pending U.S. patent application Ser. No. 10/851,546, filed May 21, 2004, which is incorporated herein by reference, discloses an apparatus and process for cracking hydrocarbon feedstock, wherein the temperature of heated effluent directed to a vapor/liquid separator, e.g., flash/separation vessel, whose overhead is subsequently cracked, can be controlled within a range sufficient so the heated effluent is partially liquid, such as from about 260 to about 540° C. (500 to 1000° F.). This permits processing of a variety of feeds containing resid with greatly differing volatilities, e.g., atmospheric resid and crude at higher temperature and dirty liquid condensates, at lower temperatures. The temperature can be lowered as needed by (i) providing one or more additional downstream feed inlets to a convection section, (ii) increasing the ratio of water/steam mixture added to the hydrocarbon feedstock, (iii) using a high pressure boiler feed water economizer to remove heat, (iv) heating high pressure steam to remove heat, (v) bypassing an intermediate portion of the convection section used, e.g., preheat rows of tube banks, and/or (vi) reducing excess oxygen content of the flue gas providing convection heat.

Co-pending U.S. patent application Ser. No. 10/851,486, filed May 21, 2004, which is incorporated herein by reference, discloses a process for cracking hydrocarbon feedstock containing resid comprising: heating the feedstock, mixing the heated feedstock with a fluid and/or a primary dilution steam stream to form a mixture, flashing the mixture to form a vapor phase and a liquid phase which collect as bottoms and removing the liquid phase, separating and cracking the vapor phase, and cooling the product effluent, wherein the bottoms are maintained under conditions to effect at least partial visbreaking. The visbroken bottoms may be steam stripped to recover the visbroken molecules while avoiding entrainment of the bottoms liquid. An apparatus for carrying out the process is also provided.

In using a flash to separate heavy liquid hydrocarbon fractions containing resid from the lighter fractions which can be processed in the pyrolysis furnace, it is important to effect the separation so that most of the non-volatile components will be in the liquid phase. Otherwise, heavy, coke-forming non-volatile components in the vapor are carried into the furnace causing coking problems.

Increasing the cut in the flash/separation vessel, or the fraction of the hydrocarbon that vaporizes, is also extremely desirable because resid-containing liquid hydrocarbon fractions generally have a low value, often less than heavy fuel oil. Vaporizing some of the heavier fractions produces more valuable steam cracker feed. This can be accomplished by increasing the flash/separation vessel temperature to increase the cut. However, the resulting vaporized heavier fractions tend to partially condense in the overhead vapor phase resulting in fouling of the lines and vessels downstream of the flash/separation vessel overhead outlet.

Accordingly, it would be desirable to provide a process for converting materials in the liquid phase in the flash/separation vessel to materials suitable as non-fouling components for the vapor phase.

Co-pending U.S. patent application Ser. No. 10/851,495, filed May 21, 2004, which is incorporated herein by reference, discloses a process and control system for cracking a heavy hydrocarbon feedstock containing non-volatile hydrocarbons comprising heating the heavy hydrocarbon feedstock, mixing the heated heavy hydrocarbon feedstock with a dilution steam stream to form a mixture stream having a vapor phase and a liquid phase, separating the vapor phase from the liquid phase in a separation vessel, and cracking the vapor phase in the furnace, wherein the furnace draft is continuously measured and periodically adjusted to control the temperature of the stream entering the vapor/liquid separator and thus controlling the ratio of vapor to liquid separated in the separation vessel; and wherein in a preferred embodiment the means for adjusting the draft comprises varying the speed of at least one furnace fan, possibly in combination with adjusting the position of the furnace fan damper(s) or the furnace burner damper(s).

Other applications of relevance to the various embodiments of the invention described herein are set forth in co-pending U.S. patent applications, Ser. No. 10/975,703, filed Oct. 28, 2004; Ser. No. 10/891,795, filed Jul. 14, 2004; Ser. No. 10/891,981, filed Jul. 14, 2004; Ser. No. 10/893,716, filed Jul. 16, 2004; Ser. No. 11/009,661, filed Dec. 10, 2004; and Ser. No. 11/068,615, filed Feb. 28, 2005, all of which are incorporated herein by reference.

SUMMARY OF THE INVENTION

In one aspect, the present invention relates to a process for cracking hydrocarbon feedstock containing resid which comprises:

(a) heating the hydrocarbon feedstock;

(b) mixing the heated hydrocarbon feedstock with steam to form a mixture stream upstream or downstream of (c);

(c) flashing the mixture stream to form a vapor phase overhead and a liquid phase which collects as bottoms;

(d) removing the bottoms;

(e) cracking the vapor phase to produce an effluent comprising olefins;

(f) quenching the effluent;

(g) recovering cracked product from the quenched effluent; and further comprising at least two of the following:

(1) maintaining the bottoms under conditions sufficient to effect at least partial visbreaking of the bottoms to provide lower boiling hydrocarbons;

(2) carrying out the flashing by introducing the mixture stream to a flash/separation apparatus to form (i) a vapor phase at its dew point and (ii) a liquid phase; addition of a superheated vaporous dilute to the vapor which superheats it reducing or eliminating the partial condensation caused by vapor temperature decrease effected by vapor phase cracking;

(3) carrying out the flashing by introducing the mixture stream in a flash/separation vessel through an inlet to form (i) a vapor phase at its dew point which contains a lesser portion of coke precursors and (ii) a liquid phase which contains a greater portion of coke precursors; and subsequently partially condensing the vapor phase within the flash/separation vessel by contacting the vapor phase with a condenser, which condenses at least some of the lesser portion of coke precursors, which adds to the liquid phase, the condensing providing a vapor phase above the condenser of reduced coke precursors content;

(4) carrying out the flashing of the mixture stream in a flash/separation vessel to form a coke precursor depleted vapor phase and a coke precursor rich liquid phase; removing the liquid phase through a bottom outlet and vapor phase with a trace of condensed vapor phase through an overhead outlet in the flash/separation vessel which vessel comprises internal surfaces and associated outlet piping, which surfaces and piping become coated during operation with the liquid phase and/or the condensed vapor phase and thereafter at least partially coked; determining the level of coking in the flash/separation vessel or in piping immediately downstream of the flash/separation vessel, and when a predetermined upper coke level is reached;

(i) interrupting flow of the hydrocarbon feedstock containing resid and coke precursors to the flash/separation vessel;

(ii) purging the flash/separation vessel with steam under conditions sufficient to substantially remove the vapor phase from the vessel and the liquid phase from the internal surfaces and/or outlet piping;

(iii) introducing an air/steam mixture through the flash/separation vessel under conditions sufficient to at least partially combust coke on the internal surfaces and outlet piping; and (iv) restarting the flow of the hydrocarbon feedstock to the flash/separation vessel when a predetermined lower coke level on the internal surfaces and/or outlet piping is reached;

(5) mixing the heated hydrocarbon feedstock with a primary dilution steam stream provides a heated two-phase stratified open channel flow mixture stream; and carrying out the flashing in a vapor/liquid separation apparatus for treating vapor/liquid mixtures of hydrocarbons and steam, the apparatus comprising:

(i) a substantially cylindrical vertical vessel having an upper cap section, a middle section comprising a circular wall, and a lower cap section;

(ii) an overhead vapor outlet attached to the upper cap section;

(iii) at least one substantially tangentially positioned inlet in the wall of the middle section for introducing the flow along the wall;

(iv) an annular structure located in the middle section, comprising (A) an annular ceiling section extending from the circular wall and (B) an internal vertical side wall to which the ceiling section extends, the side wall being positioned substantially concentrically to, but away from, the circular wall, the annular structure blocking the upward passage of the vapor/liquid mixtures along the circular wall beyond the ceiling section; and (v) a substantially concentrically positioned, substantially cylindrical boot of less diameter than the middle section, the boot communicating with the lower cap section, and further comprising an inlet for quench oil and a liquid outlet at its lower end;

(6) carrying out the heating of the hydrocarbon feedstock in a first tube bank of a convection zone of a furnace, the feedstock being introduced to the first tube bank through at least one of (I) an upper hydrocarbon feed inlet and (II) a lower hydrocarbon feed inlet;

carrying out the mixing of the hydrocarbon feedstock with water and steam added to the first tube bank via one or more inlets for introducing water and steam and removing the heated mixture stream through an outlet in the first tube bank, the water and steam being added in respective amounts which control the temperature of the heated mixture stream; and further controlling the temperature of the heated mixture stream by at least one of:

(i) regulating the temperature of a second tube bank of the convection zone positioned beneath the first tube bank, by introducing high pressure boiler feed water through an economizer inlet and withdrawing boiler feed water of greater heat content through an economizer outlet; and (ii) regulating the temperature of a third tube bank of the convection zone positioned beneath the first tube bank by introducing high pressure steam through an inlet for high pressure steam, heating the high pressure steam, mixing desuperheater water with the high pressure steam to cool the high pressure steam, reheating the high pressure steam and withdrawing superheated high pressure steam from the third tube bank through an outlet;

directing the heated mixture stream by a bypass line substantially external to the convection zone for receiving the heated mixture stream from the first tube bank to a fourth tube bank positioned beneath the second tube bank and the third tube bank, which fourth tube bank comprises an inlet connected to the bypass line and an outlet for directing a partially liquid effluent to a vapor/liquid separator;

carrying out the flashing by flashing the effluent from the fourth tube bank effluent in the vapor/liquid separator external to the convection zone to provide a liquid bottoms phase and an overhead vapor phase;

directing the overhead vapor phase to a fifth tube bank of the convection zone positioned beneath the fourth tube bank with an inlet for receiving overhead from the vapor/liquid separator and an outlet in order to further heat the overhead vapor phase; and carrying out the cracking by cracking the further heated overhead vapor phase in a radiant zone beneath the convection zone, which includes a plurality of burners producing flue gas passing upwards through the radiant zone and convection tube banks, to provide a cracked effluent; and withdrawing the cracked effluent from the radiant zone.

In another aspect, the present invention relates to an apparatus for cracking a hydrocarbon feedstock comprising resid, comprising:

(a) a heating zone for heating the hydrocarbon feedstock to provide heated hydrocarbon feedstock;

(b) a mixing zone for mixing a primary dilution steam stream with the heated hydrocarbon feedstock to provide a heated two-phase stratified open channel flow mixture stream;

(c) a vapor/liquid separation zone for treating vapor/liquid mixtures of hydrocarbons and steam to provide a vapor overhead and liquid bottoms;

(d) a pyrolysis furnace comprising a convection section, and a radiant section for cracking the vapor phase from the overhead vapor outlet to produce an effluent comprising olefins;

(e) a means for quenching the effluent;

(f) a recovery train for recovering cracked product from the quenched effluent; and (g) said apparatus further comprising at least two of the following:

(1) the vapor/liquid separation zone further comprising:

(i) a substantially cylindrical vertical flash/separation vessel having an upper cap section, a middle section comprising a circular wall, and a lower cap section;

(ii) an overhead vapor outlet extending upwardly from the upper cap section;

(iii) at least one inlet in the circular wall of the middle section for introducing the flow;

(iv) a substantially concentrically positioned, substantially cylindrical boot extending downwardly from the lower cap section for receiving separated liquid, the boot being of less diameter than the middle section and communicating with the lower cap section, and further comprising a liquid outlet at its lower end; and further comprising at least one of:

(v) a means for introducing heat directly to the lower cap section and/or the boot; and (vi) a means to regulate residence time of liquid present in the lower cap and/or boot;

(2) the vapor/liquid separation zone further comprising: a flash/separation vessel for treating the mixture stream to form (i) a vapor phase at its dew point which partially cracks causing a temperature decrease and partial condensation of the vapor phase in the absence of added heat and (ii) a liquid phase; the vessel further comprising;

(I) a means for reducing or eliminating the partial condensation comprising an inlet for adding heated vaporous diluent to the flash/separation vessel to superheat the vapor to an extent sufficient to at least partially compensate for the temperature decrease;

(II) a flash/separation vessel overhead outlet for removing the vapor phase as overhead;

(III) a flash/separation vessel liquid outlet for removing the liquid phase as bottoms from the flash/separation vessel;

(3) the vapor/liquid separation zone further comprising:

(i) a substantially cylindrical vertical vessel having an upper cap section, a middle section comprising a circular wall, and a lower cap section;

(ii) an overhead vapor outlet attached to the upper cap section;

(iii) at least one substantially tangentially positioned inlet in the wall of the middle section for introducing the flow mixture stream along the wall under flashing conditions where the flow mixture stream undergoes an initial flashing to form (A) a vapor phase at its dew point which contains a lesser portion of coke precursors and (B) a liquid phase which contains a greater portion of coke precursors;

(iv) a partial condenser for contacting the vapor phase within the vessel for at least partially condensing at least some of the lesser portion of coke precursors, which adds to the liquid phase, the condensing providing a vapor phase of reduced coke precursors content;

(v) a vessel overhead outlet for removing the vapor phase of reduced precursors content as overhead;

(vi) a vessel liquid outlet for removing the liquid phase as bottoms from the vessel;

(vii) a substantially concentrically positioned, substantially cylindrical boot of less diameter than the middle section, the boot communicating with the lower cap section, and further comprising an inlet for quench oil and a liquid outlet at its lower end;

(4) the flash zone further comprising a flash/separation vessel for flashing the mixture stream to form a coke precursor depleted vapor phase and a coke precursor rich liquid phase, the vessel comprising (i) a bottom outlet in the flash/separation vessel which comprises internal surfaces and associated outlet piping, which surfaces and piping during operation become coated with the liquid phase and thereafter at least partially coked;

(ii) an overhead outlet for removing the vapor phase and a trace of condensed vapor phase, which overhead outlet comprises internal surfaces and associated outlet piping, which surfaces and piping during operation become coated with condensed vapor phase and thereafter at least partially coked;

(iii) an inlet for introducing sufficient purging steam to the flash/separation vessel to remove the vapor phase from the vessel and the liquid phase from the internal surfaces and/or outlet piping; and (iv) an inlet for introducing an air/steam mixture through the flash/separation vessel under conditions sufficient to at least partially combust coke on the internal surfaces and/or outlet piping;

(5) the vapor/liquid separation zone further comprising:

(i) a substantially cylindrical vertical vessel having an upper cap section, a middle section comprising a circular wall, and a lower cap section;

(ii) an overhead vapor outlet attached to the upper cap section;

(iii) at least one substantially tangentially positioned inlet in the wall of the middle section for introducing the flow along the wall;

(iv) an annular structure located in the middle section, comprising (A) an annular ceiling section extending from the circular wall and (B) an internal vertical side wall to which the ceiling section extends, the side wall being positioned substantially concentrically to, but away from, the circular wall, the annular structure blocking the upward passage of the vapor/liquid mixtures along the circular wall beyond the ceiling section, and the annular structure circumscribing an open core having sufficient cross-sectional area to permit vapor velocity low enough to avoid significant entrainment of liquid; and (v) a substantially concentrically positioned, substantially cylindrical boot of less diameter than the middle section, the boot communicating with the lower cap section, and further comprising an inlet for quench oil and a liquid outlet at its lower end;

(6) the pyrolysis furnace further comprises:

(I) a convection zone containing:

(A) a first tube bank comprising (1) an upper hydrocarbon feed inlet, (2) an optional lower hydrocarbon feed inlet, (3) one or more inlets for introducing water and steam, and (4) an outlet for a heated mixture stream;

at least one of:

(B) a second tube bank positioned beneath the first tube bank comprising an economizer inlet for introducing high pressure boiler feed water and an economizer outlet for withdrawing boiler feed water of greater heat content; and (C) a third tube bank positioned beneath the first tube bank comprising an inlet for high pressure steam which is heated in a section of the third tube bank, an inlet for mixing desuperheater water with the high pressure steam to cool the high pressure steam, a section for reheating the high pressure steam, and an outlet for withdrawing superheated high pressure steam;

and further comprising:

(D) a bypass line for receiving the heated mixture stream from the first tube bank;

(E) a fourth tube bank positioned beneath the second tube bank and the third tube bank which comprises an inlet connected to the bypass line and an outlet for directing effluent to a vapor/liquid separator;

(F) a fifth tube bank positioned beneath the fourth tube bank with an inlet for receiving overhead from the vapor/liquid separator and an outlet; and (II) a radiant zone beneath the convection zone which includes a plurality of burners producing flue gas passing upwards through the radiant zone and convection tube banks, which radiant zone receives effluent from the fifth tube bank and further comprises an outlet for removing cracked effluent.

In yet another aspect, the present invention relates to a vapor/liquid separation apparatus for treating a flow of vapor/liquid mixtures of hydrocarbons and steam, comprising (a) a substantially cylindrical vertical vessel having an upper cap section, a middle section comprising a circular wall, and a lower cap section; (b) an overhead vapor outlet extending upwardly from the upper cap section; (c) at least one inlet in the circular wall of the middle section for introducing the flow; (d) a substantially concentrically positioned, substantially cylindrical boot extending downwardly from the lower cap section for receiving separated liquid, the boot being of less diameter than the middle section and communicating with the lower cap section, and further comprising a liquid outlet at its lower end; and further comprising at least one of (e) a means for introducing heat directly to the lower cap section and/or the boot; and (f) a means to regulate residence time of liquid present in the lower cap and/or the boot.

The present invention provides a process and control system for cracking a heavy hydrocarbon feedstock containing non-volatile hydrocarbons comprising heating the heavy hydrocarbon feedstock, mixing the heated heavy hydrocarbon feedstock with a dilution steam stream to form a mixture stream having a vapor phase and a liquid phase, separating the vapor phase from the liquid phase in a separation vessel, and cracking the vapor phase in the furnace.

The furnace has draft which is continuously measured and periodically adjusted to control the temperature of the stream entering the separation vessel and thus control the ratio of vapor to liquid separated in the separation vessel. In a preferred embodiment, the means for adjusting the draft comprises varying the speed of at least one furnace fan, possibly in combination with adjusting the position of the furnace fan damper(s) or the furnace burner damper(s).

The process further comprises measuring the temperature of the vapor phase after the vapor phase is separated from the liquid phase; comparing the vapor phase temperature measurement with a predetermined vapor phase temperature; and adjusting the draft in said furnace in response to said comparison.

In one embodiment, the temperature of the hot mixture stream can be further controlled by varying at least one of the flow rate or the temperature of the primary dilution steam stream. In another embodiment, the heated heavy hydrocarbon feedstock can also be mixed with a fluid prior to separating the vapor phase from the liquid phase, and the fluid can be at least one of liquid hydrocarbon and water. The temperature of the hot mixture stream can be further controlled by varying the flow rate of the fluid mixed with the heated hydrocarbon feedstock. The temperature of said hot mixture stream can also be further controlled by varying the flow rate of both the primary dilution steam stream and the flow rate of the fluid mixed with said heated heavy hydrocarbon feedstock.

In another embodiment, a secondary dilution steam stream is superheated in the furnace and at least a portion of the secondary dilution steam stream is then mixed with said hot mixture stream before separating the vapor phase from the liquid phase. With this embodiment, the temperature of the hot mixture stream can be further controlled by varying the flow rate and temperature of the secondary dilution steam stream. A portion of the superheated secondary dilution steam stream can be mixed with said vapor phase after separating said vapor phase from said liquid phase.

The use of primary dilution steam stream is optional for very high volatility feedstocks (e.g., ultra light crudes and contaminated condensates). It is possible that such feedstocks can be heated in the convection section, forming a vapor and a liquid phase and which is conveyed as heated hydrocarbon stream directly to the separation vessel without mixing with dilution steam. In that embodiment, the vapor phase and the liquid phase of the heated hydrocarbon feedstock will be separated in a separation vessel and the vapor phase would be cracked in the radiant section of the furnace. The furnace draft would be mixed with dilution steam and continuously measured and periodically adjusted to control the temperature of at least one of the heated hydrocarbon stream and the vapor phase separated from the liquid phase.

DETAILED DESCRIPTION OF THE INVENTION

Figure 1:
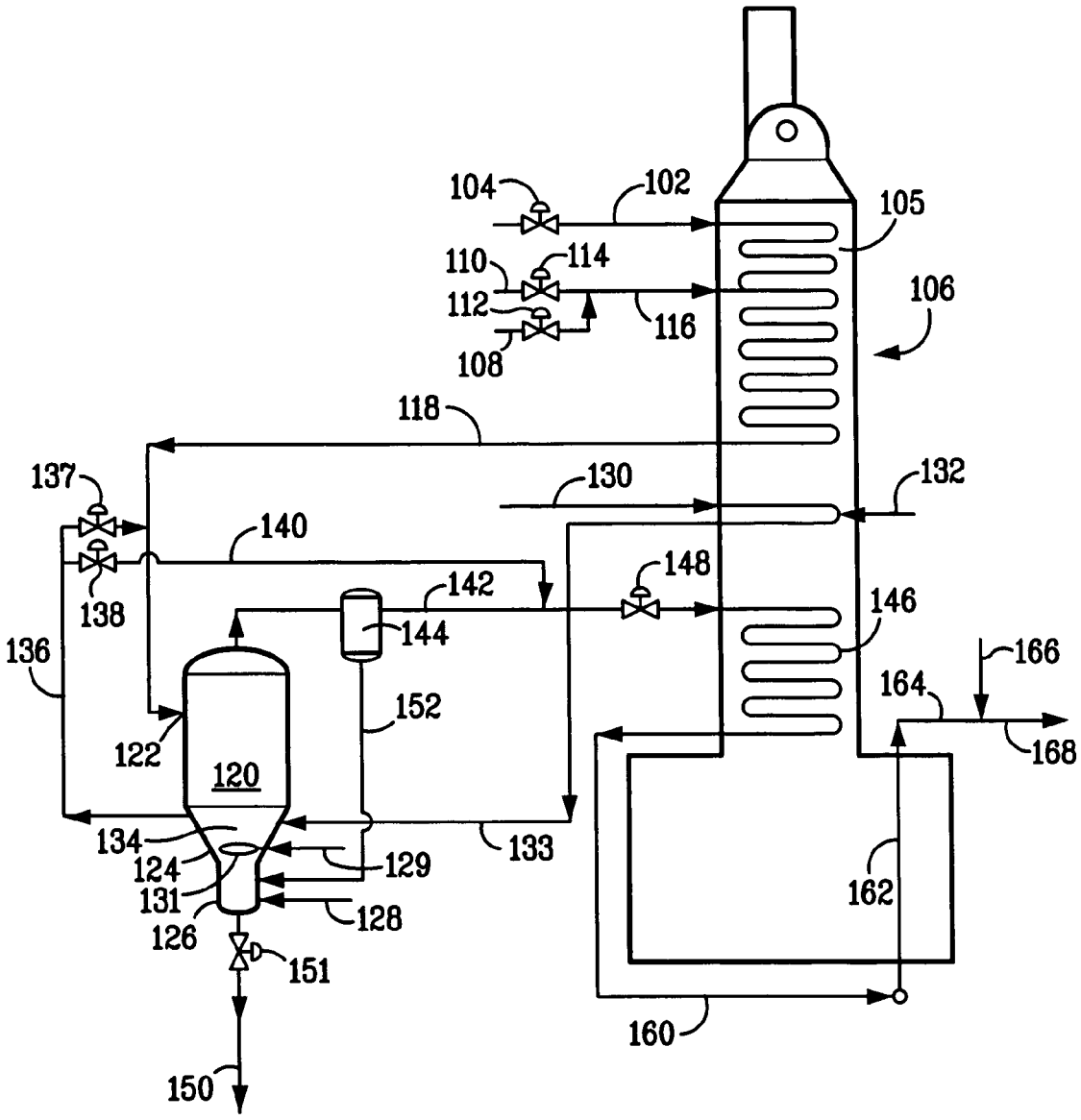
FIG. 1 illustrates a schematic flow diagram of a process in accordance with the present invention employed with a flash/separation vessel bottoms heater.

Unless otherwise stated, all percentages, parts, ratios, etc., are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, resids are non-volatile components, e.g., the fraction of the hydrocarbon feed with a nominal boiling point above about 590° C. (1100° F.) as measured by ASTM D-6352-98 or D-2887. This invention works very well with non-volatiles having a nominal boiling point above about 760° C. (1400° F.). As used herein, "resid" refers to the fraction of the hydrocarbon feed with a nominal boiling point above about 510° C. (950° F.) and includes any non-volatile components present in the feed. The boiling point distribution of the hydrocarbon feed is measured by Gas Chromatograph Distillation (GCD) ASTM D-6352-98 or D-2887, extended by extrapolation for materials boiling above 700° C. (1292° F.). Non-volatile components can include coke precursors which are large, condensable molecules in the vapor which condense, and then form coke under the operating conditions encountered in the present process of the invention.

Visbreaking

Visbreaking is a well-known mild thermal cracking process in which heavy hydrocarbon feedstock oils may be heat soaked to reduce their viscosity by cracking in the liquid phase. See, for example, Hydrocarbon Processing, September 1978, page 106. Visbreaking occurs when a heavy hydrocarbon, or resid, is heat soaked at high temperature, generally from about 427 to about 468° C. (800 to 875° F.), for several minutes. Some of the resid molecules crack or break producing less viscous resid. Raising the liquid level in the flash/separation apparatus increases residence time to increase conversion of the resid.

While lighter visbroken molecules vaporize without additional processing, steam stripping may be necessary to vaporize heavier visbroken molecules. The visbreaking reactions are rapid enough that purge steam may be added to the flash/separation vessel to strip the visbroken molecules. This increases the fraction of the hydrocarbon vaporizing in the flash/separation vessel. Heating may also be used to increase resid conversion.

Visbreaking can be controlled by modifying the residence times of the liquid phase within the flash/separation apparatus. In one embodiment, the liquid phase level may be raised to fill the head of the flash/separation vessel, thus increasing residence time of the resid molecules to an extent sufficient to effect at least partial visbreaking. The addition of heat accelerates visbreaking in the liquid phase which collects as bottoms in the lower portion of the flash/separator vessel. In one embodiment of the present invention, a heater in the lower section of a flash/separation vessel is used in conjunction with the convection section of a steam cracking furnace, to provide the needed heat. The added heat keeps the resid hot enough to effect significant visbreaking conversion.

Quenching the effluent leaving the pyrolysis furnace may be carried out using a transfer line exchanger, wherein the amount of the fluid mixed with the hydrocarbon feedstock is varied in accordance with at least one selected operating parameter of the process. The fluid can be a hydrocarbon or water, preferably water.

In an embodiment of the present invention, the mixture stream is heated to vaporize any water present and at least partially vaporize hydrocarbons present in the mixture stream. Additional steam can be added to the mixture stream after the mixture stream is heated.

In one embodiment, water is added to the heated hydrocarbon feedstock prior to the flashing.

In an embodiment, the mixture stream is further heated, e.g., by convection heating, prior to the flashing.

In another embodiment, the conditions for effecting at least partial visbreaking of the bottoms comprise maintaining sufficient residence times for the bottoms prior to their removal. Such residence times can be controlled by adjusting the level of the bottoms in the flash/separation vessel.

In an embodiment of the present invention, the conditions for effecting at least partial visbreaking of the bottoms comprise introducing additional heat to the bottoms. Typically, the additional heat is introduced to the bottoms by contacting the bottoms with at least one heating coil, although any other suitable method known to those of skill in the art can be used. For present purposes, a heating coil need not be limited in shape to a coil, but can be of any suitable shape sufficient to impart the heat required by the process of the present invention, e.g., serpentine, parallel with end manifolds, etc. The heating coil typically comprises a tube with a heat exchange medium within the tube, e.g., the at least one heating coil can contain steam, preferably superheated, as a heat exchange medium. Steam can be introduced to the heating coil at a temperature of at least about 510° C. (950° F.), e.g., at an initial temperature of about 540° C. (1000° F.). The steam loses heat within the flash/separation vessel and is withdrawn from the heating coil at a lower temperature, such as from about 10 to about 70° C. (20 to about 125° F.) lower, e.g., about 40° C. (72° F.) lower. The steam can be obtained by any suitable source, e.g., by convection heating of at least one of water and steam. The steam is typically heated in a convection section of the furnace and passed to the heating coil. After passage through the heating coil(s), the discharged steam is withdrawn from the bottoms section and routed to a point within the flash/separation vessel above the bottoms section or is mixed with the steam/hydrocarbon mixture that is flowing to the vapor/liquid separation vessel.

In another embodiment of the present invention, the at least one coil is located in an elliptical head in the lower portion of a flash/separation vessel wherein the flashing occurs.

In one embodiment, the at least one coil is located in a conical section in the lower portion of a flash/separation vessel wherein the flashing occurs. The bottoms are typically removed as a downwardly plug flowing pool.

Conditions are maintained within the vapor/liquid separation apparatus so as to maintain the liquid bottoms at a suitable temperature, typically at least about 427° C. (800° F.), e.g., at a temperature ranging from about 427 to about 500° C. (800 to 932° F.). In order to effect the desired partial visbreaking of the present invention, additional heat is added at a suitable rate, typically, a rate selected from at least one of (i) about 0.3 MW and (ii) at least about 0.3% of the furnace firing rate. Preferably, additional heat can be added at a rate selected from at least one of (i) about 0.3 to about 0.6 MW and (ii) about 0.3 to about 0.6% of the furnace firing rate. The added heat can effect sufficient partial visbreaking to convert at least about 10%, such as greater than about 25%, for example greater than about 30%, or even at least about 40%, of resid in the bottoms to a 510° C.$^{-}$ (950° F.$^{-}$) fraction.

In one embodiment, the process of the present invention further comprises stripping the lower boiling hydrocarbons from the bottoms to provide additional vapor phase overhead. Such stripping is typically carried out with steam, e.g., stripping steam added at a rate ranging from about 18 to about 4000 kg/hr (40 to 9000 lbs/hr), such as a rate of about 900 kg/hr (2000 lbs/hr). Preferred stripping steam rates range from about 0.03 to about 6.0 wt. % based on the total hydrocarbon feed to the convection section of the furnace.

In another embodiment of the present invention, the at least one coil is located in an elliptical head in the lower portion of a flash/separation vessel wherein the flashing occurs.

In one embodiment, the apparatus of the present invention further comprises an inlet for introducing stripping steam into the lower cap and/or the boot. The lower cap section can be of any suitable shape, typically, at least one of (i) substantially hemispherical and (ii) substantially semi-elliptical in longitudinal section.

The stripping steam is preferably added through a plurality of nozzles distributed in the lower cap or in the boot effecting good contact with the bottoms liquid and a velocity low enough to avoid entrainment of the bottoms liquid.

In another embodiment, the lower cap section of the apparatus is conical and can be advantageously pitched to an extent sufficient to provide downward plug flow of the separated liquid.

In an embodiment, the apparatus of the present invention has a means to regulate the residence time of the liquid in the boot, which utilizes a control valve to regulate removal of the separated liquid from the boot. Preferably, the means to regulate the residence time comprises a means to provide a liquid level within the boot and above the boot within the lower cap.

The apparatus of the present invention typically comprises at least one inlet in the circular wall of the middle section for introducing the flow that is a radial inlet or, more preferably, a substantially tangential inlet for introducing the flow along the wall. The flow is nearly straight down the wall to the lower cap. The means for introducing heat can be a heat-conducting coil mounted in the lower cap section and/or the boot which contains a heat carrying medium so that liquid adjacent the outside of the coil is heated. Any suitable heat carrying medium can be used, preferably steam.

In one embodiment, the apparatus comprises a tubular member or coil made of a material which permits efficient heat exchange, e.g., metal. The coil is advantageously substantially planar in shape and horizontally mounted, thus providing for the advantageous locating of the heating coil within the vapor/liquid separation apparatus. The coil can be continuous and comprised of alternating straight sections and 180° bend sections beginning with a straight inlet section and terminating in a straight outlet section; or alternately, the coil can comprise a substantially straight inlet communicating with an inlet manifold substantially perpendicular to the straight inlet, at least two parallel tubes substantially perpendicular to and communicating with the inlet manifold and substantially perpendicular to and communicating with an outlet manifold, and a substantially straight outlet perpendicular to and communicating with the outlet manifold. Typically, the coil is of sufficient diameter to effect a moderate pressure drop. In one embodiment, the coil has a diameter ranging from about 2.5 to about 15 cm (1 to 6 in), e.g., a diameter of about 10 cm (4 in).

In one embodiment, the apparatus comprises two or more sets of coils, one above the other(s).

In another embodiment, the apparatus of the present invention comprises a boot which comprises several internal modifications for improved operation. The boot can further comprise at least one of (i) an inlet for quench oil and (ii) a side inlet for introducing fluxant which can be added to control the viscosity of the liquid in the boot.

In applying this invention, the hydrocarbon feedstock containing resid may be heated by indirect contact with flue gas in a first convection section tube bank of the pyrolysis furnace before mixing with the fluid. Preferably, the temperature of the hydrocarbon feedstock is from 150 to 260° C. (300 to 500° F.) before mixing with the fluid.

The mixture stream may then be further heated by indirect contact with flue gas in a first convection section of the pyrolysis furnace before being flashed. Preferably, the first convection section is arranged to add the fluid, and optionally primary dilution steam, between rows of that section such that the hydrocarbon feedstock can be heated before mixing with the fluid and dilution steam and then the mixture stream typically can be further heated before being flashed.

The temperature of the flue gas entering the first convection section tube bank is generally less than about 815° C. (1500° F.), for example, less than about 700° C. (1300° F.), such as less than about 620° C. (1150° F.), and preferably less than about 540° C. (1000° F.).

Dilution steam may be added at any point in the process, for example, it may be added to the hydrocarbon feedstock containing resid before or after heating, to the mixture stream, and/or to the vapor phase. Any dilution steam stream may comprise sour steam. Any dilution steam stream may be heated or superheated in a convection section tube bank located anywhere within the convection section of the furnace, preferably in the first or second tube bank.

The mixture stream may be at about 315 to about 540° C. (600° F. to 1000° F.) before the flash and the flash pressure may be about 275 to about 1375 kPa (40 to 200 psia). Following the flash, 50 to 98% of the mixture stream may be in the vapor phase. An additional separator such as a centrifugal separator may be used to remove trace amounts of liquid from the vapor phase. The vapor phase may be heated to above the flash temperature before entering the radiant section of the furnace, for example, to a temperature of about 425 to about 705° C. (800 to 1300° F.). This heating may occur in a convection section tube bank, preferably the tube bank nearest the radiant section of the furnace.

The hydrocarbon feedstock can comprise a large portion, such as about 5 to about 50%, of non-volatile components, i.e., resid. Such feedstock could comprise, by way of non-limiting examples, one or more of steam cracked gas oils and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixtures, naphtha/residue admixtures, hydrocarbon gas/residue admixtures, hydrogen/residue admixtures, gas oil/residue admixtures, and crude oil.

The hydrocarbon feedstock can have a nominal end boiling point of at least about 315° C. (600° F.), generally greater than about 510° C. (950° F.), typically greater than about 590° C. (1100° F.), for example, greater than about 760° C. (1400° F.). The economically preferred feedstocks are generally low sulfur waxy residues, atmospheric residues, naphthas contaminated with crude, various residue admixtures, and crude oil.

In an embodiment of the present invention depicted in FIG. 1, hydrocarbon feed containing resid stream 102, e.g., atmospheric resid, controlled by feed inlet valve 104 is heated in an upper convection section 105 of a furnace 106. Then steam stream 108 and water stream 110, controlled by valves 112 and 114, respectively, are mixed through line 116 with the hydrocarbon in the upper convection section. The mixture is further heated in the convection section where all of the water vaporizes and a fraction of the hydrocarbon vaporizes.

Exiting upper convection section 105, the mixture stream 118, generally at a temperature of about 455° C. (850° F.) enters a vapor/liquid separation apparatus or flash/separation vessel 120 by a tangential inlet 122 where a vapor/liquid separation occurs. The vapor is at its dew point. The liquid resid falls to either an elliptical head (as shown in 327 of FIG. 3) or a conical bottom section 124 of the flash/separation vessel and into a cylindrical boot 126 where quench oil introduced via line 128 prevents excessive coking of the liquid bottoms. The flow pattern of the heated resid follows plug flow in the coned bottom section. Dead spots are generally infrequent in the downward flowing pool of liquid resid in the coned bottom section, preventing excess liquid residence time. In dead spots, coke can form due to severe but localized visbreaking reactions. The coned bottom section of the flash/separation vessel may have a steep pitch in order to maintain plug flow of the liquid resid. In one embodiment, visbreaking occurs in the conical bottoms pool, without a heater, provided sufficient residence time for the liquid bottoms is maintained. Steam may be directly injected into the liquid bottoms via line 129 and distributor 131 in the liquid phase to strip and agitate the pool of resid.

Additional dilution steam stream 130 is superheated in the convection section 106, desuperheated by water 132, and further heated in convection section 106 providing a 540° C. (1000° F.) steam stream and passed via line 133 to an inlet of steam heater 134 which comprises a heating coil. The cooled steam stream having a temperature of about 495° C. (925° F.) is discharged through an outlet of the steam heater via line 136. This discharged steam is further utilized by introduction via valve 137 to line 118 to vaporize additional hydrocarbon before the mixture in 118 enters the flash/separation vessel 120 and/or by adding the discharged steam via control valve 138 and line 140 to the steam/hydrocarbon vapor 142 taken as an outlet from centrifugal separator 144, prior to further heating in a lower convection section 146, controlled by valve 148. Centrifugal separator bottoms are introduced via line 152 to the boot 126. Fluxant which reduces the viscosity of the partially visbroken liquid in the boot 126 can be added via line 152 taken from centrifugal separator 144.

Raising or maintaining the liquid level in the flash/separation vessel 120 to fill the bottom head of the vessel before discharge through line 150 provides enough residence time to effect significant partial visbreaking of the resid liquid. A control valve 151 provides for regulating the amount of liquid bottoms withdrawn from the boot 126 for heat recovery and use as fuel oil. Reactor modeling predicts that 30% to 70% of resid from crude will be converted into molecules with boiling points less than 510° C. (950° F.), often referred to herein as 510° C.$^-$ (950° F.$^-$). Steam stripping may be necessary to vaporize the visbroken molecules. But, the stripping steam bubbles (void space) will reduce the effective liquid residence time in the bottom head. A 45 kg/hr (100 lbs/hr) steam purge will reduce the effective resid residence time by about 50% and resid conversion to only 23%. To counter this effect, as visbreaking is endothermic, mild heating of the resid increases its conversion to 510° C.$^-$ (950° F.$^-$) molecules.

In an embodiment of the invention, the liquid bottoms 150 can be recycled to another furnace with a flash/separation vessel, which is cracking a lighter feed, say any HAGO or condensate. The lighter feed will completely vaporize upstream of the flash/separation vessel while vaporizing the 510° C.$^-$ (950° F.$^-$) fraction in the recycle bottoms, providing additional feed to the radiant section.

The steam/hydrocarbon vapor derived from the flash/separation vessel overhead passes from the lower convection section 146 via crossover piping 160 through the radiant section 162 of the furnace and undergoes cracking. The cracked effluent exits the radiant section through line 164 and is quenched with quench oil 166 before further treatment by the recovery train 168.

Figure 2:
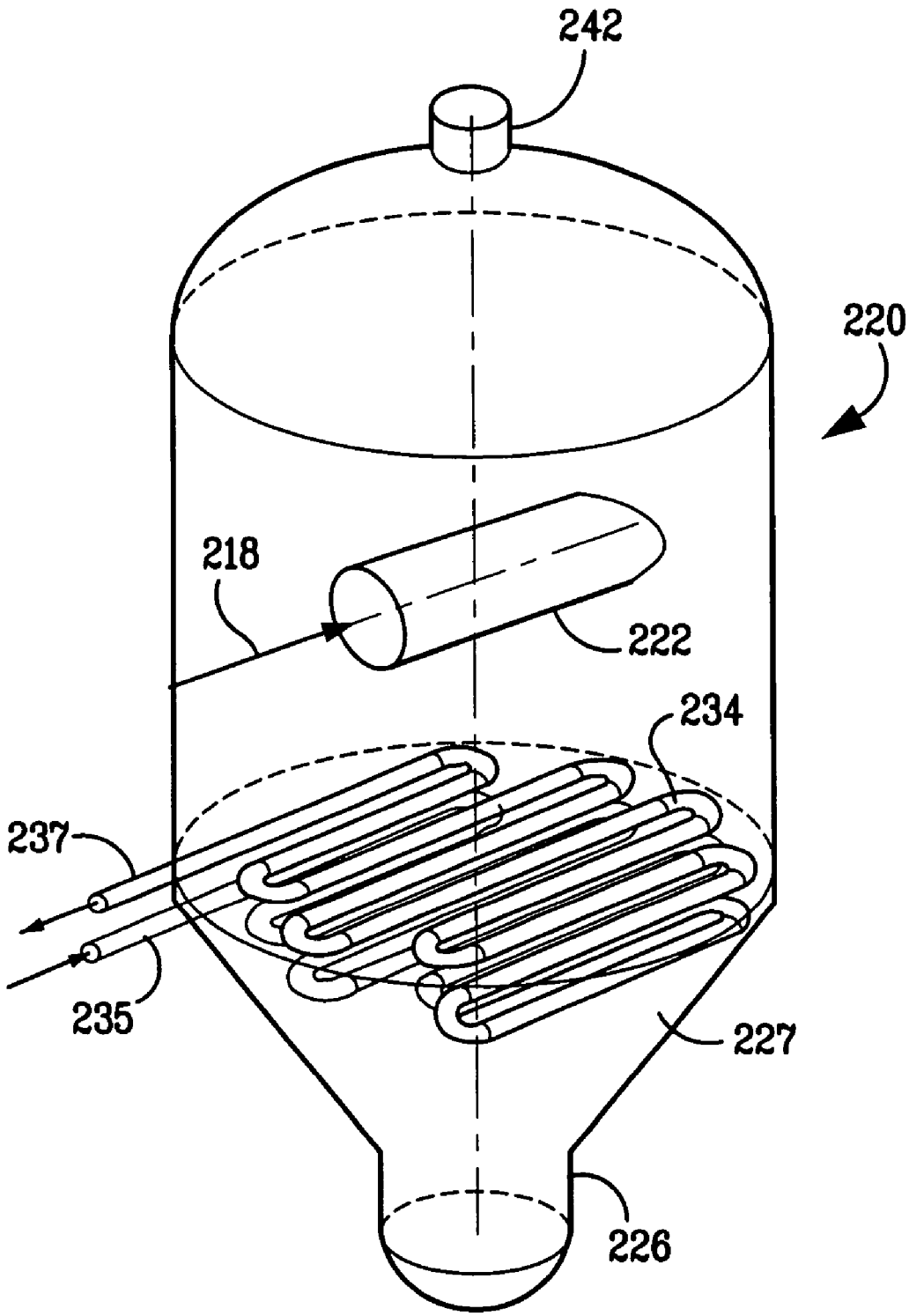
FIG. 2 illustrates a detailed perspective view of a flash/separation vessel with a conical bottom in accordance with one embodiment of the present invention.

FIG. 2 depicts a detailed view of a liquid/vapor separation or flash/separation vessel 220 with conical bottom section as used in an embodiment of the present invention. A hydrocarbon/steam mixture 218 to be flashed is introduced via tangential inlet 222. Based on a superheated steam flow rate of 11,000 kg/hr (25,000 lbs/hr) the coil geometry of the steam heater 234 located in conic lower cap section 227 generally may be at least 2 rows in substantially parallel planes, each row having about 8 straight passes. The steam heater 234 which comprises a 10 cm (4 in) metal tube includes a steam inlet 235 for 540° C. (1000° F.) steam and a steam outlet 237 for 495° C. (925° F.) steam. The bare coil length is about 36 m (120 ft), which results in about 0.3 MW (0.3% of furnace firing) of resid heating increasing resid conversion [to 510° C.$^-$ (950° F.$^-$) molecules] from 23 to 40%. A longer coil of about 70 m (230 ft) increases heating to 0.6 MW (0.6% of firing) increasing conversion to about 60%. The exiting steam can then flow into the process entering the vessel or into the overhead from centrifugal separator as noted in the description of FIG. 1. Vapor is removed as overhead from the flash/separation vessel via outlet 242.

Heating of resid allows for the use of purge stripping steam. Without purge steam, visbroken molecules may not vaporize. Removal of visbroken molecules also reduces the risk that visbroken resid will cause cavitation in bottoms pumps.

Figure 3:
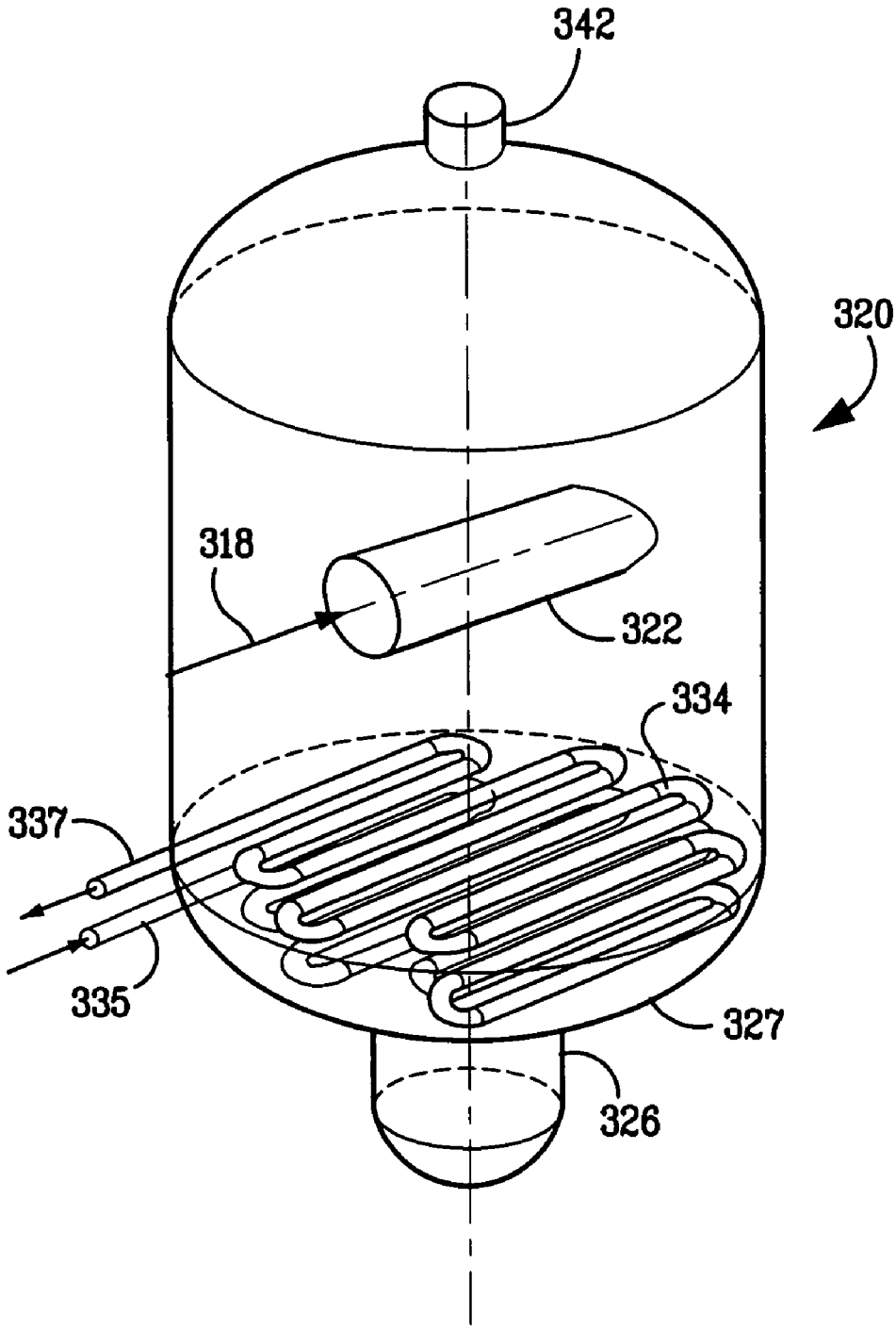
FIG. 3 depicts a detailed perspective view of a flash/separation vessel with a bottom section which is semi-elliptical in longitudinal section in accordance with one embodiment of the present invention.

FIG. 3 depicts a detailed view of a liquid/vapor separation or flash/separation vessel 320 with bottom section of semi-elliptical shape in longitudinal profile, as used in an embodiment of the present invention. A hydrocarbon/steam mixture 318 to be flashed is introduced via tangential inlet 322. Based on a superheated steam flow rate of 11,000 kg/hr (25,000 lbs/hr) the coil geometry of the steam heater 334 located in elliptical lower cap section 327 generally may be at least 2 rows in substantially parallel planes, each row having about 8 straight passes. The steam heater 334 which comprises a 10 cm (4 in) metal tube includes a steam inlet 335 for 540° C. (1000° F.) steam and a steam outlet 337 for 495° C. (925° F.) steam. The exiting steam can flow into the process entering the flash/separation vessel 320 or into the overhead from centrifugal separator as noted in the description of FIG. 1. Vapor is removed as overhead from the vessel via outlet 342.

Adding Heated Vaporous Diluent to Flash

When heavy resid-containing hydrocarbon feeds are used, the feed is preheated in the upper convection section of a pyrolysis furnace, mixed with steam and, optionally, water and then further preheated in the convection section, where the majority of the hydrocarbon vaporizes, but not the resid. This two-phase mist flow stream may pass through a series of pipe bends, reducers, and piping that convert the two-phase mist flow to two-phase stratified open channel flow, i.e., the liquid flows primarily through the bottom cross-section of the pipe and the vapor phase flows primarily though the remaining upper cross-section of the pipe. The stratified open channel flow is introduced through a tangential inlet to a flash/separation apparatus, e.g., a knockout vessel, where the vapor and liquid separate. It has been observed that the resulting hydrocarbon/steam vapor phase is at its dew point and is hot enough to crack, reducing the vapor temperature by about 8° C. (15° F.) or even about 12° C. (22° F.) or more, before it is further preheated in the lower convection section and then cracked in the radiant section of the furnace. This cooling effect condenses a portion of the heaviest hydrocarbon. The condensate dehydrogenates into foulant that limits both the time between decoking treatments and the maximum amount of hydrocarbon present as vapor in the flash/separation apparatus. Microscopic analysis of the foulant indicates it is derived from liquid hydrocarbon.

Accordingly, it would be desirable to provide a process for cracking hydrocarbons in which liquid condensation from the vapor in the flash/separation apparatus is reduced or eliminated.

In one aspect, the present invention relates to a process for cracking a hydrocarbon feedstock containing resid, the process comprising (a) heating the hydrocarbon feedstock; (b) mixing the heated hydrocarbon feedstock with steam to form a mixture stream; (c) introducing the mixture stream to a flash/separation apparatus to form (i) a vapor phase at its dew point which partially cracks causing a temperature decrease and partial condensation of the vapor phase in the absence of added heat and (ii) a liquid phase; (d) reducing or eliminating the partial condensation by adding a heated vaporous diluent to the flash/separation apparatus to an extent sufficient to at least partially compensate for the temperature decrease and to dilute and superheat the vapor phase; (e) removing the vapor phase as overhead and the liquid phase as bottoms from the flash/separation apparatus; (f) indirectly heating the vapor phase, e.g., by convection; (g) cracking the heated vapor phase in a radiant section of a pyrolysis furnace to produce an effluent comprising olefins, the pyrolysis furnace comprising a radiant section and a convection section; and (h) quenching the effluent and recovering cracked product therefrom.

In one embodiment of this aspect of the invention, the heated vaporous diluent is introduced to the flash/separation apparatus above where the mixture stream is introduced.

In another embodiment, the heated vaporous diluent to the flash/separation apparatus is added as at least one of heated light hydrocarbon (e.g., ethane) and superheated steam.

In still another embodiment of this aspect of the invention, the temperature decrease in the absence of the added heated vaporous diluent is at least about 8° C. (15° F.), e.g., at least about 12° C. (22° F.), and the heat added to the vapor/liquid separation apparatus is sufficient to overcome at least about 20% of the temperature decrease, such as at least about 50% of the temperature decrease, or even at least about 100% of the temperature decrease, e.g., from about 100% to about 200% of the temperature decrease.

In yet another embodiment of this aspect of the invention, the superheated steam has a temperature of at least the temperature of the mixture entering the flash/separation apparatus, generally at least about 454° C. (850° F.), typically ranging from about 477 to about 565° C. (890 to 1050° F.).

In still yet another embodiment, the heated vaporous diluent is added to an extent which does not significantly increase liquid entrainment in the vapor phase, such entrainment being measured by sampling the overhead vapor, condensing, and analyzing for resid.

In another embodiment of this aspect of the invention, the adding of the heated vaporous diluent increases vapor velocity by no greater than about 30%, typically by no greater than about 10%.

In yet another embodiment, the mixture stream is introduced through a side of the flash/separation apparatus via at least one tangential inlet. Typically, the superheated steam is introduced to the flash/separation apparatus above the tangential inlet.

In still another embodiment, the mixture stream is introduced as a two-phase stratified open channel flow.

In another aspect, the present invention relates to a flash/separation vessel for treating hydrocarbon feedstock containing resid to provide a liquid phase and a vapor phase which comprises (a) an inlet for introducing the hydrocarbon feedstock; (b) an inlet for adding heated vaporous diluent to the flash/separation vessel to dilute the vapor phase; (c) a flash/separation vessel overhead outlet for removing the vapor phase as overhead; and (d) a flash/separation vessel liquid outlet for removing the liquid phase as bottoms from the flash/separation vessel.

In one embodiment of this aspect of the invention, the flash/separation vessel further comprises an inlet for introducing the heated vaporous diluent to the flash/separation vessel located above the inlet for introducing the hydrocarbon feedstock. Typically, the heated vaporous diluent to the flash/separation vessel is added as at least one of heated light hydrocarbon (e.g., ethane) and superheated steam.

In another embodiment, the flash/separation vessel comprises an inlet through which the heated vaporous diluent is added to the flash/separation vessel as superheated steam.

In still another embodiment, the flash/separation vessel comprises at least one tangential inlet for introducing the hydrocarbon feedstock through a side of the flash/separation vessel.

In another embodiment, the flash/separation vessel comprises an inlet for introducing steam to the flash/separation vessel above the tangential inlet.

In yet another embodiment, the flash/separation vessel further comprises a cooling coil for partially condensing the vapor phase located above the inlet where the hydrocarbon feedstock is introduced.

In still yet another embodiment of the present invention, the flash/separation vessel further comprises sheds positioned below the cooling coil and above the inlet where the hydrocarbon feedstock is introduced.

In another aspect, the present invention relates to an apparatus for cracking a hydrocarbon feedstock containing resid, the apparatus comprising (a) a convection heater for heating the hydrocarbon feedstock; (b) an inlet for introducing steam to the heated hydrocarbon feedstock to form a mixture stream; (c) a flash/separation vessel for treating the mixture stream to form (i) a vapor phase at its dew point which partially cracks causing a temperature decrease and partial condensation of the vapor phase in the absence of added heat and (ii) a liquid phase, the vessel further comprising (1) a means for reducing or eliminating the partial condensation comprising an inlet for adding heated vaporous diluent to the flash/separation vessel to an extent sufficient to at least partially compensate for the temperature decrease and dilute and superheat the vapor phase, (2) a flash/separation vessel overhead outlet for removing the vapor phase as overhead, (3) a flash/separation vessel liquid outlet for removing the liquid phase as bottoms from the flash/separation vessel; (d) a convection heater for heating the vapor phase; (e) a pyrolysis furnace comprising a radiant section for cracking the heated vapor phase to produce an effluent comprising olefins, and a convection section; and (f) means for quenching the effluent and recovering cracked product therefrom.

In one embodiment of this aspect of the present invention, the heated vaporous diluent is introduced to the flash/separation vessel through an inlet above where the mixture stream is introduced. Typically, the heated vaporous diluent to the flash/separation vessel is added as at least one of heated light hydrocarbon and superheated steam.

In still another embodiment, the apparatus of the invention comprises at least one tangential inlet for introducing the mixture stream through a side of the flash/separation vessel. Typically, the apparatus comprises an inlet for introducing steam to the flash/separation vessel above the tangential inlet.

In still yet another embodiment, the flash/separation vessel of the apparatus further comprises a cooling coil for partially condensing the vapor phase above the inlet where the mixture stream is introduced. Typically, the flash/separation vessel further comprises liquid/vapor contacting surfaces, e.g., sheds, positioned below the cooling coil and above the inlet where the mixture stream is introduced.

The present invention relates to a process for heating and steam cracking hydrocarbon feedstock containing resid. The process comprises heating the hydrocarbon feedstock, mixing the hydrocarbon feedstock with a fluid to form a mixture, flashing the mixture to form a vapor phase and a liquid phase, feeding the vapor phase to the radiant section of a pyrolysis furnace, and subsequently quenching the reaction, e.g., by using a transfer line exchanger.

Figure 4:
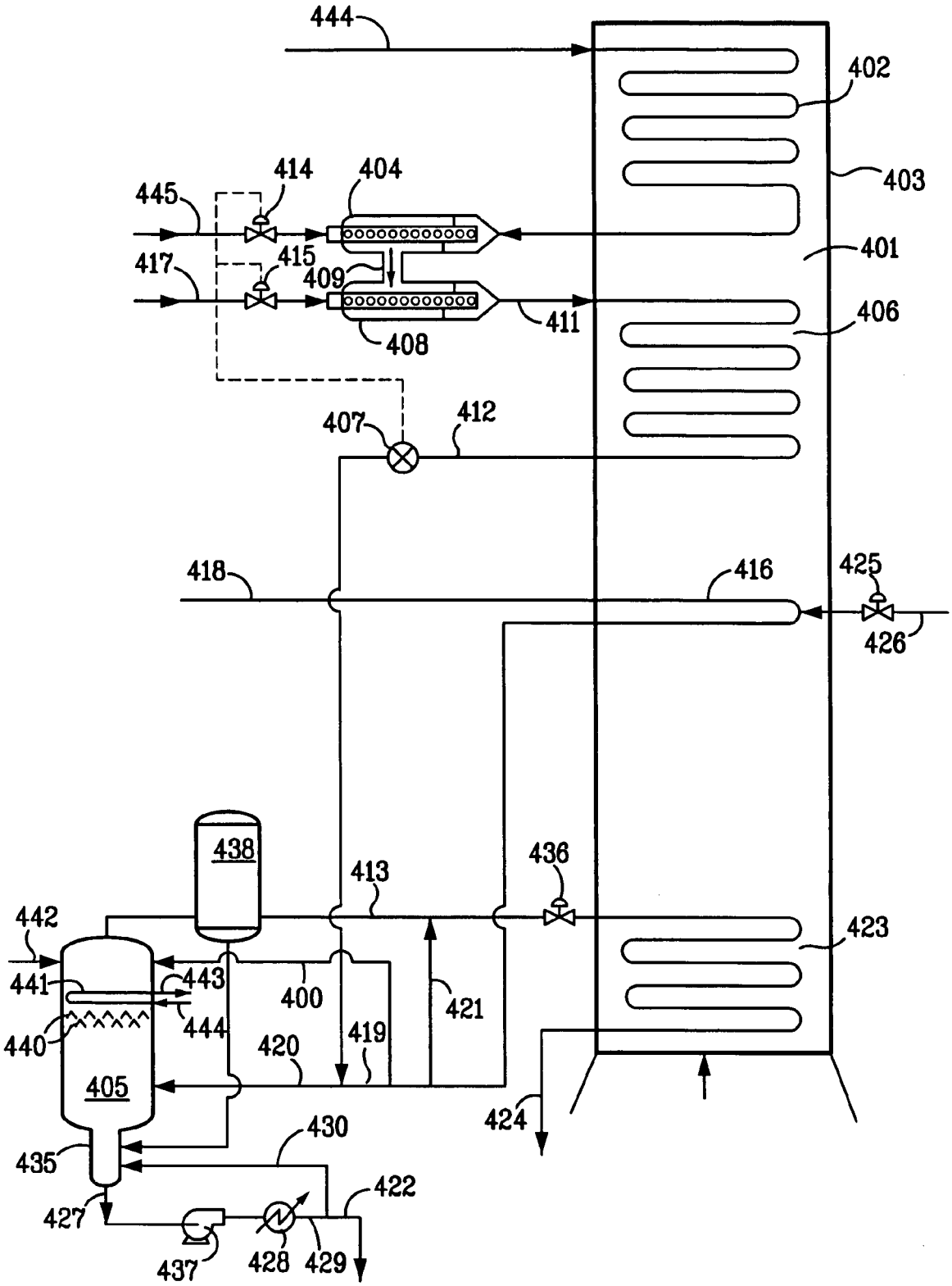
FIG. 4 illustrates a schematic flow diagram of the overall process and apparatus in accordance with the present invention employed with a pyrolysis furnace.

The heating of the hydrocarbon feedstock can take any form known by those of ordinary skill in the art. However, as shown in FIG. 4, it is preferred that the heating comprises indirect contact of the hydrocarbon feedstock stream 444 in the upper (farthest from the radiant section) convection section tube bank 402 of the furnace 401 with hot flue gases from the radiant section of the furnace. This can be accomplished, by way of non-limiting example, by passing the hydrocarbon feedstock through a bank of heat exchange tubes 402 located within the convection section 403 of the furnace 401. The heated hydrocarbon feedstock typically has a temperature between about 150 and about 260° C. (300 to 500° F.), such as about 160 to about 230° C. (325 to 450° F.), for example, about 170 to about 220° C. (340 to 425° F.).

The heated hydrocarbon feedstock is mixed with primary dilution steam and optionally, a fluid stream 445 which can be a hydrocarbon (preferably liquid but optionally vapor), water, steam, or a mixture thereof. The preferred fluid is water. A source of the fluid can be low pressure boiler feed water. The temperature of the fluid can be below, equal to, or above the temperature of the heated feedstock.

The mixing of the heated hydrocarbon feedstock and the fluid can occur inside or outside the pyrolysis furnace 401, but preferably it occurs outside the furnace. The mixing can be accomplished using any mixing device known within the art.

For example, it is possible to use a first sparger 404 of a double sparger assembly 409 for the mixing. The first sparger 404 can avoid or reduce hammering, caused by sudden vaporization of the fluid, upon introduction of the fluid into the heated hydrocarbon feedstock.

The present invention uses steam streams in various parts of the process. The primary dilution steam stream 417 can be mixed with the heated hydrocarbon feedstock as detailed below. In another embodiment, a secondary dilution steam stream 418 can be heated in the convection section and mixed with the heated mixture steam before the flash. The source of the secondary dilution steam may be primary dilution steam which has been superheated, optionally in a convection section of the pyrolysis furnace. Either or both of the primary and secondary dilution steam streams may comprise sour steam. Superheating the sour dilution steam minimizes the risk of corrosion which could result from condensation of sour steam.

In one embodiment of the present invention, in addition to the fluid mixed with the heated feedstock, the primary dilution steam 417 is also mixed with the feedstock. The primary dilution steam stream can be preferably injected into a second sparger 408. It is preferred that the primary dilution steam stream is injected into the hydrocarbon fluid mixture before the resulting stream mixture optionally enters the convection section at 411 for additional heating by flue gas, generally within the same tube bank as would have been used for heating the hydrocarbon feedstock.

The primary dilution steam can have a temperature greater, lower, or about the same as hydrocarbon feedstock fluid mixture, but preferably the temperature is greater than that of the mixture and serves to partially vaporize the feedstock/fluid mixture. The primary dilution steam may be superheated before being injected into the second sparger 408.

The mixture stream comprising the heated hydrocarbon feedstock, the fluid, and the primary dilution steam stream leaving the second sparger 408 is optionally heated again in the convection section of the pyrolysis furnace 403 before the flash. The heating can be accomplished, by way of non-limiting example, by passing the mixture stream through a bank of heat exchange tubes 406 located within the convection section, usually as part of the first convection section tube bank, of the furnace and thus heated by the hot flue gas from the radiant section of the furnace. The thus-heated mixture stream leaves the convection section as a mixture stream 412 to optionally be further mixed with an additional steam stream.

Optionally, the secondary dilution steam stream 418 can be further split into a flash steam stream 419 which is mixed with the hydrocarbon mixture 412 before the flash and a bypass steam stream 421 which bypasses the flash of the hydrocarbon mixture and, instead is mixed with the vapor phase from the flash before the vapor phase is cracked in the radiant section of the furnace. The present invention can operate with all secondary dilution steam 418 used as flash steam 419 with no bypass steam 421. Alternatively, the present invention can be operated with secondary dilution steam 418 directed to bypass steam 421 with no flash steam 419. In a preferred embodiment in accordance with the present invention, the ratio of the flash steam stream 419 to bypass steam stream 421 should be preferably 1:20 to 20:1, and most preferably 1:2 to 2:1. In this embodiment, the flash steam 419 is mixed with the hydrocarbon mixture stream 412 to form a flash stream 420 which typically is introduced before the flash in flash/separation vessel 405. Preferably, the secondary dilution steam stream is superheated in a superheater section 416 in the furnace convection before splitting and mixing with the hydrocarbon mixture. The addition of the flash steam stream 419 to the hydrocarbon mixture stream 412 aids the vaporization of most volatile components of the mixture before the flash stream 420 enters the flash/separator vessel 405.

The mixture stream 412 or the flash stream 420 is then introduced for flashing, either directly or through a tangential inlet (to impart swirl) to a flash/separation apparatus, e.g., flash/separation vessel 405, for separation into two phases: a vapor phase comprising predominantly volatile hydrocarbons and steam and a liquid phase comprising predominantly non-volatile hydrocarbons. The vapor phase is preferably removed from the flash/separation vessel as an overhead vapor stream 413. The vapor phase formed in the flash/separation vessel is at its dew point and partially cracks in the upper portion of the flash/separation vessel and exit piping. Since the cracking is endothermic, it results in a temperature decrease, which in turn causes additional liquid to condense from the vapor phase. The presence of liquid in the vapor stream leaving the flash/separation vessel increases the coking in the vessel, piping, and the convection section tube bank 423. To reduce the cracking that occurs in the flash/separation vessel and at least partially offset the temperature decrease resulting from the partial cracking, a heated vaporous diluent is added to the flash/separation vessel to an extent sufficient to at least partially compensate for the temperature decrease and to dilute and superheat the vapor phase. The diluted vapor phase, preferably, is fed back to a convection section tube bank 423 of the furnace, preferably located nearest the radiant section of the furnace, for optional heating and through crossover pipes 424 to the radiant section of the pyrolysis furnace for cracking. The liquid phase of the flashed mixture stream is removed from the flash/separation vessel 405 as a bottoms stream 427.

It is preferred to maintain a predetermined constant ratio of vapor to liquid in the flash/separation vessel 405, but such ratio is difficult to measure and control. As an alternative, temperature of the mixture stream 412 before the flash/separation vessel 405 can be used as an indirect parameter to measure, control, and maintain an approximately constant vapor-to-liquid ratio in the flash/separation vessel 405. Ideally, when the mixture stream temperature is higher, more volatile hydrocarbons will be vaporized and become available, as a vapor phase, for cracking. However, when the mixture stream temperature is too high, more heavy hydrocarbons will be present in the vapor phase and carried over to the convection furnace tubes, eventually coking the tubes. If the mixture stream 412 temperature is too low, resulting in a low ratio of vapor to liquid in the flash/separation vessel 405, more volatile hydrocarbons will remain in liquid phase and thus will not be available for cracking.

The mixture stream temperature is limited by highest recovery/vaporization of volatiles in the feedstock while avoiding excessive coking in the furnace tubes or coking in piping and vessels conveying the mixture from the flash/separation vessel to the furnace 401 via line 413. The pressure drop across the vessels and piping 413 conveying the mixture to the lower convection section 423, and the crossover piping 424, and the temperature rise across the lower convection section 423 may be monitored to detect the onset of coking problems. For instance, if the crossover pressure and process inlet pressure to the lower convection section 423 begin to increase rapidly due to coking, the temperature in the flash/separation vessel 405 and the mixture stream 412 should be reduced. If coking occurs in the lower convection section, the temperature of the flue gas to the superheater 416 increases, requiring more desuperheater water 426.

The selection of the mixture stream 412 temperature is also determined by the composition of the feedstock materials. When the feedstock contains higher amounts of lighter, hydrocarbons, the temperature of the mixture stream 412 can be set lower. As a result, the amount of fluid used in the first sparger 404 would be increased and/or the amount of primary dilution steam used in the second sparger 408 would be decreased since these amounts directly impact the temperature of the mixture stream 412. When the feedstock contains a higher amount of non-volatile hydrocarbons, the temperature of the mixture stream 412 should be set higher. As a result, the amount of fluid used in the first sparger 404 would be decreased while the amount of primary dilution steam used in the second sparger 408 would be increased. By carefully selecting a mixture stream temperature, the present invention can find applications in a wide variety of feedstock materials.

Typically, the temperature of the mixture stream 412 can be set and controlled at between about 315 and about 540° C. (600 and 1000° F.), such as between about 370 and about 510° C. (700 and 950° F.), for example, between about 400 and about 480° C. (750 and 900° F.), and often between about 430 and about 475° C. (810 and 890° F.). These values will change with the concentration of volatiles in the feedstock as discussed above.

Considerations in determining the temperature include the desire to maintain a liquid phase to reduce the likelihood of coke formation on exchanger tube walls and in the flash/separation vessel.

The temperature of mixture stream 412 can be controlled by a control system 407 which comprises at least a temperature sensor and any known control device, such as a computer application. Preferably, the temperature sensors are thermocouples. The control system 407 communicates with the fluid valve 414 and the primary dilution steam valve 415 so that the amount of the fluid and the primary dilution steam entering the two spargers can be controlled.

In order to maintain a constant temperature for the mixture stream 412 mixing with flash steam 419 and entering the flash/separation vessel to achieve a constant ratio of vapor to liquid in the flash/separation vessel 405, and to avoid substantial temperature and flash vapor-to-liquid ratio variations, the present invention operates as follows: When a temperature for the mixture stream 412 before the flash/separation vessel 405 is set, the control system 407 automatically controls the fluid valve 414 and primary dilution steam valve 415 on the two spargers. When the control system 407 detects a drop of temperature of the mixture stream, it will cause the fluid valve 414 to reduce the injection of the fluid into the first sparger 404. If the temperature of the mixture stream starts to rise, the fluid valve will be opened wider to increase the injection of the fluid into the first sparger 404. In one possible embodiment, the fluid latent heat of vaporization controls mixture stream temperature.

When the primary dilution steam stream 417 is injected to the second sparger 408, the temperature control system 407 can also be used to control the primary dilution steam valve 415 to adjust the amount of primary dilution steam stream injected to the second sparger 408. This further reduces the sharp variation of temperature changes in the flash 405. When the control system 407 detects a drop of temperature of the mixture stream 412, it will instruct the primary dilution steam valve 415 to increase the injection of the primary dilution steam stream into the second sparger 408 while valve 414 is closed more. If the temperature starts to rise, the primary dilution steam valve will automatically close more to reduce the primary dilution steam stream injected into the second sparger 408 while valve 414 is opened wider.

In one embodiment in accordance with the present invention, the control system 407 can be used to control both the amount of the fluid and the amount of the primary dilution steam stream to be injected into both spargers.

In an example embodiment where the fluid is water, the controller varies the amount of water and primary dilution steam to maintain a constant mixture stream temperature 412, while maintaining a constant ratio of water-to-feedstock in the mixture 411. To further avoid sharp variation of the flash temperature, the present invention also preferably utilizes an intermediate desuperheater 425 in the superheating section of the secondary dilution steam in the furnace. This allows the superheater 416 outlet temperature to be controlled at a constant value, independent of furnace load changes, coking extent changes, excess oxygen level changes, and other variables. Normally, this desuperheater 425 maintains the temperature of the secondary dilution steam between about 425 and about 590° C. (800 and 1100° F.), for example, between about 455 and about 540° C. (850 and 1000° F.), such as between about 455 and about 510° C. (850 and 950° F.), and typically between about 470 and about 495° C. (875 and 925° F.). The desuperheater can be a control valve and water atomizer nozzle. After partial preheating, the secondary dilution steam exits the convection section and a fine mist of water 426 can be added which rapidly vaporizes and reduces the temperature. The steam is preferably then further heated in the convection section. The amount of water added to the superheater can control the temperature of the steam which is mixed with mixture stream 412.

Although the description above is based on adjusting the amounts of the fluid and the primary dilution steam streams injected into the hydrocarbon feedstock in the two spargers 404 and 408, according to the predetermined temperature of the mixture stream 412 before the flash/separation vessel 405, the same control mechanisms can be applied to other parameters at other locations. For instance, the flash pressure and the temperature and the flow rate of the flash steam 419 can be changed to effect a change in the vapor-to-liquid ratio in the flash. Also, excess oxygen in the flue gas can also be a control variable, albeit possibly a slow one.

In addition to maintaining a constant temperature of the mixture stream 412 entering the flash/separation vessel, it is generally also desirable to maintain a constant hydrocarbon partial pressure of the flash stream 420 in order to maintain a constant ratio of vapor to liquid in the flash/separation vessel. By way of examples, the constant hydrocarbon partial pressure can be maintained by maintaining constant flash/separation vessel pressure through the use of control valves 436 on the vapor phase line 413, and by controlling the ratio of steam to hydrocarbon feedstock in stream 420.

Typically, the hydrocarbon partial pressure of the flash stream in the present invention is set and controlled at between about 4 and about 25 psia (25 and 175 kPa), such as between about 5 and about 15 psia (35 and 100 kPa), for example between about 6 and about 11 psia (40 and 75 kPa).

In one embodiment, the flash is conducted in at least one flash/separation vessel. Typically the flash is a one-stage process with or without reflux. The flash/separation vessel 405 is normally operated at about 275 to 1400 kPa (40 to 200 psia) pressure and its temperature is usually the same or slightly lower than the temperature of the flash stream 420 via the flash/separation apparatus feed inlet before entering the flash/separation vessel 405. Typically, the pressure at which the flash/separation vessel operates is at about 275 to about 1400 kPa (40 to 200 psia), and the temperature is at about 310 to about 540° C. (600 to 1000° F.). For example, the pressure of the flash can be about 600 to about 1100 kPa (85 to 155 psia), and the temperature can be about 370 to about 490° C. (700 to 920° F.). As a further example, the pressure of the flash can be about 700 to about 1000 kPa (105 to 145 psia) with a temperature of about 400 to about 480° C. (750 to 900° F.). In yet another example, the pressure of the flash/separation vessel can be about 700 to about 760 kPa (105 to 125 psia), and the temperature can be about 430 to about 475° C. (810 to 890° F.). Depending on the temperature of the mixture stream 412, generally about 50 to about 98% of the mixture stream being flashed is in the vapor phase, such as about 60 to about 95%, for example, about 65 to about 90%.

The flash/separation vessel 405 is generally operated, in one aspect, to minimize the temperature of the liquid phase at the bottom of the vessel because too much heat may cause coking of the non-volatiles in the liquid phase. Use of the secondary dilution steam stream 418 in the flash stream entering the flash/separation vessel lowers the vaporization temperature because it reduces the partial pressure of the hydrocarbons (i.e., a larger mole fraction of the vapor is steam) and thus lowers the required liquid phase temperature. It may also be helpful to recycle a portion of the externally cooled flash/separation vessel bottoms liquid 430 back to the flash/separation vessel to help cool the newly separated liquid phase at the bottom of the flash/separation vessel 405. Stream 427 can be conveyed from the bottom of the flash/separation vessel 405 to the cooler 428 via pump 437. The cooled stream 429 can then be split into a recycle stream 430 and export stream 422. The temperature of the recycled stream would typically be about 260 to about 315° C. (500 to 600° F.), for example, about 270 to about 290° C. (520 to 550° F.). The amount of recycled stream can be about 80 to about 250% of the amount of the newly separated bottom liquid inside the flash/separation vessel, such as 90 to 225%, for example, 100 to 200%.

The flash is generally also operated, in another aspect, to minimize the liquid retention/holding time in the flash/separation vessel 405. In one example embodiment, the liquid phase is discharged from the vessel through a small diameter "boot" or cylinder 435 on the bottom of the flash/separation vessel. Typically, the liquid phase retention time in the flash/separation vessel is less than about 75 seconds, for example, less than about 60 seconds, such as less than about 30 seconds, and often less than about 15 seconds. The shorter the liquid phase retention/holding time in the flash/separation vessel, the less coking occurs in the bottom of the flash/separation vessel.

Inasmuch as the present invention relates to controlling partial condensation of the vapor phase within the flash/separation vessel 405, it is noted that endothermic cracking reactions which occur within the flash/separator vessel cause a lowering of the vapor phase temperature and an attendant condensation of heavier components within the vapor phase. In order to minimize such condensation and the resulting undesired passage of condensed vapor coke precursors as overhead components via line 413, a heated diluent is added to the flash/separator vessel. The diluent may be added as steam, via line 400 at a point above the hydrocarbon feed inlet 420, and/or as heated hydrocarbon, e.g., ethane, via line 442.

In one embodiment, a surface for vapor/liquid contacting, e.g., cooling coil 441 is positioned within the flash/separator vessel 405 above 400 and 442. The cooling coil receives coolant via coolant inlet 444 which coolant is removed via coolant outlet 443. Suitable coolants include steam and water. Preferably, the coolant when introduced to the flash/separator vessel has a temperature of no greater than about 450° C., such as from about 150 to about 260° C. A set of passive vapor/liquid contacting surfaces 440, can be placed below the cooling coil 441 and above where the feed stream 420 is introduced. Such surfaces can improve separation of heavy condensable molecules from overheads. Typically, the set of vapor/liquid contacting surfaces are sheds. Alternately, a Glitsch Grid can be used.

Preferably the diluent (or heat) is added as superheated steam at a rate corresponding to between about 1 and about 10% of the hydrocarbon throughput in the vapor phase. In an embodiment, the vapor phase throughput for the flash/separation apparatus ranges from about 9,000 to about 90,000 kg/hr (20,000 to 200,000 lbs/hr) steam, from about 25,000 to about 80,000 kg/hr (55,000 to 180,000 lbs/hr) hydrocarbons, and the heat is added as from about 250 to about 8,000 kg/hr (550 to about 18,000 lbs/hr) of superheated steam. In another embodiment of this aspect of the invention, the vapor phase throughput for the flash/separation apparatus can be about 15,000 kg/hour (33,000 lbs/hr) steam, about 33,000 kg/hour (73,000 lbs/hr) hydrocarbons and the heat is added as about 2,700 kg/hour (about 6,000 lbs/hr) of superheated steam.

The vapor phase taken as overhead from the flash/separation apparatus 405 via 413 may contain, for example, 55 to 70% hydrocarbons and 30 to 45% steam. The boiling end point of the vapor phase is normally below about 760° C. (1400° F.), such as below about 590° C. (1100° F.), for example, below about 565° C. (1050° F.), and often below about 540° C. (1000° F.). The vapor phase is continuously removed from the flash/separator vessel 405 through an overhead pipe, which optionally conveys the vapor to a centrifugal separator 438 to remove trace amounts of entrained and/or condensed liquid. The vapor then typically flows into a manifold that distributes the flow to the convection section of the furnace.

The vapor phase stream 413 continuously removed from the flash/separator vessel is preferably superheated in the pyrolysis furnace lower convection section 423 to a temperature of, for example, about 425 to about 705° C. (800 to about 1300° F.) by the flue gas from the radiant section of the furnace. The vapor phase is then introduced to the radiant section of the pyrolysis furnace to be cracked.

The vapor phase stream 413 removed from the flash/separator vessel can optionally be mixed with a bypass steam stream 421 before being introduced into the furnace lower convection section 423.

The bypass steam stream 421 is a split steam stream from the secondary dilution steam 418. Preferably, the secondary dilution steam is first heated in the convection section of the pyrolysis furnace 403 before splitting and mixing with the vapor phase stream removed from the flash/separation vessel 405. In some applications, it may be possible to superheat the bypass steam again after the splitting from the secondary dilution steam but before mixing with the vapor phase. The superheating after the mixing of the bypass steam 421 with the vapor phase stream 413 ensures that all but the heaviest components of the mixture in this section of the furnace are vaporized before entering the radiant section. Raising the temperature of vapor phase from about 425 to 705° C. (800 to about 1300° F.) in the lower convection section 423 also helps the operation in the radiant section since radiant tube metal temperature can be reduced. This results in less coking potential in the radiant section. The superheated vapor is then cracked in the radiant section of the pyrolysis furnace.

Because the controlled flash of the mixture stream results in significant removal of the coke- and tar-producing heavier hydrocarbon species (in the liquid phase), it is possible to utilize a transfer line exchanger for quenching the effluent from the radiant section of the pyrolysis furnace. Among other benefits, this will allow more cost-effective retrofitting of cracking facilities initially designed for lighter feeds, such as naphthas, or other liquid feedstocks with end boiling points generally below about 315° C. (600° F.), which have transfer line exchanger quench systems already in place.

A transfer line exchanger can be used to produce high pressure steam which is then preferably superheated in a convection section tube bank of the pyrolysis furnace, typically to a temperature less than about 590° C. (1100° F.), for example, about 455 to about 510° C. (850 to 950° F.) by indirect contact with the flue gas before the flue gas enters the convection section tube bank used for heating the heavy hydrocarbon feedstock and/or mixture stream. An intermediate desuperheater may be used to control the temperature of the high pressure steam. The high pressure steam is preferably at a pressure of about 4240 kPa (600 psig) or greater and may have a pressure of about 10,450 to about 13,900 kPa (1500 to 2000 psig). The high pressure steam superheater tube bank is preferably located between the first convection section tube bank and the tube bank used for heating the vapor phase.

After being cooled in the transfer line exchanger, the furnace effluent may optionally be further cooled by injection of a stream of suitable quality quench oil.

Partially Condensing Vapor Phase During Flash

The present invention relates to a process for cracking hydrocarbon feedstock containing resid comprising heating the feedstock, mixing the heated feedstock with a fluid and/or a primary dilution steam stream to form a mixture stream, and flashing the mixture stream within a flash/separation vessel to form a vapor phase and a liquid phase. The vapor phase is partially condensed by contacting with a condenser and, optionally, surfaces (sheds) underneath the condenser to improve contact between the condensate and the rising vapor, within the vessel, to condense at least some coke precursors within the vapor while providing condensates which add to the liquid phase. The vapor phase of reduced coke precursors content is removed as overhead and the liquid phase is removed as bottoms. The vapor phase is heated and then cracked in a radiant section of a pyrolysis furnace to produce an effluent comprising olefins. The resulting effluent is quenched and cracked product is recovered from the quenched effluent.

The condenser is advantageously located within the flash/separation vessel, typically above the inlet of the flash/separation vessel which introduces the hydrocarbon feedstock to the vessel. The condenser comprises a vapor/liquid contacting surface which is maintained under conditions sufficient to effect condensation of condensable fractions within the vapor phase. In one embodiment, the condenser comprises a heat-conducting tube containing a cooling medium. The tube can be made of any heat conducting material, e.g., metal, which complies with local boiler and piping codes. A cooling medium is present within the tube, e.g., a fluid such as a liquid or gas. In one embodiment, the cooling medium comprises liquid, typically water, e.g., boiler feed water. The tube typically comprises a tube inlet and a tube outlet for introducing and removing the cooling medium. At least one of the tube inlet and the tube outlet can pass through a wall of the flash/separation vessel or, alternatively, at least one of the tube inlet and the tube outlet pass through the overhead outlet of the flash/separation vessel.

In operation, the condenser tube typically has an outside tube metal temperature (TMT) ranging from about 200 to about 370° C. (400 to 700° F.), such as from about 260 to about 315° C. (500 to 600° F.). At this temperature, a large amount of hydrocarbon condensation occurs on the outside of the cooling tubes but not in the vessel cross-sectional area between the tubes, producing a partial condenser effect. The tube may be of any size sufficient to impart the requisite heat to the vapor phase. Typically, the tube has a diameter of about 10 cm (4 in). For a vessel of about 4 m (13 ft) diameter, the condenser heat duty typically ranges from about 0.06 to about 0.60 MW, such as from about 0.1 to about 0.3 MW. In one embodiment, boiler feed water is passed through the condenser at a rate of about 450 to about 13,000 kg/hr (1 to 30 klb/hr) at a temperature ranging from about 100 to about 260° C. (212 to 500° F.) and a pressure ranging from about 350 to about 17,000 kPag (50 to 2500 psig).

It is desirable that the condenser fit within the upper portion of the flash/separation vessel; thus the condenser is typically substantially planar and configured so it can be horizontally mounted within the vessel. In one embodiment, the tube present in the condenser is continuous and comprised of alternating straight sections and 180° bend sections beginning with a straight inlet section and terminating in a straight outlet section. Cooling medium which is cooler than the vapor phase temperature is introduced via the inlet section and, after heat exchange with the vapor, heated cooling medium is withdrawn through the outlet section.

In another embodiment, the condenser comprises a substantially straight inlet communicating with an inlet manifold substantially perpendicular to the straight inlet, at least two substantially parallel cooling tubes substantially perpendicular to and communicating with the inlet manifold and substantially perpendicular to and communicating with an outlet manifold, and a substantially straight outlet perpendicular to and communicating with the outlet manifold.

In one embodiment, the surface area of the tube is enhanced by providing extended surfaces along the tube, e.g., by attaching fins to the tube along its length. Typically, the tube comprises at least about 2 fin/cm of tube length (5 fins/in of tube length) and the fins range from about ⅝ to about 2½ cm (¼ to 1 in) in height and about 0.05 to about 0.4 cm (0.02 to 0.15 in) in thickness, say, about 2 cm (¾ in) in height and about ⅛ cm (0.05 in) in thickness.

In still another embodiment, the tube employed in the condenser comprises a substantially concentrically placed inner tube within an outer tube, wherein cooling liquid, e.g., water is passed through the inner tube while steam is passed through the outer tube. Typically, the inner tube has a diameter ranging from about 2½ to about 10 cm (1 to 4 in) and the outer tube has a diameter ranging from about 5 to about 15 cm (2 to 6 in), such as the inner tube has a diameter of about 5 cm (2 in) and the outer tube has a diameter of about 10 cm (4 in).

In yet another embodiment, a set of passive liquid/vapor contacting surfaces is positioned beneath the condenser, within the flash/separation vessel. Typically, a set of liquid/vapor contacting surface(s) is provided by a first row of sheds arranged substantially perpendicularly to the tube. The sheds have an inverted V cross-section which serves to drain liquid formed from the surface downward off the sheds for contacting with the vapor phase or for collection as bottoms. The set of liquid/vapor contacting surfaces can further comprise at least one additional row of sheds positioned substantially parallel to and beneath the first row of sheds. Other suitable liquid/vapor contacting surfaces include Glitsch Grid and other distillation tower wide open packing.

In still another embodiment, a second condenser is located beneath the liquid/vapor contacting surfaces to enhance condensation of the vapor phase.

The mixture stream is typically introduced to the flash/separation vessel through an inlet in the side of the flash/separation vessel. The inlet can be substantially perpendicular to the vessel wall, or more advantageously, angled so as to be at least partially tangential to the vessel wall in order to effect swirling of the mixture stream feed within the vessel.

The process of the present invention is typically operated so that the condensing step provides a vapor phase reduced in coke precursor content by at least about 50%, say at least about 80%, relative to a comparable vapor phase produced in the absence of the condensing.

Quenching the effluent leaving the pyrolysis furnace may be carried out using a transfer line exchanger, wherein the amount of the fluid mixed with the hydrocarbon feedstock is varied in accordance with at least one selected operating parameter of the process. The fluid can be a hydrocarbon or water, preferably water.

In applying this invention, the hydrocarbon feedstock containing resid and coke precursors may be heated by indirect contact with flue gas in a first convection section tube bank of the pyrolysis furnace before mixing with the fluid. Preferably, the temperature of the hydrocarbon feedstock is from about 150° C. to about 260° C. (300° F. to 500° F.) before mixing with the fluid.

The mixture stream may then be heated by indirect contact with flue gas in a first convection section of the pyrolysis furnace before being flashed. Preferably, the first convection section is arranged to add the fluid, and optionally, primary dilution steam, between passes of that section such that the hydrocarbon feedstock can be heated before mixing with the fluid and the mixture stream can be further heated before being flashed.

The temperature of the flue gas entering the first convection section tube bank is generally less than about 815° C. (1500° F.), for example, less than about 700° C. (1300° F.), such as less than about 620° C. (1150° F.), and preferably less than about 540° C. (1000° F.).

Dilution steam may be added at any point in the process; for example, it may be added to the hydrocarbon feedstock containing resid before or after heating, to the mixture stream, and/or to the vapor phase. Any dilution steam stream may comprise sour or process steam. Any dilution steam stream may be heated or superheated in a convection section tube bank located anywhere within the convection section of the furnace, preferably in the first or second tube bank.

The mixture stream may be at about 315 to about 540° C. (600° F. to 1000° F.) before the flash in the flash/separation vessel, and the flash pressure may be about 275 to about 1375 kPa (40 to 200 psia). Following the flash, 50 to 98% of the mixture stream may be in the vapor phase. An additional separator such as a centrifugal separator may be used to remove trace amounts of liquid from the vapor phase. The vapor phase may be heated above the flash temperature before entering the radiant section of the furnace, for example, from about 425 to about 705° C. (800 to 1300° F.). This heating may occur in a convection section tube bank, preferably the tube bank nearest the radiant section of the furnace.

The hydrocarbon feedstock can comprise a large portion, such as about 2 to about 50%, of non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, hydrocarbon gas/residue admixtures, hydrogen/residue admixtures, $C_4$'s/residue admixtures, naphtha/residue admixtures, gas oil/residue admixtures, and crude oil.

The hydrocarbon feedstock can have a nominal end boiling point of at least about 315° C. (600° F.), generally greater than about 510° C. (950° F.), typically greater than about 590° C. (1100° F.), for example, greater than about 760° C. (1400° F.). The economically preferred feedstocks are generally low sulfur waxy residues, atmospheric residues, naphthas contaminated with crude, various residue admixtures, and crude oils.

Figure 5:
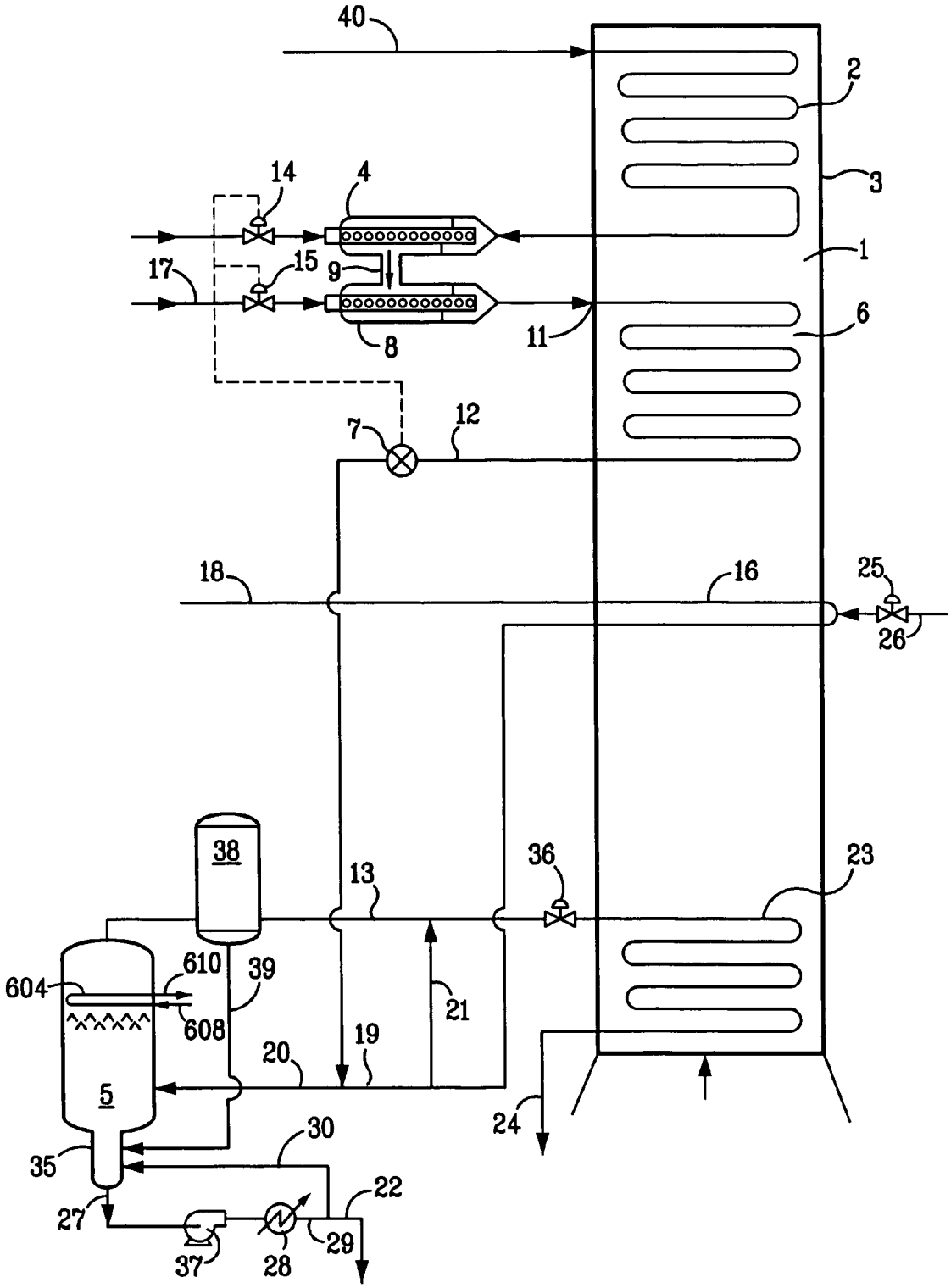
FIG. 5 illustrates a schematic flow diagram of a process in accordance with the present invention employed with a pyrolysis furnace.

The heating of the hydrocarbon feedstock containing resid can take any form known by those of ordinary skill in the art. However, as seen in FIG. 5, it is preferred that the heating comprises indirect contact of the hydrocarbon feedstock 40 in the upper (farthest from the radiant section) convection section tube bank 2 of the furnace 1 with hot flue gases from the radiant section of the furnace. This can be accomplished, by way of non-limiting example, by passing the hydrocarbon feedstock through a bank of heat exchange tubes 2 located within the convection section 3 of the furnace 1. The heated hydrocarbon feedstock typically has a temperature between about 150 and about 260° C. (300 to 500° F.), such as between about 160 and about 230° C. (325 to 450° F.), for example, between about 170 and about 220° C. (340 to 425° F.).

The heated hydrocarbon feedstock is mixed with primary dilution steam and, optionally, a fluid that can be a hydrocarbon (preferably liquid but optionally vapor), water, steam, or a mixture thereof. The preferred fluid is water. A source of the fluid can be low-pressure boiler feed water. The temperature of the fluid can be below, equal to, or above the temperature of the heated feedstock.

The mixing of the heated hydrocarbon feedstock and the fluid can occur inside or outside the pyrolysis furnace 1, but preferably it occurs outside the furnace. The mixing can be accomplished using any mixing device known within the art. For example, it is possible to use a first sparger 4 of a double sparger assembly 9 for the mixing. The first sparger 4 can avoid or reduce hammering, caused by sudden vaporization of the fluid, upon introduction of the fluid into the heated hydrocarbon feedstock.

The present invention typically uses steam streams in various parts of the process. The primary dilution steam stream 17 can be mixed with the heated hydrocarbon feedstock as detailed below. In another embodiment, a secondary dilution steam stream 18 can be heated in the convection section and mixed with the heated mixture steam before the flash. The source of the secondary dilution steam may be primary dilution steam that has been superheated, optionally, in a convection section of the pyrolysis furnace. Either or both of the primary and secondary dilution steam streams may comprise sour or process steam. Superheating the sour or process dilution steam minimizes the risk of corrosion, which could result from condensation of sour or process steam.

In one embodiment of the present invention, in addition to the fluid mixed with the heated feedstock, the primary dilution steam 17 is also mixed with the feedstock. The primary dilution steam stream can be preferably injected into a second sparger 8. It is preferred that the primary dilution steam stream is injected into the hydrocarbon fluid mixture before the resulting stream mixture optionally enters the convection section at 11 for additional heating by flue gas, generally within the same tube bank as would have been used for heating the hydrocarbon feedstock.

The primary dilution steam can have a temperature greater, lower, or about the same as hydrocarbon feedstock fluid mixture, but preferably the temperature is greater than that of the mixture and serves to partially vaporize the feedstock/fluid mixture. The primary dilution steam may be superheated before being injected into the second sparger 8.

The mixture stream comprising the heated hydrocarbon feedstock, the fluid, and the primary dilution steam stream leaving the second sparger 8 is optionally heated again in the convection section of the pyrolysis furnace 3 before the flash. The heating can be accomplished, by way of non-limiting example, bypassing the mixture stream through a bank of heat exchange tubes 6 located within the convection section, usually as part of the first convection section tube bank, of the furnace and thus heated by the hot flue gas from the radiant section of the furnace. The thus-heated mixture stream leaves the convection section as a mixture stream 12 to, optionally, be further mixed with an additional steam stream.

Optionally, the secondary dilution steam stream 18 can be further split into a flash steam stream 19 which is mixed with the hydrocarbon mixture 12 before the flash and a bypass steam stream 21 which bypasses the flash of the hydrocarbon mixture and is instead mixed with the vapor phase from the flash before the vapor phase is cracked in the radiant section of the furnace. The present invention can operate with all secondary dilution steam 18 used as flash steam 19 with no bypass steam 21. Alternatively, the present invention can be operated with secondary dilution steam 18 directed to bypass steam 21 with no flash steam 19. In a preferred embodiment in accordance with the present invention, the ratio of the flash steam stream 19 to bypass steam stream 21 should preferably be 1:20 to 20:1, most preferably 1:2 to 2:1. In this embodiment, the flash steam 19 is mixed with the hydrocarbon mixture stream 12 to form a flash stream 20, which typically is introduced before the flash in flash/separation vessel 5. Preferably, the secondary dilution steam stream is superheated in a superheater section 16 in the furnace convection before splitting and mixing with the hydrocarbon mixture. The addition of the flash steam stream 19 to the hydrocarbon mixture stream 12 aids the vaporization of most volatile components of the mixture before the flash stream 20 enters the flash/separator vessel 5.

The mixture stream 12 or the flash stream 20 is then introduced for flashing, either directly or through a tangential inlet (to impart swirl), to a flash/separation apparatus, e.g., flash/separator vessel 5, for separation into two phases: a vapor phase comprising predominantly volatile hydrocarbons and steam and a liquid phase comprising predominantly non-volatile hydrocarbons. The vapor phase is preferably removed from the flash/separator vessel as an overhead vapor stream 13. The vapor phase, preferably, is fed back to a convection section tube bank 23 of the furnace, preferably located nearest the radiant section of the furnace, for optional heating and through crossover pipes 24 to the radiant section of the pyrolysis furnace for cracking. The liquid phase of the flashed mixture stream is removed from the flash/separator vessel 5 as a bottoms stream 27.

It is preferred to maintain a predetermined constant ratio of vapor to liquid in the flash/separator vessel 5, but such ratio is difficult to measure and control. As an alternative, temperature of the mixture stream 12 before the flash/separator vessel 5 can be used as an indirect parameter to measure, control, and maintain an approximately constant vapor-to-liquid ratio in the flash/separator vessel 5. Ideally, when the mixture stream temperature is higher, more hydrocarbons will be vaporized and become available, as a vapor phase, for cracking. However, when the mixture stream temperature is too high, more heavy hydrocarbons will be present in the vapor phase and carried over to the convection furnace tubes, eventually coking the tubes. If the mixture stream 12 temperature is too low, resulting in a low ratio of vapor to liquid in the flash/separator vessel 5, more volatile hydrocarbons will remain in liquid phase and thus will not be available for cracking.

The mixture stream temperature is optimized to maximize recovery/vaporization of volatiles in the feedstock while avoiding excessive coking in the furnace tubes or coking in piping and vessels conveying the mixture from the flash/separator vessel to the furnace 1 via line 13. The pressure drop across the vessels and piping 13 conveying the mixture to the lower convection section 23, and the crossover piping 24, and the temperature rise across the lower convection section 23 may be monitored to detect the onset of coking problems. For instance, if the crossover pressure and process inlet pressure to the lower convection section 23 begins to increase rapidly due to coking, the temperature in the flash/separator vessel 5 and the mixture stream 12 should be reduced. If coking occurs in the lower convection section, the temperature of the flue gas to the superheater 16 increases, requiring more desuperheater water 26 via valve 25.

The selection of the mixture stream 12 temperature is also determined by the composition of the feedstock materials. When the feedstock contains higher amounts of lighter hydrocarbons, the temperature of the mixture stream 12 can be set lower. As a result, the amount of fluid used in the first sparger 4 would be increased and/or the amount of primary dilution steam used in the second sparger 8 would be decreased since these amounts directly impact the temperature of the mixture stream 12. When the feedstock contains a higher amount of non-volatile hydrocarbons, the temperature of the mixture stream 12 should be set higher. As a result, the amount of fluid used in the first sparger 4 would be decreased while the amount of primary dilution steam used in the second sparger 8 would be increased. By carefully selecting a mixture stream temperature, the present invention can find applications with a wide variety of feedstock materials.

Typically, the temperature of the mixture stream 12 can be set and controlled at between about 315 and about 540° C. (600 and 1000° F.), such as between about 370 and about 510° C. (700 and 950° F.), for example, between about 400 and about 480° C. (750 and 900° F.), and often between about 430 and about 475° C. (810 and 890° F.). These values will change with the concentration of volatiles in the feedstock as discussed above.

Considerations in determining the temperature include the desire to maintain a liquid phase to reduce the likelihood of coke formation on exchanger tube walls and in the flash/separator.

The temperature of mixture stream 12 can be controlled by a control system 7 which comprises at least a temperature sensor and any known control device, such as a computer application. Preferably, the temperature sensors are thermocouples. The control system 7 communicates with the fluid valve 14 and the primary dilution steam valve 15 so that the amount of the fluid and the primary dilution steam entering the two spargers can be controlled.

In order to maintain a constant temperature for the mixture stream 12 mixing with flash steam 19 and entering the flash/separator vessel 5 to achieve a constant ratio of vapor to liquid in the flash/separator vessel 5, and to avoid substantial temperature and flash vapor-to-liquid ratio variations, the present invention operates as follows: When a temperature for the mixture stream 12 before the flash/separator vessel 5 is set, the control system 7 automatically controls the fluid valve 14 and primary dilution steam valve 15 on the two spargers. When the control system 7 detects a drop of temperature of the mixture stream, it will cause the fluid valve 14 to reduce the injection of the fluid into the first sparger 4. If the temperature of the mixture stream starts to rise, the fluid valve will be opened wider to increase the injection of the fluid into the first sparger 4. In one possible embodiment, the fluid latent heat of vaporization controls mixture stream temperature.

When the primary dilution steam stream 17 is injected to the second sparger 8, the temperature control system 7 can also be used to control the primary dilution steam valve 15 to adjust the amount of primary dilution steam stream injected to the second sparger 8. This further reduces the sharp variation of temperature changes in the flash/separation vessel 5. When the control system 7 detects a drop of temperature of the mixture stream 12, it will instruct the primary dilution steam valve 15 to increase the injection of the primary dilution steam stream into the second sparger 8 while valve 14 is closed more. If the temperature starts to rise, the primary dilution steam valve will automatically close more to reduce the primary dilution steam stream injected into the second sparger 8 while valve 14 is opened wider.

In one embodiment in accordance with the present invention, the control system 7 can be used to control both the amount of the fluid and the amount of the primary dilution steam stream to be injected into both spargers.

In an example embodiment where the fluid is water, the controller varies the amount of water and primary dilution steam to maintain a constant mixture stream temperature 12, while maintaining a constant ratio of $H_2O$-to-feedstock in the mixture 11. To further avoid sharp variation of the flash temperature, the present invention also preferably utilizes an intermediate desuperheater providing desuperheater water 26 via valve 25 to the superheating section 16 of the secondary dilution steam in the furnace. This allows the superheater outlet temperature to be controlled at a constant value, independent of furnace load changes, coking extent changes, excess oxygen level changes, and other variables. Normally, this desuperheater maintains the temperature of the secondary dilution steam between about 425 and about 590° C. (800 and 1100° F.), for example, between about 455 and about 540° C. (850 and 1000° F.), such as between about 455 and about 510° C. (850 and 950° F.), and typically between about 470 and about 495° C. (875 and 925° F.). The desuperheater comprises the control valve 25 and an optional water atomizer nozzle. After partial preheating, the secondary dilution steam exits the convection section and a fine mist of water can be added which rapidly vaporizes and reduces the temperature. The steam is preferably then further heated in the convection section. The amount of water added to the superheater can control the temperature of the steam mixed with mixture stream 12.

Although the description above is based on adjusting the amounts of the fluid and the primary dilution steam streams injected into the hydrocarbon feedstock in the two spargers 4 and 8 according to the predetermined temperature of the mixture stream 12 before the flash/separator vessel 5, the same control mechanisms can be applied to other parameters at other locations. For instance, the flash pressure and the temperature and the flow rate of the flash steam 19 can be changed to effect a change in the vapor-to-liquid ratio in the flash/separation vessel. Also, excess oxygen in the flue gas can also be a control variable, albeit possibly a slow one.

In addition to maintaining a constant temperature of the mixture stream 12 entering the flash/separator vessel, it is generally also desirable to maintain a constant hydrocarbon partial pressure of the flash stream 20 in order to maintain a constant ratio of vapor to liquid in the flash/separator vessel. By way of examples, the constant hydrocarbon partial pressure can be maintained by keeping constant flash/separator vessel pressure through the use of control valves 36 on the vapor phase line 13, and by controlling the ratio of steam-to-hydrocarbon feedstock in stream 20.

Typically, the hydrocarbon partial pressure of the flash stream in the present invention is set and controlled at between about 25 and about 175 kPa (4 and about 25 psia), such as between about 35 and about 100 kPa (5 and 15 psia), for example, between about 40 and about 75 kPa (6 and 11 psia).

In one embodiment, the flash is conducted in at least one flash/separator vessel. Typically the flash is a one-stage process with or without reflux. The flash/separator vessel 5 is normally operated at about 275 to 1400 kPa (40 to 200 psia) pressure and its temperature is usually the same or slightly lower than the temperature of the flash stream 20 at the flash/separation apparatus feed inlet before entering the flash/separator vessel 5. Typically, the pressure at which the flash/separator vessel operates is at about 275 to about 1400 kPa (40 to 200 psia), and the temperature is at about 310 to about 540° C. (600 to 1000° F.). For example, the pressure of the flash can be about 600 to about 1100 kPa (85 to 160 psia), and the temperature can be about 370 to about 490° C. (700 to 920° F.). As a further example, the pressure of the flash can be about 700 to about 1000 kPa (100 to 145 psia) with a temperature of about 400 to about 480° C. (750 to 900° F.). In yet another example, the pressure of the flash/separator vessel can be about 700 to about 860 kPa (100 to 125 psia), and the temperature can be about 430 to about 475° C. (810 to 890° F.). Depending on the temperature of the mixture stream 12, generally about 50 to about 98% of the mixture stream being flashed is in the vapor phase, such as about 60 to about 95%, for example about 65 to about 90%.

The flash/separator vessel 5 is generally operated, in one aspect, to minimize the temperature of the liquid phase at the bottom of the vessel because too much heat may cause coking of the non-volatiles in the liquid phase. Use of the secondary dilution steam stream 18 in the flash stream entering the flash/separator vessel 5 lowers the vaporization temperature because it reduces the partial pressure of the hydrocarbons (i.e., a larger mole fraction of the vapor is steam) and thus lowers the required liquid phase temperature. It may also be helpful to recycle a portion of the externally cooled flash/separator vessel bottoms liquid 30 back to the flash/separator vessel 5 to help cool the newly separated liquid phase at the bottom of the flash/separator vessel 5. Stream 27 can be conveyed from the bottom of the flash/separator vessel 5 to the cooler 28 via pump 37. The cooled stream 29 can then be split into a recycle stream 30 and export stream 22. The temperature of the recycled stream would typically be about 260 to about 315° C. (500 to 600° F.), for example about 270 to about 290° C. (520 to 550° F.). The amount of recycled stream can be from about 80 to about 250% of the amount of the newly separated bottom liquid inside the flash/separator vessel, such as from about 90 to about 225%, for example, from about 100 to about 200%.

The flash is generally also operated, in another aspect, to minimize the liquid retention/holding time in the flash/separation vessel. In one example embodiment, the liquid phase is discharged from the vessel through a small diameter "boot" or cylinder 35 on the bottom of the flash/separator vessel. Typically, the liquid phase retention time in the vessel is less than about 75 seconds, for example, less than about 60 seconds, such as less than about 30 seconds, and often less than about 15 seconds. The shorter the liquid phase retention/holding time in the flash/separator vessel, the less coking occurs in the bottom of the flash/separator vessel.

When the mixture of steam and water mixed with hydrocarbon enters the flash/separator vessel 5, a perfect or near perfect vapor/liquid separation occurs, with the vapor being at its dew point. Since the flash/separation vessel has no theoretical stages of separation, even if the vapor/liquid separation is perfect, thermodynamic calculations predict about 10 ppm of the hydrocarbon vapor has a normal boiling point above 760° C. (1400° F.). The vapor spends about 30 seconds in the flash/separation vessel at 450° C. (850° F.) causing cracking and coking of some of the heavier molecules. Because cracking and coking are endothermic reactions, the vapor will cool below its dew point, causing a fraction of the heavier molecules to condense. Coking of the condensed molecules produces even heavier molecules and the condensed and coked molecules foul the piping downstream from the overheads outlet of the flash/separation vessel, e.g., the piping downstream of centrifugal separator 38 and crossover piping 24. Accordingly, the present invention treats the vapor phase by contacting it with condenser 104 to effect partial condensation of the vapor phase before cracking occurs.

Figure 6:
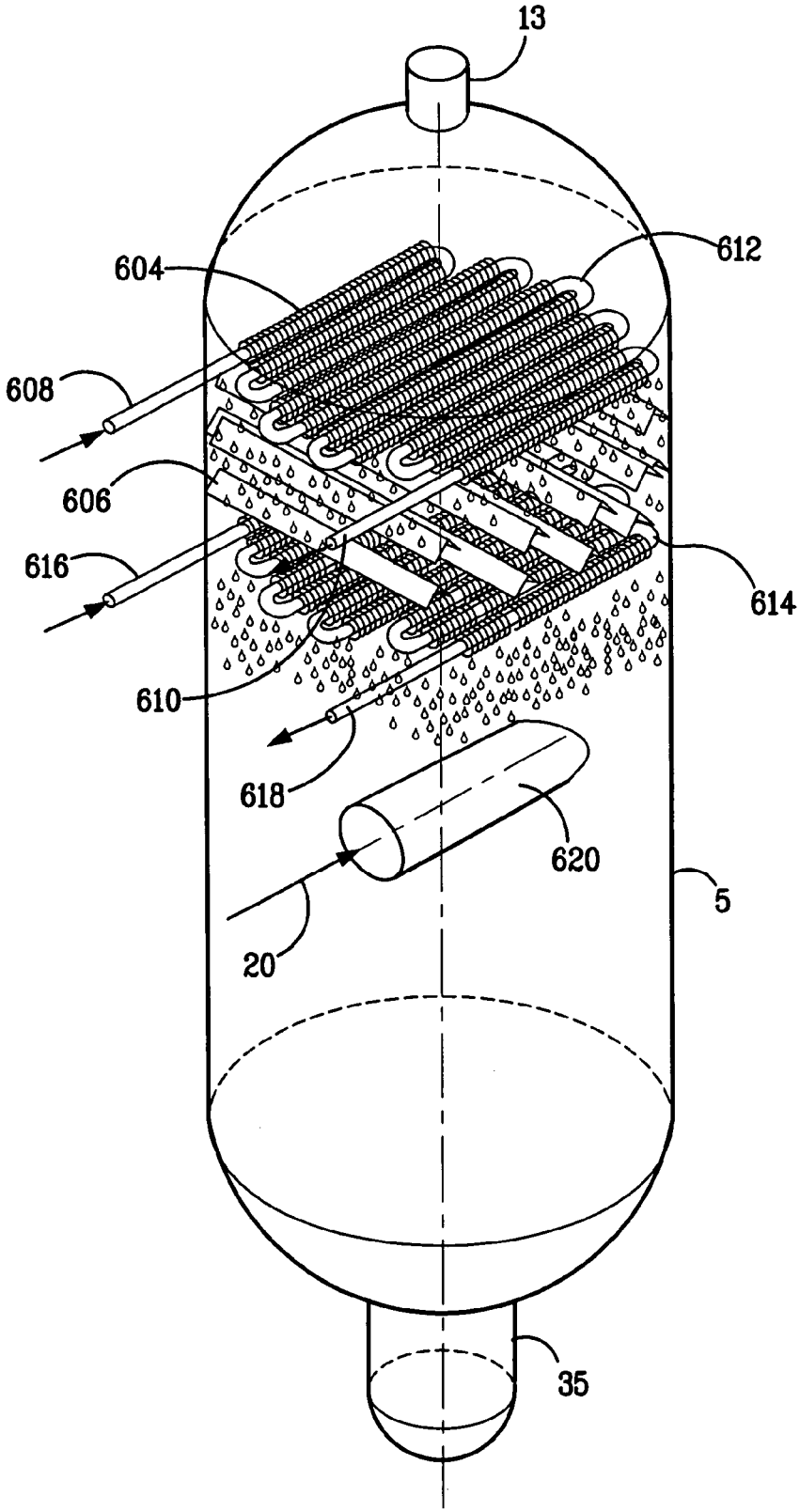
FIG. 6 illustrates a flash/separation apparatus of the present invention comprising dual finned serpentine cooling coils with interposed sheds.

In one embodiment, as depicted in FIG. 6, the feed mixture containing hydrocarbon and steam is introduced through a tangential inlet 620 via line 20. The condenser 604 comprises a first serpentine, finned cooling coil 612 inside the top of the flash/separator vessel 5 which coil has a cooling medium inlet 608 and a cooling medium outlet 610. The fins effect good drop distribution across the flash/separator vessel cross-section area as compared to bare tubes. Droplets forming on the coil and fins can flow down the fin surface, improving vapor/liquid heat and mass transfer. Sheds 606 are installed below the first coil. A second serpentine finned cooling coil 614 having a cooling medium inlet 616 and a cooling medium outlet 618 is installed beneath the sheds. Hydrocarbon liquid drops fall off the sheds into the boot 35 preventing coke buildup.

Figure 7:
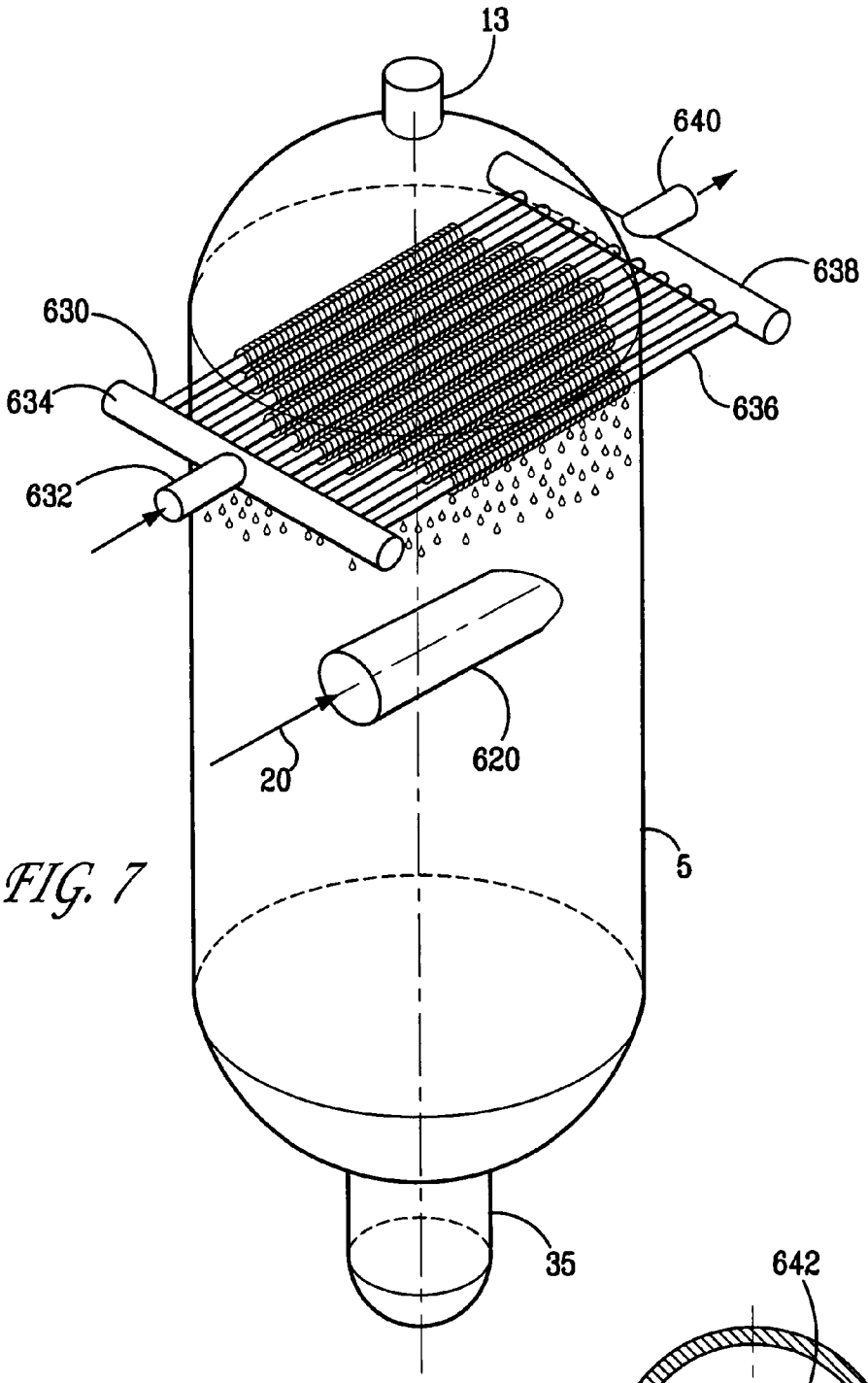
FIG. 7 illustrates a flash/separation apparatus of the present invention showing a single parallel finned cooling coil with concentric pipe coolers.

In another embodiment, as depicted in FIG. 7, the feed mixture containing hydrocarbon and steam is introduced through a tangential inlet 620 via line 20. The condenser 630 can comprise a substantially straight inlet 632 communicating with an inlet manifold 634 and parallel cooling tubes 636 substantially perpendicular to and communicating with inlet manifold 634 and substantially perpendicular to and communicating with an outlet manifold 638, with a substantially straight outlet 640 perpendicular to and communicating with the outlet manifold.

Figure 8:
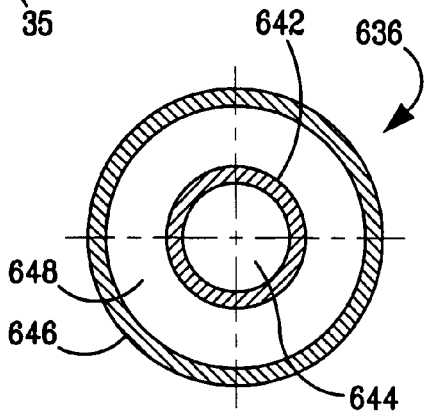
FIG. 8 illustrates a cross-section of concentric pipe coolers used in the present invention.
Figure 9:
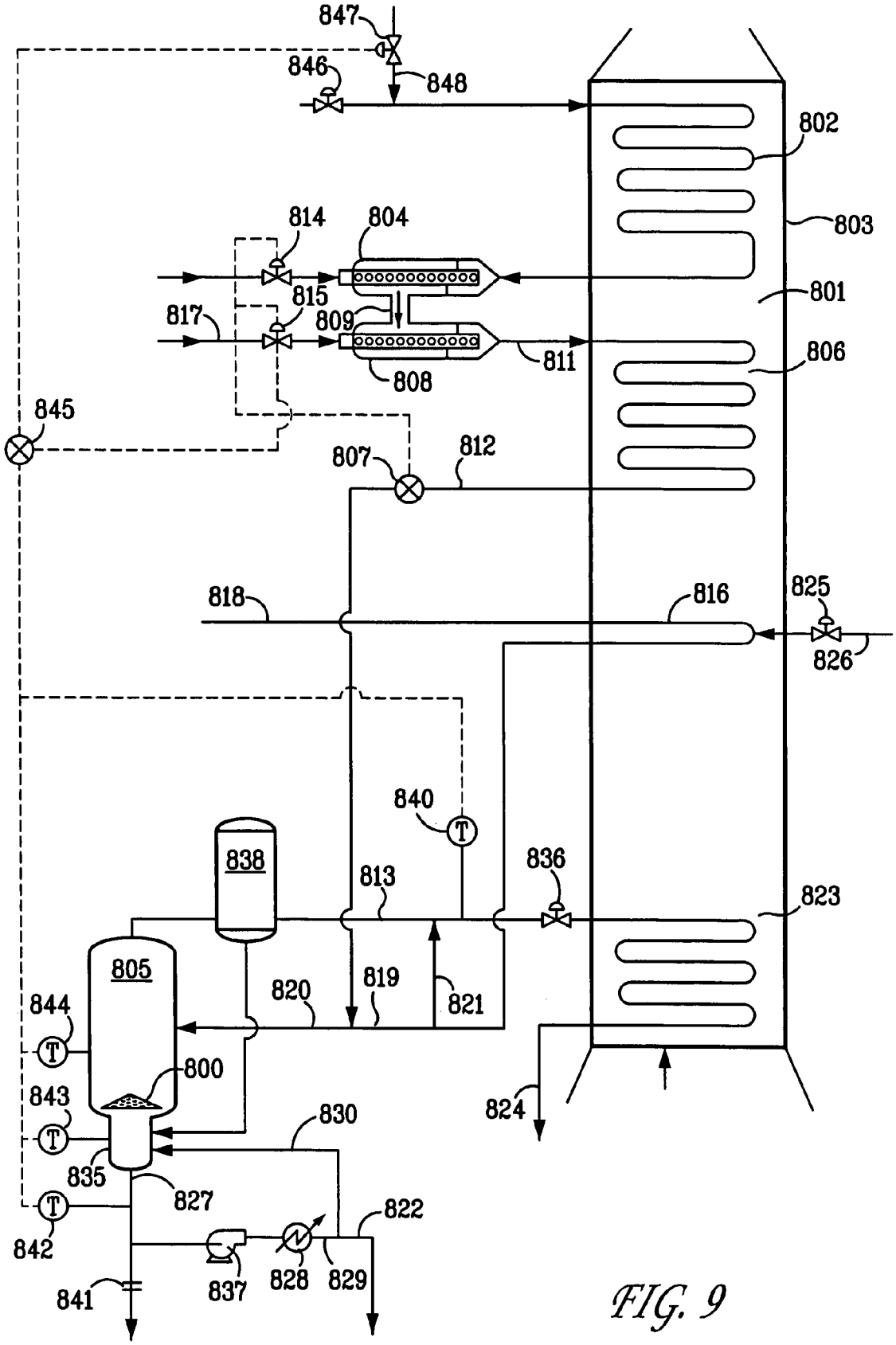
FIG. 9 illustrates a schematic flow diagram of a process in accordance with the present invention employed with a pyrolysis furnace.

In one embodiment, the cooling tubes 636 comprise concentric pipes as depicted in FIG. 8, with an internal pipe 642 through which water 644 is passed and a concentric external pipe 646 through which steam 648 is passed. This arrangement permits a reduced water rate. Water flows through the inner pipe while low pressure steam flows through the annulus. Because low pressure steam has a relatively low thermal conductivity, the tube metal temperature of the outside pipe can be from about 260 to about 315° C. (500 to 600° F.) even though the water is much colder. This colder water can absorb more heat per kg (pound) without localized boiling occurring in the film at the tube wall effecting a lower water rate for a given quantity of heat transfer. Boiling in the film may cause excessive pressure drop in this water coil. Another way to attain such tube metal temperature is to cool with high pressure/moderate temperature boiler feed water. In one embodiment, 0.2 MW of heat can be removed via a single serpentine coil (as shown in FIG. 6) in a 4 m (13.5 ft) diameter flash/separation vessel, where the coils are 10 cm (4 in) Nominal Pipe Size (NPS) with 2 cm (0.75 in) height fins at 0.8 fins/cm (2 fins/in). The embodiment uses 4500 kg/hr (10,000 lbs/hr) of 10,500 kPa (1500 psig) boiler feed water heated from about 150 to about 180° C. (300 to 360° F.) with a maximum film temperature, i.e., the maximum temperature of the water in contact with the pipe walls (with no localized boiling and flow cycling) of about 240° C. (460° F.). Maximum tube metal temperature (TMT) is about 255° C. (490° F.) while maximum fin tip temperature is about 350° C. (660° F.).

Referring again to FIG. 5. The vapor phase taken as overhead from the flash/separation apparatus 5 via 13 may contain, for example, 55 to 70% hydrocarbons and 30 to 45% steam. The boiling end point of the vapor phase is normally below about 760° C. (1400° F.), such as below about 590° C. (1100° F.). The vapor phase is continuously removed from the flash/separator vessel 5 through an overhead pipe, which optionally conveys the vapor to a centrifugal separator 38 to remove trace amounts of entrained and/or condensed liquid which can be recycled to boot 35 as quench via line 39. Optionally, steam cracker gas oil [about 205 to about 290° C. (400 to 560° F.) boiling range] or other low viscosity hydrocarbon having a similar boiling range can be added to line 39 as quench or fluxant. The vapor from line 13 then typically flows into a manifold that distributes the flow to the convection section of the furnace.

The vapor phase stream 13 continuously removed from the flash/separator vessel is preferably superheated in the pyrolysis furnace lower convection section 23 to a temperature of about 425 to about 705° C. (800 to about 1300° F.) by the flue gas from the radiant section of the furnace. The vapor phase is then introduced to the radiant section of the pyrolysis furnace to be cracked.

The vapor phase stream 13 removed from the flash/separator vessel can optionally be mixed with a bypass steam stream 21 before being introduced into the furnace lower convection section 23.

The bypass steam stream 21 is a steam stream split from the secondary dilution steam 18. Preferably, the secondary dilution steam is first heated in the convection section of the pyrolysis furnace 3 before splitting and mixing with the vapor phase stream removed from the flash/separator vessel 5. In some applications, it may be possible to superheat the bypass steam again after the splitting from the secondary dilution steam but before mixing with the vapor phase. The superheating after the mixing of the bypass steam 21 with the vapor phase stream 13 ensures that all but the heaviest components of the mixture in this section of the furnace are vaporized before entering the radiant section. Raising the temperature of vapor phase from about 425 to about 705° C. (800 to 1300° F.) in the lower convection section 23 also helps the operation in the radiant section since radiant tube metal temperature can be reduced. This results in less coking potential in the radiant section. The superheated vapor is then cracked in the radiant section of the pyrolysis furnace.

Because the controlled flash of the mixture stream results in significant removal of the coke- and tar-producing heavier hydrocarbon species (in the liquid phase), it is possible to utilize a transfer line exchanger for quenching the effluent from the radiant section of the pyrolysis furnace. Among other benefits, this will allow more cost-effective retrofitting of cracking facilities initially designed for lighter feeds, such as naphthas or other liquid feedstocks with end boiling points generally below about 315° C. (600° F.), which have transfer line exchanger quench systems already in place.

After being cooled in the transfer line exchanger, the furnace effluent may, optionally, be further cooled by injection of a stream of suitable quality quench oil.

The present invention's use of an internal partial condenser within the flash/separation apparatus provides several benefits. The condenser cleans up during each steam/air decoke of the vessel, eliminating costly maintenance and shutdowns. The condenser's minimal space requirements permit retrofitting of current flash/separation apparatus. Where fouling is caused by entrainment of resid rather than strictly vapor/liquid equilibrium, the raining droplets produced by the condenser will also remove liquid resid in the vapor. Where a 50% reduction is achieved in 760° C. (1400° F.) or above fraction present in the vapor exiting the flash/separation apparatus, overhead fouling is reduced or a greater hydrocarbon vapor cut can be taken.

Decoking Flash/Separation Vessel with Air and Steam

The present invention relates to a process for heating and steam cracking hydrocarbon feedstock containing resid. The process comprises heating the hydrocarbon feedstock, mixing the hydrocarbon feedstock with a fluid to form a mixture, flashing the mixture to form a vapor phase and a liquid phase, feeding the vapor phase to the radiant section of a pyrolysis furnace, and subsequently quenching the reaction, e.g., by using a transfer line exchanger or quench oil.

In using a flash to separate heavy liquid hydrocarbon fractions from the lighter fractions which can be processed in the pyrolysis furnace, it is important to effect the separation so that most of the non-volatile components will be in the liquid phase. Otherwise, heavy, coke-forming non-volatile components in the vapor are carried into the furnace causing coking problems. However, the flashing in a flash/separation vessel is typically accompanied by coking of internal surfaces in and proximally downstream of the vessel. The extent of such coking is dependent upon various factors including feed type, preheating protocol, and design of the vessel. Liquids contacting the internal surfaces of the vessel and downstream equipment provide coatings of films that are precursors to coke. Excessive temperatures, such as above about 427° C. (800° F.), typically from about 450 to about 460° C. (840 to 860° F.) or from about 510 to above about 621° C. (950 to 1150° F.), depending on the feedstock, are theorized to lead to excessive coke formation by thermal cracking and heat soaking of the heavy end of the heavy hydrocarbon feedstock stream. Because this coke buildup can effect restriction and increase pressure drop within the overall process, it would be advantageous to control the buildup within the flash zone and immediately downstream of the flash zone.

Inasmuch as the various embodiments of the present invention as described throughout this application relate to controlling coking within the flash/separator vessel 805, it is noted that optimizing the cut made by the flash/separator vessel typically employs conditions of high temperatures and convection pressures. These conditions are conducive to the formation of coke by thermal cracking on the vessel internals, e.g., baffles and walls.

In one aspect, the present invention relates to a process for removing coke formed during cracking of hydrocarbon feedstock containing resid and coke precursors, wherein steam is added to the feedstock to form a mixture which is thereafter separated into a vapor phase and a liquid phase by flashing in a flash/separation vessel. The vapor phase is then separated and cracked and the resulting cracked product recovered. Coking of internal surfaces in and proximally downstream of the vessel is controlled by interrupting the feed flow, purging the vessel with steam, introducing an air/steam mixture to at least partially combust the coke, and resuming the feed flow when sufficient coke has been removed.

In another aspect, the present invention relates to a process for removing coke formed during cracking of a hydrocarbon feedstock containing resid and coke precursors. The process comprises (a) heating the hydrocarbon feedstock; (b) mixing the heated hydrocarbon feedstock with a primary dilution steam stream to form a mixture stream containing coke precursors; (c) flashing the mixture stream in a flash/separation vessel to form a coke precursor depleted vapor phase and a coke precursor rich liquid phase; (d) removing the liquid phase through a bottom outlet and vapor phase with a trace of condensed vapor phase through an overhead outlet in the flash/separation vessel, which vessel comprises internal surfaces and associated outlet piping, which surfaces and piping become coated during operation with said liquid phase and/or condensed vapor phase and thereafter at least partially coked; (e) cracking the vapor phase in a radiant section of a pyrolysis furnace to produce an effluent comprising olefins, the pyrolysis furnace comprising a radiant section and a convection section; (f) quenching the effluent and recovering cracked product therefrom; and (g) determining the level of coking in the flash/separation vessel or in piping immediately downstream of said flash/separation vessel, and when a predetermined upper coke level is reached (i) interrupting flow of the hydrocarbon feedstock containing resid and coke precursors to the flash/separation vessel, (ii) purging the flash/separation vessel with steam under conditions sufficient to substantially remove the vapor phase from the vessel and the liquid phase from the internal surfaces and/or outlet piping, (iii) introducing an air/steam mixture through the flash/separation vessel under conditions sufficient to at least partially combust coke on the internal surfaces and outlet piping, and (iv) restarting the flow of the hydrocarbon feedstock to the flash/separation vessel when a predetermined lower coke level on the internal surfaces and/or outlet piping is reached.

In an embodiment of this aspect of the present invention, the flash/separation vessel comprises a baffle positioned above the liquid outlet which carries liquid outward and from the center of the vessel and downward. Typically, the baffle can be of any suitable shape, e.g., a substantially conical baffle whose apex points up, effecting the desired flow of liquid outward and downward. The baffle can be perforated, typically comprising perforations substituting for at least about 1% of the total surface area of a corresponding unperforated baffle. In another embodiment of this aspect of the present invention, the flash/separation vessel is substantially cylindrical. The mixture stream is introduced to the flash/separation vessel in a suitable manner, typically, by introducing the mixture stream (i) tangentially through at least one side inlet located in the side of the vessel, (ii) radially through at least one side inlet located in the side of the vessel, (iii) through the top of the vessel, and/or (iv) through the bottom of the vessel, and the vapor phase is removed through an overhead outlet of the vessel. In one embodiment, the mixture stream is introduced tangentially to the flash/separation vessel through at least one side inlet located in the side of said vessel, while the vapor phase is removed through an overhead outlet of the vessel.

In still another embodiment of the present invention, purging steam is introduced through at least one side inlet of the flash/separation vessel. The purging steam is typically introduced to the flash/separation vessel at a temperature ranging from about 400 to about 550° C. (750 to 1025° F.), a total pressure ranging from about 0 to about 830 kPag (0 to 120 psig), and a total flow of steam equal 5 to 250 times the volume of the flash/separator vessel.

In another embodiment, purging steam is introduced to the flash/separation vessel at a temperature ranging from about 450 to about 510° C. (840 to 950° F.), a total pressure ranging from about 350 to about 700 kPag (from about 50 to about 100 psig), and a total purge steam volume equal to 100 to 200 times the volume of the flash/separator vessel.

In yet another embodiment of this aspect of the present invention, the air/steam mixture stream is introduced through at least one side inlet of the flash/separation vessel. The air/steam mixture stream is characterized by an air/steam weight ratio ranging from about 0.01 to about 0.5, preferably from about 0.05 to about 0.2.

In another embodiment of this aspect, a major portion of the air/steam mixture is removed from the flash/separation vessel as an overhead stream and a minor portion of the air/steam mixture is removed from said flash/separation vessel as a bottoms slipstream. The minor portion is typically at least about 2% of the total air/steam mixture, typically ranging from about 5% to about 10% of the total air/steam mixture. In yet another embodiment, the amount of the air/steam mixture removed as a bottoms slipstream is controlled by at least one of a flow valve associated with the bottom outlet and one or more restriction orifices in the piping associated with the bottom outlet. The air/steam mixture is typically introduced to the flash/separation vessel under conditions sufficient to combust coke while limiting the adiabatic flame temperatures to no greater than the design temperature of the flash/separation vessel said bottoms slipstream piping. Typical design temperature ranges from about 570 to about 615° C. (1060 to 1140° F.).

The air/steam weight ratio of the air/steam mixture is typically maintained at no greater than about 0.2 during decoking of easily combusted coke, and at no greater than about 0.5 after decoking.

In one embodiment of this aspect of the present invention, the process further comprises monitoring internal temperature of the flash/separation vessel and controlling the air/steam weight ratio as a function of the internal temperature. This monitoring can be carried out by any suitable method known in the art. Typically, the monitoring is carried out by means of a thermocouple associated with the inside of the flash/separation vessel. The process can further comprise monitoring the bottoms slipstream temperature of the flash/separation vessel and controlling the air/steam weight ratio as a function of the internal temperature.

In another embodiment, the monitoring is carried out by means of a surface thermocouple attached to the outside of the bottom of the flash/separation vessel or the piping immediately downstream of the flash/separation vessel.

In yet another embodiment, monitoring is carried out by analyzing the flue gas produced during air/steam decoking for $CO/CO_2$.

In another aspect, the present invention relates to an apparatus for cracking a hydrocarbon feedstock containing resid and coke precursors, comprising (a) a heating zone for heating the hydrocarbon feedstock to provide heated hydrocarbon feedstock; (b) a mixing zone for mixing a primary dilution steam stream with the heated hydrocarbon feedstock to provide a mixture stream containing coke precursors; (c) a flash/separation vessel for flashing the mixture stream to form a coke precursor depleted vapor phase and a coke precursor rich liquid phase, the vessel comprising (i) a bottom outlet which comprises internal surfaces and associated outlet piping, which surfaces and piping during operation become coated with the liquid phase and thereafter at least partially coked; (ii) an overhead outlet for removing the vapor phase and a trace of condensed vapor phase, which overhead outlet comprises internal surfaces and associated outlet piping, which surfaces and piping during operation become coated with condensed vapor phase and thereafter at least partially coked; (iii) an inlet for introducing sufficient purging steam to the flash/separation vessel to remove the vapor phase from the vessel and the liquid phase from the internal surfaces and/or outlet piping; and (iv) an inlet for introducing an air/steam mixture through the flash/separation vessel under conditions sufficient to at least partially combust coke on the internal surfaces and/or outlet piping; (d) a pyrolysis furnace comprising a convection section, and a radiant section for cracking the vapor phase to produce an effluent comprising olefins; (e) a means for quenching the effluent; (f) a recovery train for recovering cracked product from the quenched effluent; (g) a means for determining the level of coking in the flash/separation vessel and/or in the associated outlet piping; and (h) a control valve for controlling the flow of the hydrocarbon feedstock with resid and coke precursors to the flash/separation vessel.

In one embodiment of this aspect of the invention, the flash/separation vessel comprises a baffle positioned above the liquid outlet. Typically, the baffle is a substantially conical baffle whose apex points upward, e.g., a perforated, substantially conical baffle. The perforations can make up at least about 1% of its total surface area.

In another embodiment of this aspect, the flash/separation vessel is substantially cylindrical.

In yet another embodiment, the flash/separation vessel contains a means to monitor its internal temperature. Typically, any suitable means for monitoring the internal temperature can be used, e.g., one that comprises a thermocouple mounted within the flash/separation vessel.

In still another embodiment of this aspect of the invention, the flash/separation vessel further comprises at least one side inlet for tangentially introducing the mixture stream. The purging steam and/or the air/steam mixture stream can be introduced through the at least one side inlet.

In still yet another embodiment of this aspect of the invention, the apparatus further comprises a means to monitor the bottom outlet temperature. Typically, any suitable means for monitoring the internal temperature can be used, e.g., the monitoring means can comprise a surface thermocouple attached to the outside of the bottom of the flash/separation vessel or the outlet piping immediately downstream of the flash/separation vessel.

In another embodiment of this aspect of the present invention, the apparatus further comprises a means to control air/steam weight ratio of the air/steam mixture stream as a function of the internal temperature and the bottom outlet temperature.

In one embodiment of the invention, a substantially conical baffle 800, which is advantageously perforated, employed for the purpose of reducing or avoiding entrainment of liquid in the overhead, is subjected to coking of its surfaces. Moreover, coke laydown in the outlet piping (overhead outlet associated with that portion of vapor phase line 813 downstream of line 821 and bottom outlet associated with liquid phase line 827) immediately downstream of the vessel 805 is enhanced by steam stripping of the lighter components in the vessel overhead stream by bypass steam 821 injected in the overhead stream. Coke forming in the flash/separator vessel 805 and its adjacent downstream piping can be removed by techniques such as hydroblasting which requires shutdown of the furnace 801 for hydroblasting of the vessel internals and associated piping by introducing water (not shown) to the vessel. Such techniques typically require long shutdown times followed by steam purging before restarting the process.

In one embodiment, the present invention removes this coke by utilizing the introduction of clean or sour or process steam via 817 as controlled by steam valve 815 and introduction of air 848 as controlled by air valve(s) 847, to the flash/separator vessel 805 via an inlet for introducing an air/steam mixture, e.g., via the line used to introduce flash stream 820, under conditions which effect at least partial combustion of the obstructing coke. In order to avoid explosive mixtures and/or runaway combustion, a purge stream containing clean or sour or process steam can be introduced from a suitable line such as 817 or 818 before effecting the partial combustion in order to remove hydrocarbon liquids or vapors from the flash/separation vessel 805 and associated lines. After purging, any remaining hydrocarbon will be below the fuel lean flammability limit at an air to steam weight ratio of 0.1. The weight ratio of air/steam and air/steam flow rate is controlled by controller 845 which controls steam valve 815 and air valve 847 as a function of data received from one or more sensors which monitor internal flash/separation vessel conditions and/or associated line conditions. Such data can be selected from any meaningful criteria for controlling coking conditions including temperatures and their rate of change, pressures, flow rates, control valve opening, $CO/CO_2$ in the flue gas from decoking air/steam, etc.

In one embodiment of the present invention, the sensors comprise sensor 844 and sensor 843 within the vessel 805 or its boot 835. Sensors may also be positioned downstream of the vessel, e.g., downstream of where bypass stream is introduced to overhead at 840, or at 842 downstream of the boot 835 which allows monitoring the bottoms slipstream temperature of the flash/separation vessel. The sensors are typically surface thermocouples associated with the inside of the flash/separation vessel 805 or associated piping. In order to effectively remove coke, the temperature of the air/steam mixture is typically controlled to be hot enough to combust the coke, such as about 480° C. (896° F.). The air/steam ratio is typically controlled to less than about 0.2 to limit flame temperatures to about 570 to about 615° C. (1060 to 1140° F.) and the temperature of the bottoms slip stream to about 550° C. (1025° F.) so as not to exceed the allowable design temperature of the flash/separation vessel 805 and its associated piping. Once the vessel is decoked, the air-to-steam rate can be increased to about 0.5. In order to effectively decoke the baffle 800 it is advantageous to provide a slipstream, such as about 10% of the air/steam mixture through the baffle perforations and around the baffle perimeter and out through the bottom outlet as stream 827 whose flow can be controlled by restriction orifices 841. The remaining 90% of the air/steam mixture can pass as overhead via 813 whose flow, optionally, can be controlled by 836. Both the overhead and bottom flow of the air/steam mixture can be controlled by controller 845, such as a function of temperatures registered by one or more of the sensors. Finally, controller 845 can interrupt the flow of hydrocarbon feedstock, effect steam purge, and then resume the flow of hydrocarbon feedstock by valve 846 during the process as a function of coke levels within the vessel and associated piping, in accordance with the present invention.

Turning from the subject of controlling coking within the flash/separator vessel 805 and its associated piping, and considering the further processing of the vapor phase taken as overhead from the vessel, it is noted that the vapor phase may contain, for example, 55 to 70% hydrocarbons and 30 to 45% steam. The boiling end point of the vapor phase is normally below about 760° C. (1400° F.), such as below about 590° C. (1100° F.), and often below about 565° C. (1050° F.). The vapor phase is continuously removed from the flash/separator vessel 805 through an overhead pipe, which optionally conveys the vapor to a centrifugal separator 838 to remove trace amounts of entrained and/or condensed liquid. The vapor then typically flows into a manifold that distributes the flow to the convection section of the furnace.

The vapor phase stream 813 continuously removed from the flash/separator vessel is preferably superheated in the pyrolysis furnace lower convection section 823 to a temperature of, for example, about 425 to about 705° C. (800 to 1300° F.) by the flue gas from the radiant section of the furnace. The vapor phase is then introduced to the radiant section of the pyrolysis furnace to be cracked.

The vapor phase stream 813 removed from the flash/separator vessel can optionally be mixed with a bypass steam stream 821 before being introduced into the furnace lower convection section 823.

The bypass steam stream 821 is a split steam stream from the secondary dilution steam 818. Preferably, the secondary dilution steam is first heated in the convection section of the pyrolysis furnace 803 before splitting and mixing with the vapor phase stream removed from the flash/separation vessel 805. The superheating after the mixing of the bypass steam 821 with the vapor phase stream 813 ensures that all but the heaviest components of the mixture in this section of the furnace are vaporized before entering the radiant section. Raising the temperature of vapor phase to about 425 to about 705° C. (800 to 1300° F.) in the lower convection section 823 also helps the operation in the radiant section since radiant tube metal temperature can be reduced. This results in less coking potential in the radiant section. The superheated vapor is then cracked in the radiant section of the pyrolysis furnace.

The overhead vapor from the flash/separation vessel 805 is optionally heated to a sufficient temperature for passing to the radiant (cracking) zone of the pyrolysis furnace. In the radiant zone the feed is thermally cracked to produce an effluent comprising olefins, including ethylene and other desired light olefins, and byproducts which is passed to a recovery train for recovery of products as known in the art.

Flash Apparatus with Annular, Inverted-L Baffle

The present invention relates to a highly efficient vapor/liquid separation apparatus for treating a flow of vapor/liquid mixtures of hydrocarbons and steam. The apparatus comprises a substantially cylindrical vertical vessel or vessel having an upper cap section, a middle section comprising a circular wall, a lower cap section, a tangential inlet to introduce hydrocarbon/steam mixtures, an overhead vapor outlet, and a bottom outlet for liquid. The vessel also comprises an annular structure located in the middle section, comprising (i) an annular ceiling section extending from the circular wall and (ii) a concentric internal vertical side wall, to which the ceiling section extends. The annular structure blocks upward passage of vapor/liquid mixtures along the circular wall beyond the ceiling section, and surrounds an open core having sufficient cross-sectional area to permit vapor velocity low enough to avoid significant entrainment of liquid.

In one embodiment of the present invention, the vapor outlet comprises a pipe extending above and below the upper cap section of the vessel, wherein a skirt extends circumferentially downwardly and outwardly from a section of the pipe extending below the upper cap section of the vessel.

In another embodiment, the apparatus comprises an upper and a lower cap wherein the caps are at least one of (i) substantially hemispherical and (ii) substantially elliptical in longitudinal section.

In yet another embodiment, the tangentially positioned inlet passes through the circular wall and opens into the annular structure. The apparatus can further comprise an additional substantially tangentially positioned inlet substantially opposite from the first tangentially positioned inlet, or one or more such inlets equally spaced from one another along the vessel circumference. The tangential entry causes the liquid in the two-phase flow to contact the wall with significant force, e.g., from about 1 to 2 g's of centrifugal force. This permits hot liquid hydrocarbon to wet the wall and smoothly fall to the bottom of the vertical vessel without being entrained by the gas flow in the core of the vessel. Advantageously, the tangentially positioned inlet can be flush to an interior side of the circular wall, in order to reduce disruption of flow, the flush entry serving to reduce or eliminate formation of mist within the vessel. The resulting smooth, near vertical flow of the liquid to the bottom of the vessel minimizes its residence time before quenching in the boot. Thus, the tangential inlet or inlets can serve to completely coalesce the liquid phase.

The apparatus of the present invention includes an open core defined by the annular structure. In one embodiment, the open core has sufficient cross-sectional area to permit vapor velocity of no greater than about one-third of the maximum vapor velocity, which avoids significant entrainment of liquid in the vapor. Typically, the open core has sufficient cross-sectional area to permit a vapor velocity of no greater than about 60 cm/sec (2 ft/sec), such as from about 15 to about 45 cm/sec (½ to 1½ ft/sec).

In an embodiment of the present invention, the tangentially positioned inlet is oriented to provide the flow in the same direction as the Coriolis force acting on the vessel. Where more than one such inlet is present, all inlets are advantageously oriented to provide the flow in the same direction as the Coriolis force acting on the vessel.

In one embodiment, it has been found useful to provide an apparatus according to the invention, which further comprises a means for controlling swirling of the liquid of the vapor/liquid mixture. Typically, such swirling is controlled to the extent that the liquid is swirled to no greater than about one-third of a revolution around the vessel. The means for controlling swirling of the liquid is typically selected from at least one of (i) limiting vapor/liquid velocity entering the vessel and (ii) providing a sufficient vessel diameter. The vapor/liquid velocity entering the vessel can be less than about 9 m/sec (30 ft/sec), preferably less than about 6 m/sec (20 ft/sec), preferably ranging from about 3 to about 6 m/sec (10 to 20 ft/sec). Sufficient vessel diameters are typically greater than about 1 meter, such as greater than about 2 meters, e.g., about 4 meters.

In another embodiment of the present invention, a wear plate is attached to the circular wall adjacent the annular structure. The wear plate protects against erosion, particularly during decoking operations with air and steam in which coke can otherwise erode the interior wall of the flash/separation vessel.

The apparatus of the present invention comprises an annular structure which serves to prevent trace mists from creeping up the vessel walls. Inasmuch as a flat horizontal ring alone permits some mist to still creep up the walls and around the ring, the ring structure comprises a vertical element secured to the inner edge of the horizontal ring, providing an inverted L-shaped cross-section. Such a structure has been shown to prevent the mist from traversing the vertical element without coalescing into the bulk liquid phase. The annular structure is advantageously supported by hangers positioned above which reduces or prevents obstruction of fluid flows by the structure's supporting members.

In another embodiment, the apparatus comprises a manway provided in the circular wall, for the purpose of providing access to the interior of the flash/separation vessel for cleaning, maintenance, and other servicing. The manway can comprise a plug contoured to the shape of the circular wall through which it passes.

As earlier noted, the apparatus of the present invention can further comprise at least one baffle located at a lower part of the middle section providing a surface slanting downwardly from the center of the vessel toward the circular wall and providing a gap between the baffle and the circular wall for directing liquid along or near the circular wall to the lower cap section. In one embodiment, the baffle is perforated. This baffle, which can be substantially conical in shape, partially isolates the bottom of the flash/separation vessel and boot from the upper part of the flash/separation vessel, but prevents hot swirling vapors from causing liquid to swirl, and prevents the colder liquid in the boot from condensing the hotter vapor. The baffle advantageously is shaped, e.g., by having sufficient pitch where conical, to prevent pooling of liquid thereon. The baffle may also comprise perforations which improve mass transfer during decoking, e.g., by permitting passage of air and steam through the baffle. By properly selecting the number and size of the perforations, during normal operation, minimal hot vapor diffuses into the bottom of the vessel. Yet, during decoking, the fraction of the steam/air mixtures flowing out the bottom of the boot can effectively contact the entire vessel. Without perforations, a thick layer of coke can build on the lower part of the vessel and on the baffle. Thus, the perforations are advantageously sufficient in size to prevent coke from plugging them. In one embodiment, the baffle is perforated with at least one of substantially circular perforations and substantially rectangular perforations. The baffle can be perforated with perforations ranging in size from about 50 to about 200 $cm^2$ (8 to 31 $in^2$). The perforations can have dimensions selected from the group consisting of about 5 cm×20 cm (2 in×8 in) rectangles and about 10 to 15 cm (4 to 6 in) diameter circles. Advantageously, the baffle is perforated to an extent ranging from about 1% to about 20% of its surface area as compared to a corresponding unperforated baffle, such as to an extent sufficient to increase mass transfer from the apparatus of a steam/air mixture used for decoking. Although a single baffle is typically used in the lower part of the middle section of the vessel, multiple baffles may be used as well.

As earlier noted, the apparatus of the present invention comprises a substantially concentrically positioned, substantially cylindrical boot of less diameter than the middle section, the boot communicating with the lower cap section, and further comprising an inlet for quench oil and a liquid outlet at its lower end. The boot is the location at which hot liquid can be quenched by recycle of externally cooled liquid. The boot is advantageously sized to provide negligible liquid residence time before and during quenching, which prevents coke formation and provides a sufficient liquid level to be controllable. The liquid level also provides NPSH or Net Positive Suction Pressure to prevent cavitation in the pumps which serve to transfer liquid bottoms from the vessel. The boot may comprise additional internal components to ensure that recycle quench is thoroughly and rapidly mixed with the hot liquid without causing vortexing of the liquid. Liquid vortexes make the liquid level difficult to control and can allow gas to flow with the liquid into the pumps.

In one embodiment, the present invention relates to an apparatus wherein the boot further comprises an inlet for recycle quench oil. While quench can flow directly into the boot, this may cause liquid vortexing and a wavy gas/liquid interface.

In an embodiment of the present invention, it is especially desirable to provide the boot with a ring distributor for recycle quench oil, located at about the normal operating liquid level maintained in the boot. The ring distributor for recycle quench oil can advantageously comprise downwardly directed apertures to effect rapid quenching and a level gas/ liquid interface. Sufficient number and size of the holes in the ring distributor ensure good flow distribution while plugging with coke.

In one embodiment, the apparatus of the present invention comprises a boot that further comprises anti-swirl baffles. Typically, the anti-swirl baffles comprise vanes whose longitudinal edges are substantially perpendicular to an internal wall of the boot, although any effective design is sufficient for present purposes.

In an embodiment, the apparatus contains a boot that further comprises at least one grate above and proximal to the liquid outlet. Such grate(s) prevent or minimize vortexing while liquid drains from the boot.

In still another embodiment, the present invention comprises an apparatus whose boot can comprise one or more additional drains for removing liquid, e.g., a side outlet above the liquid outlet. This can further prevent liquid from vortexing.

In an embodiment, the apparatus of the invention contains a boot that further comprises a side inlet for introducing fluxant. This is of particular utility because the liquid in the boot typically exhibits high viscosity as a result of high molecular weight or being partially visbroken. To promote flow of liquid hydrocarbon, the boot can be equipped with one or more nozzles for fluxant addition. Advantageously, the fluxant nozzle or nozzles can be located below the normal liquid level in the boot. Thus, fluxant can enter below the quench point, thereby preventing the fluxant from boiling.

In applying this invention, hydrocarbon feedstock containing resid may be heated by indirect contact with flue gas in a first convection section tube bank of the pyrolysis furnace before mixing with the fluid. Preferably, the temperature of the hydrocarbon feedstock is from about 150 to about 260° C. (300 to 500° F.) before mixing with the fluid.

The mixture stream may then be heated by indirect contact with flue gas in a first convection section of the pyrolysis furnace before being flashed. Preferably, the first convection section is arranged to add the fluid, and optionally primary dilution steam, between passes of that section such that the hydrocarbon feedstock can be heated before mixing with the fluid and the mixture stream can be further heated before being flashed.

The temperature of the flue gas entering the first convection section tube bank is generally less than about 815° C. (1500° F.), for example, less than about 700° C. (1300° F.), such as less than about 620° C. (1150° F.), and preferably less than about 540° C. (1000° F.).

Dilution steam may be added at any point in the process, for example, it may be added to the hydrocarbon feedstock containing resid before or after heating, to the mixture stream, and/or to the vapor phase. Any dilution steam stream may comprise sour or process steam. Any dilution steam stream may be heated or superheated in a convection section tube bank located anywhere within the convection section of the furnace, preferably in the first or second tube bank.

The mixture stream may be at about 315 to about 540° C. (600 to 1000° F.) before the flash step, and the flash pressure may be about 275 to about 1375 kPa (40 to 200 psia). Following the flash, 50 to 98% of the mixture stream may be in the vapor phase. An additional separator such as a centrifugal separator may be used to remove trace amounts of liquid from the vapor phase. The vapor phase may be heated to above the flash temperature before entering the radiant section of the furnace, for example to between about 425 and about 705° C. (800 to 1300° F.). This heating may occur in a convection section tube bank, preferably the tube bank nearest the radiant section of the furnace.

Unless otherwise stated, all percentages, parts, ratios, etc., are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless whether ranges are separately disclosed.

Also as used herein, flow regimes are visual or qualitative properties of fluid flow. There is no set velocity and no set drop size. Mist flow refers to a two-phase flow where tiny droplets of liquid are dispersed in the vapor phase flowing through a pipe. In clear pipe, mist flow looks like fast moving small rain droplets.

Annular flow refers to a two-phase flow where liquid flows as streams on the inside surface of a pipe and the vapor flows in the core of the pipe. The vapor flow velocity of annular flow is about 6 m/sec (20 ft/sec). In clear pipe, a layer of fast moving liquid is observed. Few droplets of liquid are observed in the core of the vapor flow. At the pipe exit, the liquid usually drips out and only a small amount of mist is observed. The change from mist to annular flow usually includes a transition period where mist and annular flow exist together.

The feedstock comprises at least two components: volatile hydrocarbons and non-volatile hydrocarbons. The mist flow, in accordance with the present invention, comprises fine droplets of non-volatile hydrocarbons entrained in volatile hydrocarbon vapor.

Figure 10:
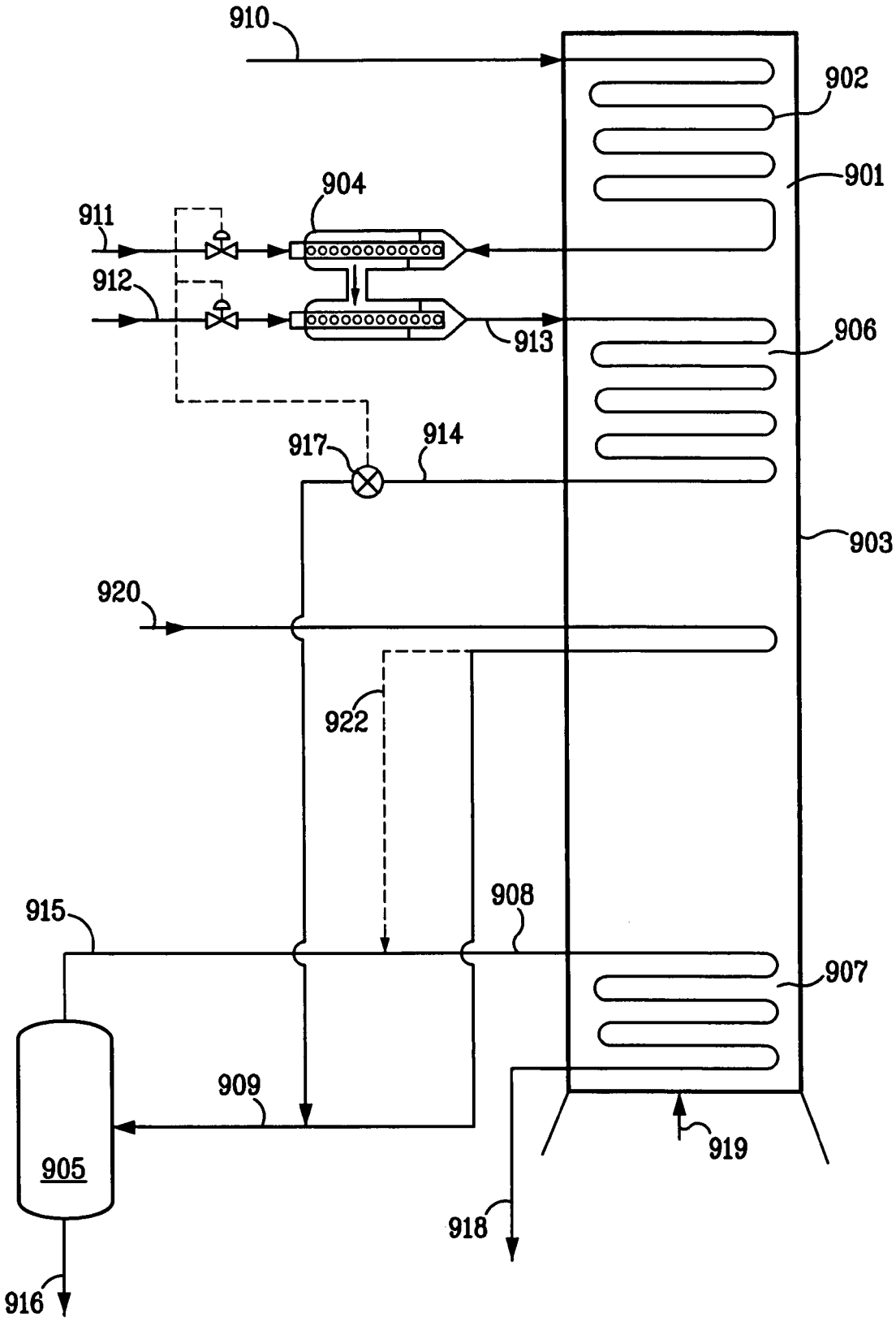
FIG. 10 illustrates a schematic flow diagram of a process in accordance with the present invention employed with a pyrolysis furnace.

A process for cracking a hydrocarbon feedstock 910 of the present invention as illustrated in FIG. 10 comprises preheating a hydrocarbon feedstock by a bank of exchanger tubes 902, with or without the presence of water 911 and steam 912 in the upper convection section 901 of a steam cracking furnace 903 to vaporize a portion of the feedstock and to form a mist stream 913 comprising liquid droplets comprising non-volatile hydrocarbons in volatile hydrocarbon/steam vapor. The further preheating of the feedstock/water/steam mixture can be carried out through a bank of heat exchange tubes 906. The mist stream upon leaving the convection section 914 has a first flow velocity and a first flow direction. The process also comprises treating the mist stream to coalesce the liquid droplets, separating at least a portion of the liquid droplets from the hydrocarbon vapor in a flash/separation vessel 905 to form a vapor phase 915 and a liquid phase 916, and feeding the vapor phase 908 to the lower convection section 907 and thence by crossover piping 918 to the radiant section of the cracking furnace 903. Flue gas from the radiant section is introduced to the lower convection section 907 of furnace 903 via 919.

As used herein, non-volatile components, or resids, are the fraction of the hydrocarbon feed with a nominal boiling point above 590° C. (1100° F.) as measured by ASTM D-6352-98 or D-2887. This invention works very well with non-volatiles having a nominal boiling point above 760° C. (1400° F.). The boiling point distribution of the hydrocarbon feed is measured by Gas Chromatograph Distillation (GCD) by ASTM D-6352-98 or D-2887. Non-volatiles include coke precursors, which are large, condensable molecules that condense in the vapor, and then form coke under the operating conditions encountered in the present process of the invention.

The hydrocarbon feedstock can comprise a large portion, such as about 5 to about 50%, of non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixtures, hydrocarbon gas/residue admixtures, hydrogen/residue admixtures, gas oil/residue admixtures, and crude oil.

The hydrocarbon feedstock can have a nominal end boiling point of at least about 315° C. (600° F.), generally greater than about 510° C. (950° F.), typically greater than about 590° C. (1100° F.), for example, greater than about 760° C. (1400° F.). The economically preferred feedstocks are generally low sulfur waxy residues, atmospheric residues, naphthas contaminated with crude, various residue admixtures, and crude oils.

As noted, the heavy hydrocarbon feedstock is preheated in the upper convection section of the furnace 901. The feedstock may optionally be mixed with steam before preheating or after preheating (e.g., after preheating in preheater 902) in a sparger 905. The preheating of the heavy hydrocarbon can take any form known by those of ordinary skill in the art. It is preferred that the heating comprises indirect contact of the feedstock in the convection section of the furnace with hot flue gases from the radiant section of the furnace. This can be accomplished, by way of non-limiting example, by passing the feedstock through a bank of heat exchange tubes 902 located within the upper convection section 901 of the pyrolysis furnace 903. The preheated feedstock 914 before the control system 917 has a temperature between about 310 to about 510° C. (600 to 950° F.). Preferably, the temperature of the heated feedstock is about 370 to about 490° C. (700 to 920° F.), more preferably between about 400 to about 480° C. (750 to 900° F.) and most preferably between about 430 to about 475° C. (810 to 890° F.).

As a result of preheating, a portion of the feedstock is vaporized and a mist stream is formed containing liquid droplets comprising non-volatile hydrocarbon in volatile hydrocarbon vapor, with or without steam. At flow velocities of greater than about 30 m/sec (100 ft/sec), the liquid is present as fine droplets comprising non-volatile hydrocarbons entrained in the vapor phase. This two-phase mist flow is extremely difficult to separate into liquid and vapor. It is necessary to coalesce the fine mist into large droplets or a single continuous liquid phase before entering the flash/separation vessel. However, flow velocities of about 30 m/sec (100 ft/sec) or greater are normally necessary to practically effect the transfer of heat from the hot flue gases and reduce coking, especially in lower convection section 907 and/or further downstream.

In an embodiment of the present invention, the mist stream is treated in accordance with the method disclosed in earlier noted US2004/004028 to coalesce the liquid droplets. In one embodiment in accordance with the present invention, the treating comprises reducing the velocity of the mist stream. It is found that reducing the velocity of the mist stream leaving convection section 914 before the flash/separation vessel 905 (location 909 in FIG. 10) helps coalesce the mist stream. It is preferred to reduce the mist stream velocity by at least about 40%, preferably at least about 70%, more preferably at least about 80%, and most preferably about 85%. It is also preferred to reduce the velocity of the mist flow stream leaving the convection section from at least about 30 m/sec (100 ft/sec) to a velocity of less than about 18 m/sec (60 ft/sec), more preferably to less than about 9 m/sec (30 ft/sec), and most preferably to less than about 6 m/sec (20 ft/sec).

It is found that using the inventions disclosed herein, a flash/separation vessel removal efficiency of at least about 95% can be accomplished. A preferred flash efficiency of at least about 98%, a more preferred flash efficiency of at least about 99%, and a most preferred flash efficiency of at least about 99.9% can also be achieved using the present invention. Removal or flash efficiency as used herein, is 100% less the percentage of liquid hydrocarbon entering the vessel that is entrained in the overhead vapor phase leaving the flash/separation vessel 905.

After the desirable reduction of velocity, e.g., in a combination of expanders, the fine droplets in the mist flow stream can advantageously coalesce in one or more bends and thus are easily separated from the vapor phase stream in the flash/separation vessel 905. Flash is normally carried out in at least one flash/separation vessel. In the flash/separation vessel 905, the vapor phase stream is removed from at least one upper flash/separation vessel outlet 915 and the liquid phase is removed from at least one lower flash/separation vessel outlet 916. Preferably, two or more lower flash/separation vessel outlets are present in the flash for liquid phase removal.

Secondary dilution steam 920 can be convection heated in the furnace 903 and then directed to the flash/separation vessel 905 via line 909. In one embodiment, the heated secondary dilution steam can be added directly to the flash/separation vessel 905 via line 909. Alternately, the heated secondary dilution steam can be added to the flash/separation vessel overhead by an optional bypass 922.

Figure 11:
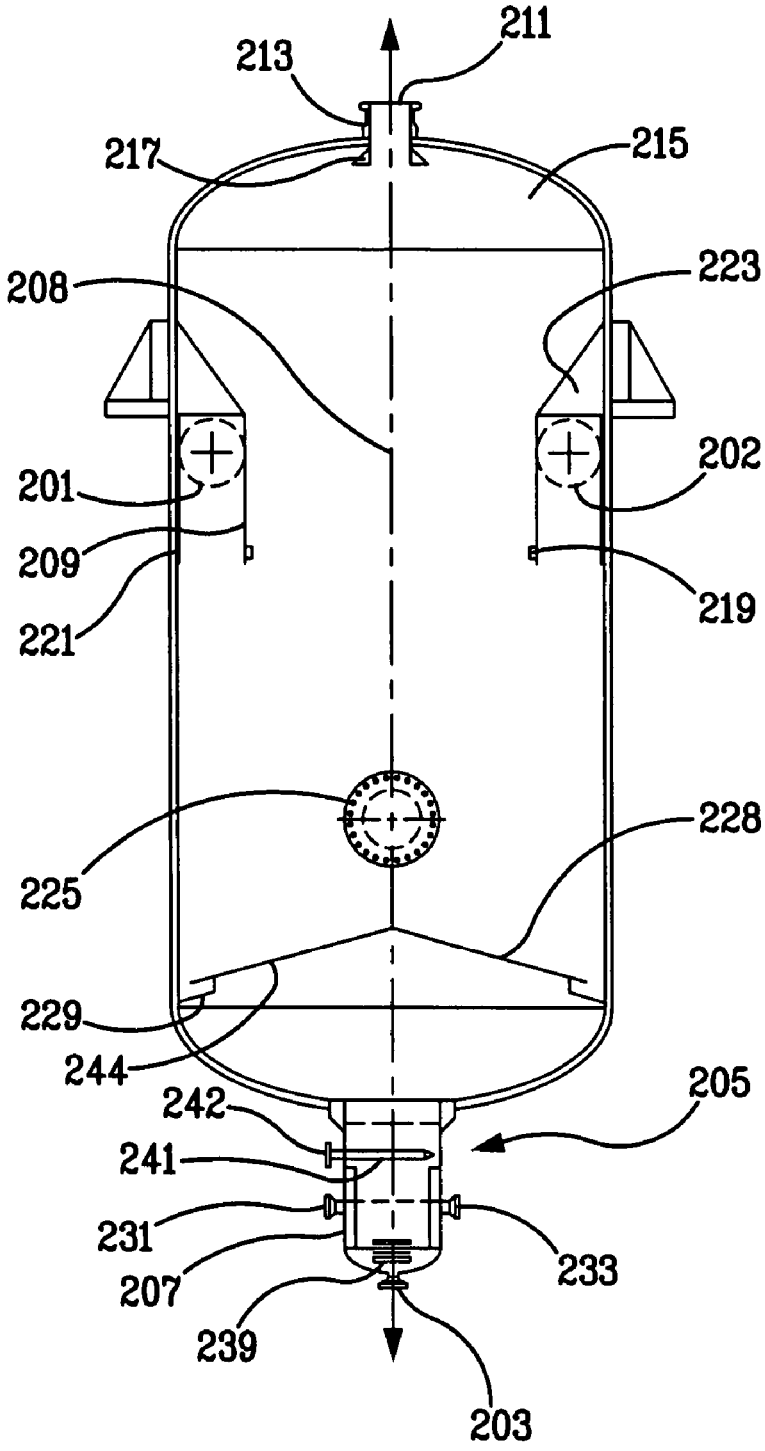
FIG. 11 illustrates an elevational view of an embodiment of the flash/separation apparatus of the present invention comprising tangential inlets, annular, inverted-L baffle, perforated conical baffle, manway, boot with anti-swirl baffles and ring distributor.

To further increase the removal efficiency of the non-volatile hydrocarbons in the flash/separation vessel (or vapor/liquid separation apparatus), it is preferred that the flash stream 909 of FIG. 10 enters the flash/separation vessel tangentially through tangential flash/separation vessel inlet 201 and 202 as shown in FIG. 11. Preferably, the tangential inlets are level or slightly downward flow. The non-volatile hydrocarbon liquid phase will form an outer annular flow along the inside flash/separator vessel wall and the volatile vapor phase will initially form an inner core and then flow upwardly in the flash/separation vessel. In one preferred embodiment, the tangential entries should be the same direction as the Coriolis effect.

The liquid phase is removed from bottom flash/separation vessel outlet 203 attached to boot 205. Optionally, a side flash/separation vessel outlet 231 or a vortex breaker comprising anti-swirl baffles or vanes 207 can be added to prevent a vortex forming in the outlet. The upward inner core flow of vapor phase is diverted in the middle section 208 around an annular structure or baffle 209 inside the flash/separation vessel and is removed from at least one upper flash/separation vessel outlet or overhead vapor outlet 211 which can comprise a pipe 213 extending above and below the upper cap portion 215 of the vessel which is typically semi-elliptical in longitudinal section. The baffle or annular structure 209 is installed inside the flash/separation vessel to further avoid and reduce any portion of the separated liquid phase, flowing downwards in the flash/separation vessel, from being entrained in the upflow vapor phase in the flash/separation vessel. The pipe 213 may have a skirt 217 extending circumferentially down and out from a lower section of the pipe. A stiffening ring 219 is attached to the lower internal portion of the annular structure 209 for reinforcement. A wear plate 221 is optionally provided around the internal vessel wall partially enclosed by the annular structure for the purpose of preventing erosion of the internal vessel wall by coke during decoking. A support structure 223 may be used to attach the annular structure 209 to the vessel from above. An optional manway 225 is provided in the vessel wall to provide access to the vessel internals. A conical baffle 244 having sufficient pitch to prevent liquid from pooling on its surface is optionally located in the lower portion of the vessel vessel, e.g., beneath the manway. Conical baffle 244 can be supported by columns or brackets 229 attached to the vessel wall. A baffle manway 228 optionally provides access through the conical baffle. Boot 205 may optionally comprise a side outlet 231 that permits withdrawal of liquid bottoms while avoiding the swirling flow problems associated with using only the bottom liquid outlet 203. The boot 205 may further comprise an inlet 233 for liquid fluxant added to control viscosity, as well as an inlet for quench oil 242 in communication with ring distributor 241. The boot may also comprise anti-vortex subway grating 239. The vapor phase, preferably, flows to the lower convection section 907 of FIG. 10 and through crossover pipes 908 to the radiant section of the pyrolysis furnace.

Figure 12:
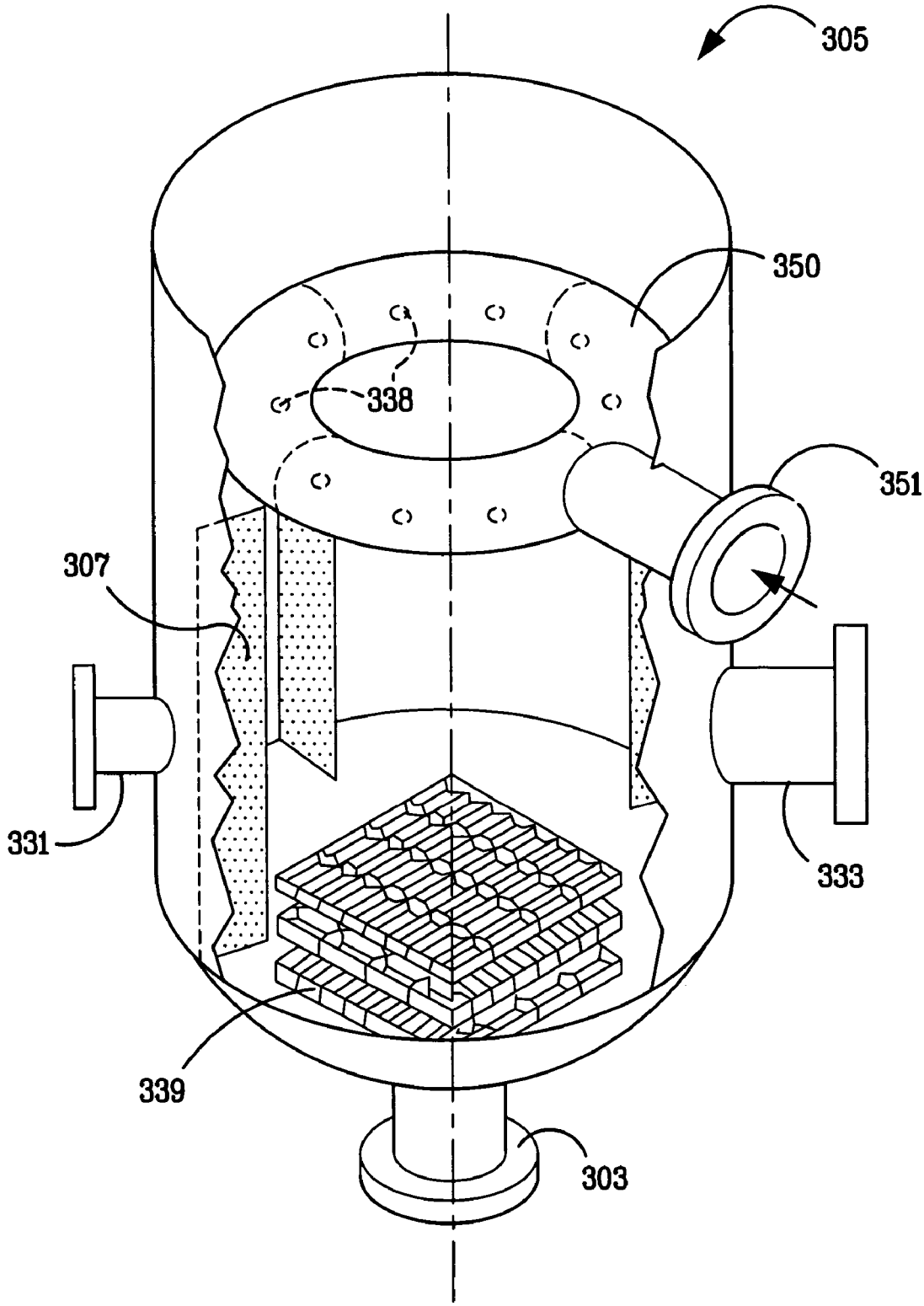
FIG. 12 provides a perspective detailed view of a boot for an embodiment of the present invention, depicting an inlet for quench oil and associated ring distributor, an inlet for fluxant, a side drain, and anti-swirl baffles.

Referring to FIG. 12, a perspective detailed view of a boot 305 shows a bottom resid liquid outlet 303, anti-swirl baffles 307, a side drain 331, a fluxant inlet 333, a quench oil inlet 351 attached to ring distributor 350 having downwardly pointed holes 338, and anti-vortex subway grating 339.

Figure 13:
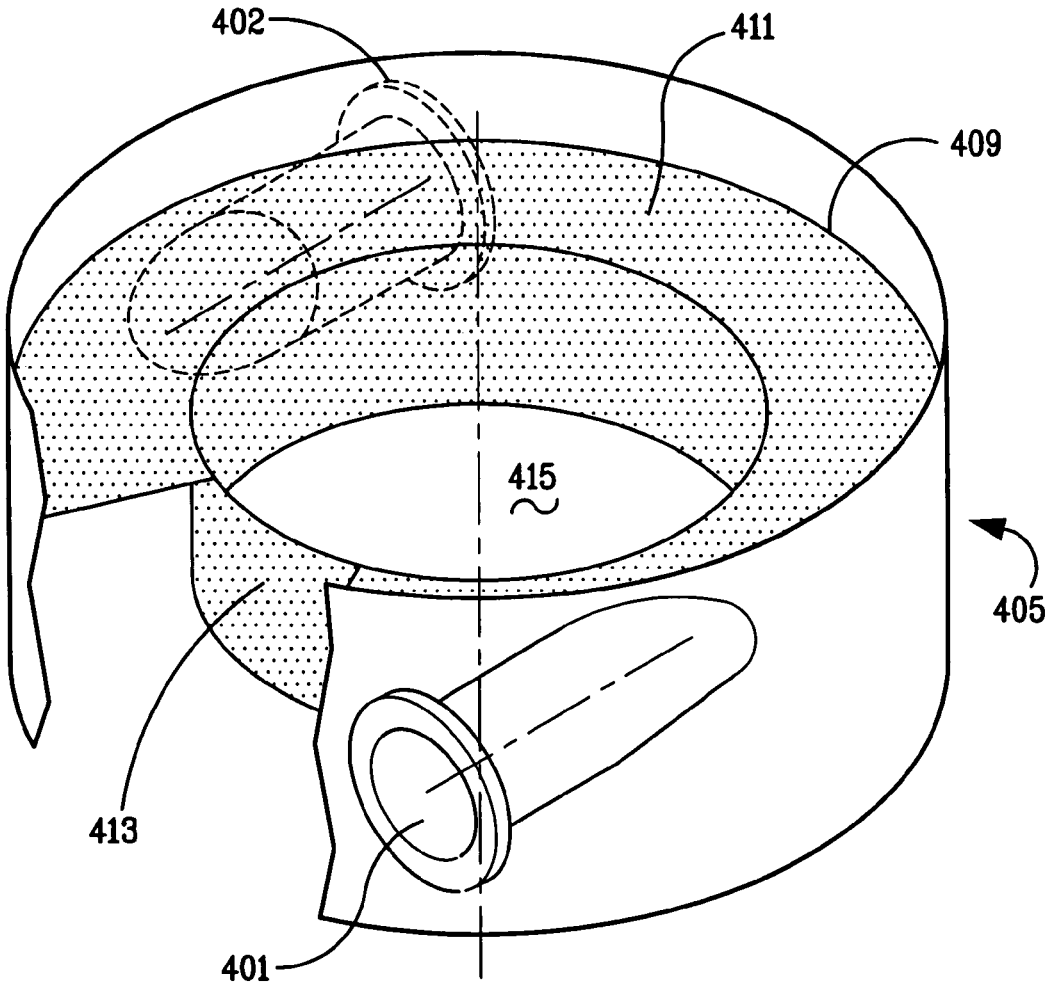
FIG. 13 provides a perspective view of a cross-section of the apparatus taken at the level of the tangential inlet nozzles showing the details of the annular, inverted-L baffle.

Referring to FIG. 13, a perspective detailed view, including a cut-away, of a cross-section of the vapor/liquid separation apparatus or flash/separation vessel 405 taken at the level of the tangential inlet nozzles 401 and 402 shows the details of the annular structure 409, comprising a horizontal annular ring component or annular ceiling section 411 extending from the circular wall of the flash/separation vessel 405, and an internal vertical side wall 413, providing an inverted-L shaped profile as shown by the cut-away. An open core area 415 allows upward flow of the vapor phase to the overhead or vapor outlet 211 shown in FIG. 2.

Figure 14:
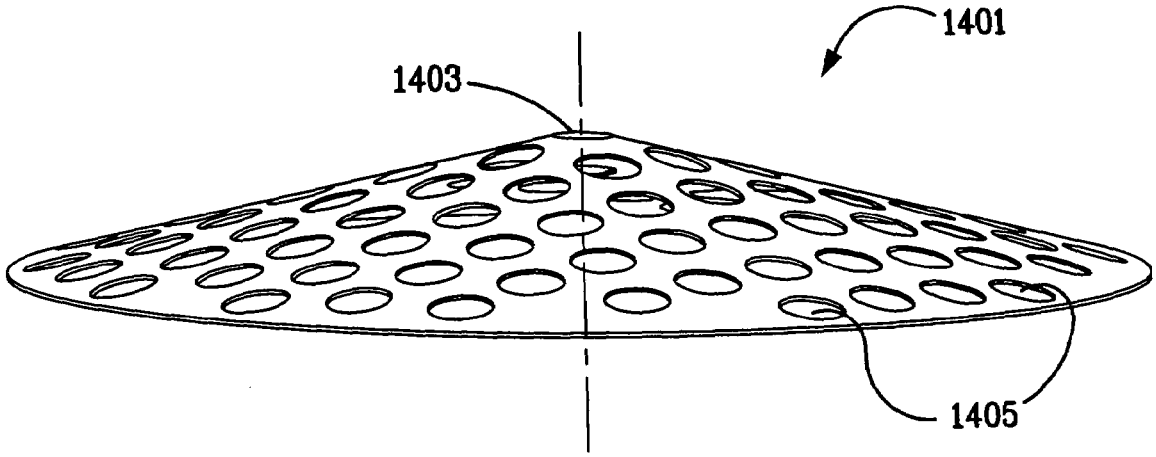
FIG. 14 provides a perspective view of a perforated conical baffle used in an embodiment of the present invention.

Referring to FIG. 14, a perspective view is provided of a perforated conical baffle 1401 having an apex 1403 used in an embodiment of the present invention, which includes perforations 1405 of round or elliptical shape.

Temperature Regulation of Furnace Tube Banks

Controlling temperature in furnace tube banks provide greater flexibility in selecting feedstocks which can be processed in accordance with this aspect of the invention.

Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, hydrocarbon gas/residue admixtures, hydrogen/residue admixtures, $C_4$'s/residue admixtures, naphtha/residue admixtures, gas oil/residue admixtures, and crude oil; especially crudes, atmospheric resids, contaminated condensates, and contaminated naphthas.

The present invention relates to an apparatus or process for cracking hydrocarbon feedstock, wherein the temperature of heated effluent directed to a vapor/liquid separator, such as a flash/separation vessel, whose overhead is subsequently cracked, can be controlled within a range sufficient so the heated effluent is partially liquid, such as from about 260 to about 540° C. (500 to 1000° F.). This permits processing of a variety of feeds with differing volatility, such as atmospheric resid (at higher temperature) and dirty condensates, such as crude- or fuel oil-contaminated condensates (at lower temperature). For example, a very light crude such as Tapis has a moderate amount of resid, yet might need to enter the convection section at the lower inlet because, like condensates, it contains a lot of low molecular weight light hydrocarbons. These lights combine with steam/vaporized water to vaporize all but the non-volatile heavies at a low temperature. As long as some non-volatile resid is present, this temperature does not change much with resid concentration. The temperature can be lowered as needed by (i) providing one or more additional downstream feed inlets to a convection section, (ii) increasing the ratio of water/steam mixture added to the hydrocarbon feedstock, (iii) using a high pressure boiler feed water economizer to remove heat, (iv) superheating high pressure steam to remove heat, (v) bypassing an intermediate portion of the convection section used, e.g., preheat rows of tube banks, as described above, and/or (vi) reducing excess oxygen content of the flue gas providing convection heat. A radiant zone beneath the convection section includes a burner producing flue gas passing upward through the tube banks. Typically, a plurality of burners is used which is sufficient to provide uniform flue gas heat release in the radiant zone, such as 10, 20, or even 50 or more burners.

In an embodiment of the present invention, the radiant zone includes a means for adjusting excess oxygen content of the flue gas, which provides temperature control for the convection section. A sample of flue gas exiting the radiant section of the furnace is cooled and analyzed for oxygen. The flue gas oxygen can be controlled as a function of analyzed oxygen content by adjusting dampers at the burner's air ducts, adjusting the dampers/louvers located either below or above the stack induced draft fan, and by adjusting the induced draft fan speed. Since flue gas analysis takes a relatively long time, the furnace draft, i.e., the difference in pressure between the top of the radiant section and the outside air, a rapidly responding parameter, is advantageously used to control the damper, louver and fan speed adjustments.

One embodiment of the present invention comprises a line which bypasses at least a portion of the fourth tube bank and whose effluent is directed to the vapor/liquid separator.

An embodiment of the present invention comprises a first transfer line exchanger for receiving cracked effluent from the radiant zone, the transfer line exchanger having an outlet for removing quenched effluent. A second transfer line exchanger can be placed downstream from the first transfer line exchanger to provide additional effluent quenching. A recovery train is placed downstream of the transfer line exchanger.

In one embodiment, the one or more inlets for introducing water and steam are associated with a sparger for mixing the water, the steam, and the feedstock.

In an embodiment, the upper inlet is used for introducing feeds selected from the group consisting of crude oil, atmospheric resids, and condensates which contain at least about 2 ppm by weight [ppm(w)] resids.

In one embodiment, the feeds to the upper inlet are selected from the group consisting of crude oil and atmospheric resids.

In one embodiment, the lower inlet is used for introducing feeds that contain at least about 2 ppm(w) resids. Typically, such feeds are condensates that contain at least about 350 ppm(w) resids. Where such feeds are employed, their temperature prior to introduction to the vapor/liquid separator can be provided at a lower temperature as needed by adjusting excess oxygen content of the flue gas. The excess oxygen content can be adjusted to at least about 4%, particularly for the less volatile heavy feeds. For more volatile lighter feeds, excess oxygen content is preferably adjusted to no greater than about 3%, such as no greater than about 1.5%.

In an embodiment, the process of the invention further comprises bypassing at least a portion of the fourth tube bank and directing effluent taken from an intermediate portion of the fourth tube bank to the vapor/liquid separator.

In an embodiment where a second transfer line exchanger further quenches the quenched cracked effluent from a first transfer line exchanger, the olefins from the further quenched cracked effluent are recovered in a recovery train.

In one embodiment of the process, the hydrocarbon feedstock-containing resid is selected from light crude oil and condensate contaminated with resids in the effluent from the fourth tube bank directed to the vapor/liquid separator is maintained at temperatures less than about 315° C. (600° F.). Typically, the temperatures of the fourth tube bank effluent are less than about 290° C. (550° F.).

In an embodiment of the process of the invention, the hydrocarbon feedstock-containing resid is selected from the group consisting of crude oil and atmospheric resid (e.g., atmospheric pipestill bottoms) in the effluent from the fourth tube bank is directed to the vapor/liquid separator is maintained at temperatures of at least about 400° C. (750° F.), such as at least about 460° C. (860° F.), e.g., ranging from about 400 to about 540° C. (750 to 1000° F.). In one embodiment of the process, the feed is introduced to the first tube bank through the upper hydrocarbon feed inlet.

In an embodiment, the feed is introduced to the first tube bank through the lower hydrocarbon feed inlet. Typically, the feed contains at least about 2 ppm(w) resid.

In another embodiment of the process, the feed is introduced to the first tube bank through both (i) an upper hydrocarbon feed inlet and (ii) a lower hydrocarbon feed inlet. The feed can be selected from the group consisting of crude oil and atmospheric resid.

In an embodiment of the process, a feed that contains less than about 50 wt % resid is introduced to the first tube bank through the upper hydrocarbon feed inlet. The feed can be selected from the group consisting of crude oil, atmospheric resid, and heavy or contaminated condensate.

Figure 15:
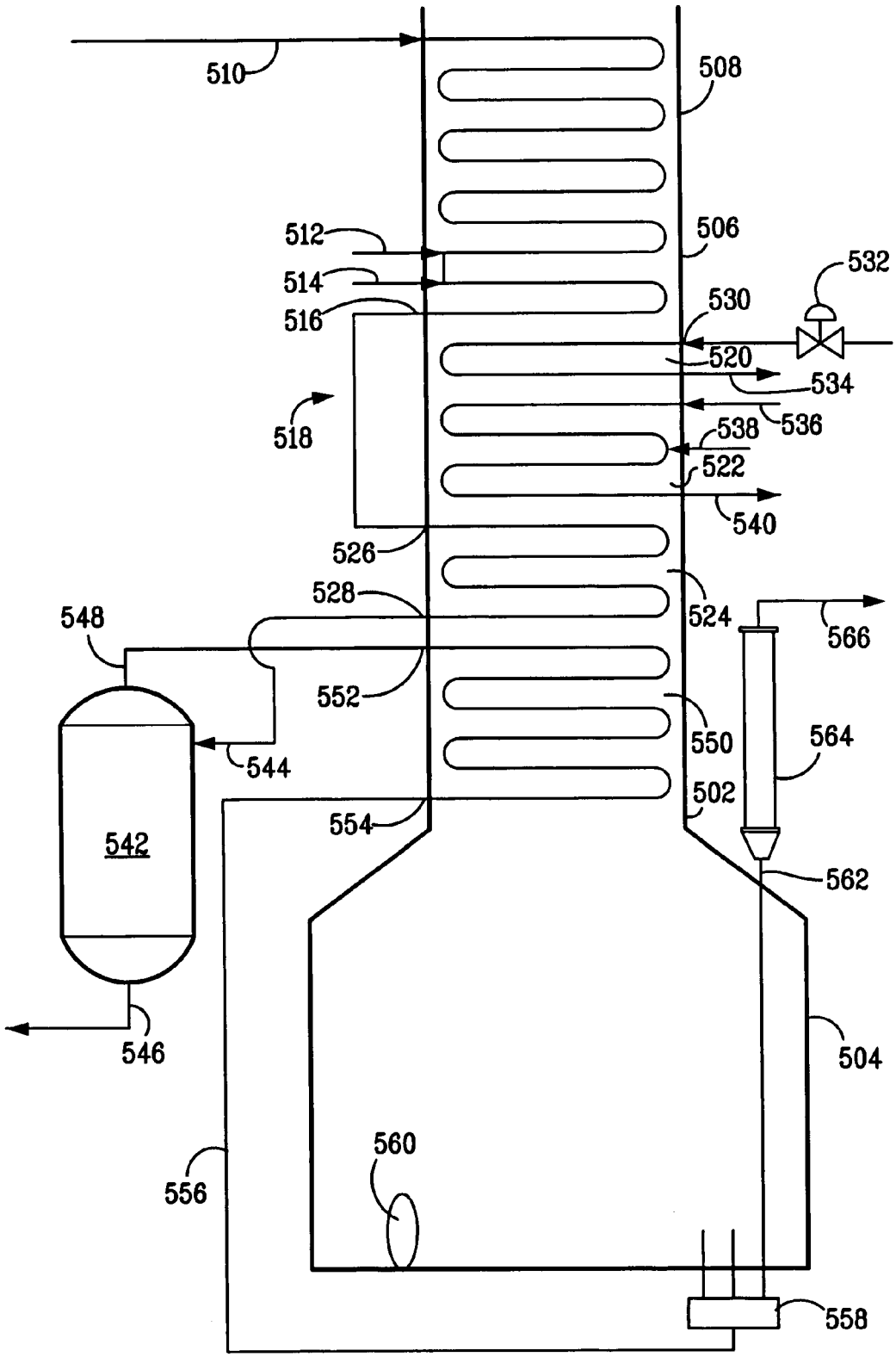
FIG. 15 illustrates a schematic flow diagram of the overall process and apparatus in accordance with the present invention wherein a variety of feeds are introduced through a single feed inlet.

FIG. 15 depicts an apparatus for cracking hydrocarbon feedstock selected from disparate sources, including crudes, atmospheric resids and condensates wherein all feeds enter through the same inlet. The apparatus comprises a furnace 502 comprising a radiant section 504 and a convection section 506 comprising a convection zone containing a first tube bank 508 comprising an upper hydrocarbon feed inlet 510, inlet for introducing water 512, and inlet for introducing steam 514, e.g., via a dual sparger, the respective amounts of water and steam controlling temperature in the apparatus, to a limited extent. By swapping water for steam up to about 9 MW of heat is absorbed, reducing the temperature in flash/separation vessel 542 by about 55 to about 110° C. (100 to 200° F.). An outlet 516 is provided for a heated mixture stream from the first tube bank 508 and feeds into a process jumpover or bypass line 518 which bypasses a second tube bank 520 and a third tube bank 522 to a fourth tube bank 524 positioned below the second and third tube banks through fourth tube bank inlet 526 and the heated stream passes through fourth tube bank outlet 528. A separate second tube bank 520 is an economizer whose economizer inlet 530 is controlled by valve 532 for introducing high pressure boiler feed water added at a temperature of about 110° C. (230° F.), further heated within the furnace 502 to a temperature of up to about 310° C. (590° F.) and removed as boiler feed water of greater heat content via economizer outlet 534 and directed to a steam vessel/boiler. When crudes and atmospheric resid feeds (with relatively low volatility) are cracked, less or no high pressure boiler feed water flows through the economizer. This maximizes flue gas temperature above the economizer. When high volatility feeds are cracked, e.g., dirty condensates and dirty naphthas, more high pressure boiler feed water flows through the economizer, producing cooler flue gas and relatively cool condensate above the economizer. The economizer can absorb roughly an additional 9 MW. The economizer allows energy efficient furnace operation no matter which feed is cracked. For example, because some liquid must be present in the mixture entering the flash/separator vessel, its temperature is lower for dirty condensates than for crudes or atmospheric resids. The lower temperature provides a lower crossover temperature and a greater radiant heat requirement or furnace firing per unit of condensate than crude or atmospheric resid. At constant maximum firing, the condensate feed rate to the radiant zone is about 10 to about 20% less than for the heavier feeds, resulting in excess heat entering the convection zone. But the greater flow of high pressure boiler feed water in the economizer absorbs the extra heat entering the convection section, which is in turn converted to additional valuable high pressure steam in the steam vessel. Thus, compared to a conventional furnace, during condensate operations, less feed is cracked, but more high pressure steam is produced. The separate third tube bank 522 is positioned beneath the first tube bank and comprises an inlet 536 for high pressure steam, an inlet 538 for mixing desuperheater water with said high pressure steam and reheating said high pressure steam, and an outlet 540 for withdrawing superheated high pressure steam. Saturated steam, typically at 10,500 kPa and 315° C. (1500 psig and 600° F.) is fed from the steam vessel at the top of the furnace to a bank of convection tubes which heat the steam to about 482° C. (900° F.). Then, just exterior to the convection section, high pressure boiler feed water is added to the high pressure steam through a combined control valve atomizer assembly called the desuperheater. The steam is quenched to about 315° C. (600° F.) and is subsequently reheated to about 510° C. (950° F.). This 510° C. (950° F.) outlet temperature is controlled by the quantity of the high pressure water added through the desuperheater. The intermediate steam quenching by the desuperheater allows the use of less expensive convection tube alloys and produces more high pressure steam than other ways of controlling the outlet temperature.

Inasmuch as it is important that the feed to the liquid/vapor separation apparatus or flash/separation vessel 542 be at least partially liquid, the temperature of the heated mixture stream exiting from fourth tube bank outlet 528 is advantageously maintained at a temperature to effect this, such as less than about 290° C. (550° F.) for condensates. At 290° C. the resid, a fraction of the remaining crude oil contaminant, and a small fraction of the condensate comprise the liquid phase. For feeds such as crudes and atmospheric resids, where less or no heat is removed by the economizer or by vaporized sparger water, the temperature of the feed entering the flash/separation vessel can be at least about 400° C. (750° F.), preferably at least about 425° C. (800° F.). At this temperature, most but not all of the crude or atmospheric resid is in the vapor phase.

The heated mixture stream from fourth tube bank outlet 528 is directed to flash/separation vessel (or knockout vessel) 542 through flash/separation vessel inlet 544 which can be substantially tangential to the vessel wall to effect swirling. Liquid hydrocarbon resid is removed through bottoms outlet 546 and a vaporous overhead, e.g., a clean steam/hydrocarbon vapor, is removed through overhead outlet 548. The vaporous overhead then passes to fifth tube bank 550, positioned beneath the fourth tube bank, via inlet 552 for further heating and is removed via outlet 554 through crossover line 556 and manifold 558 to radiant zone 504 which includes burners 560 producing flue gas passing upwards through the radiant zone and convection tube banks.

The amount of excess oxygen in the flue gas can be controlled, providing yet an additional means to broaden the temperature range used in the process. When cracking low volatility feeds, the furnace can be operated with relatively high excess oxygen in the flue gas, such as from about 4 to about 6%. But when cracking high volatility feeds, the excess oxygen can be reduced below about 4%, such as 2% or even lower. This reduces heat to the convection section by about 3 MW to about 9 MW.

The effluent from the fifth tube bank outlet is cracked in the radiant zone and cracked effluent is removed through outlet 562. The cracked effluent can pass from outlet 562 to one or more transfer line exchangers 564 and thence to a recovery train via line 566. The cracking of certain feeds such as condensates can result in low flash/separation vessel and crossover temperatures which tend to require addition of more heat by the radiant zone where cracking occurs, e.g., condensate typically requires about 85° C. (150° F.) additional heating and thus effects higher tube metal temperatures and excessive coking in the radiant zone. These conditions can be ameliorated by increasing the length of the coil (or tube) employed in the radiant zone, such as from about 2 to about 20%, e.g., about 10%, for example, extending a radiant coil from about 12 m to about 13 m (40 to 44 ft), which results in a slightly lower selectivity for crude or atmospheric resid cracking, but longer run-lengths for all feeds.

Figure 16:
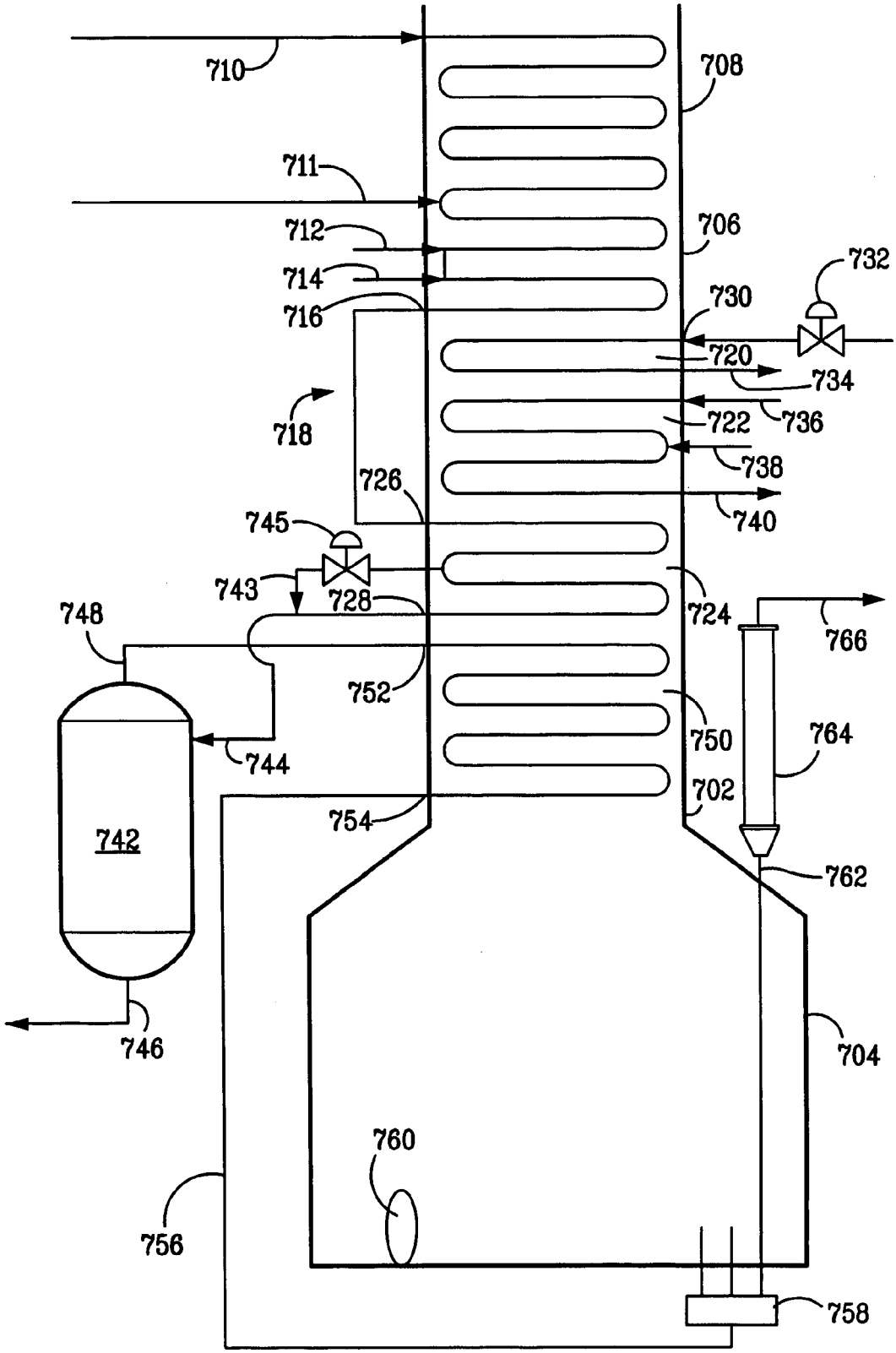
FIG. 16 illustrates a schematic flow diagram of the overall process and apparatus in accordance with the present invention wherein a variety of feeds are introduced through a plurality of feed-specific inlets with an optional heater bypass used for condensate feeds requiring less heating before flashing.

FIG. 16 depicts an apparatus for cracking hydrocarbon feedstock feeds selected from disparate sources, including crudes, atmospheric resids and condensates. Feeds such as crudes and atmospheric resids requiring more heating enter through an upper inlet while feeds such as dirty condensates, naphthas, and kerosenes requiring less heating are added downstream in a lower inlet and are exposed to less convection heat transfer area.

The apparatus comprises a furnace 702 comprising a radiant section 704 and a convection section 706 comprising a convection zone containing a first tube bank 708 comprising an upper hydrocarbon feed inlet 710, for introducing feeds such as crudes and atmospheric resids, a lower hydrocarbon feed inlet 711 for introducing feeds such as dirty condensates, an inlet for introducing dilution water 712, and an inlet for introducing dilution steam 714, the respective amounts of dilution water and steam controlling temperature to an extent in the apparatus. An outlet 716 is provided for a heated mixture stream from the first tube bank 708 and feeds into a process jumpover or bypass line 718 which bypasses a second tube bank 720 and a third tube bank 722 to a fourth tube bank 724 positioned below the second and third tube banks through fourth tube bank inlet 726 and the heated stream passes via fourth tube bank outlet 728.

A separate second tube bank 720 is an economizer whose economizer inlet 730 is controlled by valve 732 for introducing high pressure boiler feed water added at a temperature of about 110° C. (230° F.), heated within the second tube bank 720 to a temperature of up to about 310° C. (590° F.) and is removed as high pressure boiler feed water of greater heat content via economizer outlet 734 for further treatment, such as by a steam vessel/boiler.

The separate third tube bank 722 is positioned beneath the first tube bank and comprises an inlet 736 for high pressure steam, an inlet 738 for mixing desuperheater water with said high pressure steam, reheating of said high pressure steam, and an outlet 740 for withdrawing superheated high pressure steam.

Inasmuch as it is important that the feed to the liquid/vapor separation apparatus or flash/separation vessel 742 be at least partially liquid, the temperature of the heated mixture stream exiting from fourth tube bank outlet 728 is typically maintained at a temperature to effect this. The heated mixture stream from fourth tube bank outlet 728 is directed to flash/separation vessel (or knockout vessel) 742 through flash/separation vessel inlet 244. One way of reducing the temperature of the heated mixture stream directed to the flash/separation vessel is to provide a bypass line 743 around a portion of the fourth tube bank outlet 728 to the flash/separation vessel inlet 744. The bypass line 743 is controlled by valve 745 and is especially suited for feeds such as dirty condensates introduced at lower temperature. Hydrocarbon resid is removed through bottoms outlet 746 and vaporous overhead through overhead outlet 748. The vaporous overhead then passes to fifth tube bank 740, positioned beneath the fourth tube bank, via inlet 752 for further heating and is removed via outlet 754 through crossover line 756 and manifold 758 to radiant zone 704 which includes burners 760 producing flue gas passing upwards through the radiant zone and convection tube banks. The amount of excess oxygen in the flue gas can be controlled. The effluent from the fifth tube bank outlet is cracked in the radiant zone and cracked effluent is removed through outlet 762. The cracked effluent can pass from outlet 762 to one or more transfer line exchangers 764 and thence to a recovery train via line 766.

Process and Draft Control System

The present invention relates to a process and "draft" control system for use in a pyrolysis furnace while cracking a hydrocarbon feedstock, and in particular a heavy hydrocarbon feedstock. The present invention provides a method to maintain a relatively constant ratio of vapor to liquid leaving the flash or vapor/liquid separation vessel by maintaining a relatively constant temperature of the stream entering the vapor/liquid separation vessel. More specifically, the temperature of the hot mixture stream, vapor stream or flash stream can be adjusted and maintained by periodically adjusting the draft in the pyrolysis furnace, where the draft is the measure of the difference in pressure of the flue gas in the furnace and the pressure outside the furnace. The draft is used to control the flue gas oxygen in the furnace and thus the temperature of the stream entering the vapor/liquid separation vessel.

The heavy hydrocarbon feedstock to the furnace can comprise a large portion, such as about 2 to about 50%, of non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixtures, naphtha/residue admixtures, hydrocarbon gas/residue admixtures, hydrogen/residue admixtures, gas oil/residue admixtures, and crude oil.

One embodiment of the process and draft control system can be described by reference to FIG. 17 which illustrates a furnace 1701 having a convection section 1702 and a radiant section 1703. The radiant section 1703 has radiant section burners 1704 which provide hot flue gas in the furnace 1701. The process comprises first heating a heavy hydrocarbon feedstock stream 1705 in the convection section 1702 of the furnace 1701. The heavy hydrocarbon feedstock is heated in the upper convection section 1750 of the furnace 1701. The heating of the heavy hydrocarbon feedstock can take any form known by those of ordinary skill in the art. It is preferred that the heating comprises indirect contact of the feedstock in the convection section 1702 of the furnace 1701 with hot flue gases from the radiant section 1703 of the furnace 1701. This can be accomplished, by way of non-limiting example, by passing the heavy hydrocarbon feedstock through a bank of heat exchange tubes 1706 located within the upper convection section 1750 of the pyrolysis furnace 1701. The heated heavy hydrocarbon feedstock 1752 has a temperature between about 150° C. to about 345° C. (300° F. to about 650° F.).

The heated heavy hydrocarbon feedstock is then mixed with a primary dilution steam stream 1708 to form a mixture stream 1710. The primary dilution steam stream 1708 is preferably superheated in the convection section 1702 of the furnace 1701, and is preferably at a temperature such that it serves to partially vaporize the heated heavy hydrocarbon feedstock. The use of primary dilution steam stream 1708 is optional for very high volatility feedstocks 1705 (e.g., ultra light crudes and contaminated condensates). It is possible that such feedstocks can be heated in tube bank 1706 forming a vapor and a liquid phase which is conveyed as heated hydrocarbon stream 1712 directly to the separation vessel 1716 without mixing with dilution steam stream 1708.

The mixture stream 1710 is heated again in the furnace 1701. This heating can be accomplished, by way of non-limiting example, by passing the mixture stream 1710 through a bank of heat exchange tubes 1724 located within the convection section 1702 of the furnace 1701 and thus heated by the hot flue gas from the radiant section 1703 of the furnace 1701. The thus-heated mixture leaves the convection section 1702 as a hot mixture stream 1712 having a vapor phase and a liquid phase which are ultimately separated in separation vessel 1716, which in FIG. 17 is illustrated as a knock-out or flash/separation vessel.

Optionally, a secondary dilution steam stream 1714 is heated in the convection section 1702 of the furnace 1701 and is then mixed with the hot mixture stream 1712. The secondary dilution steam stream 1714 is optionally split into a flash steam stream 1720 which is mixed with the hot mixture stream 1712 (before separating the vapor from the liquid in the separation vessel 1716) and a bypass steam stream 1718 (which bypasses the separation vessel 1716) and, instead is mixed with the vapor phase stream 1722 from the separation vessel 1716 before the vapor phase is cracked in the radiant section 1703 of the furnace 1701. This embodiment can operate with all secondary dilution steam 1714 used as flash steam stream 1720 with no bypass steam stream 1718. Alternatively, this embodiment can be operated with secondary dilution steam stream 1714 directed entirely to bypass steam stream 1718 with no flash steam stream 1720.

In a preferred embodiment in accordance with the present invention, the ratio of the flash steam stream 1720 to the bypass steam stream 1718 should be preferably 1:20 to 20:1, and most preferably 1:2 to 2:1. The flash steam stream 1720 is mixed with the hot mixture stream 1712 to form a flash stream 1726 before separating the vapor from the liquid in the separation vessel 1716. Preferably, the secondary dilution steam stream 1714 is superheated in a superheater tube bank 1756 in the convection section 1702 of the furnace 1701 before splitting and mixing with the hot mixture stream 1712. The addition of the flash steam stream 1720 to the hot mixture stream 1712 ensures the vaporization of an optimal fraction or nearly all volatile components of the hot mixture stream 1712 before the flash stream 1726 enters the separation vessel 1716.

The hot mixture stream 1712 (or flash stream 1726 as previously described) is then introduced into a separation vessel 1716 for separation into two phases: a vapor phase comprising predominantly volatile hydrocarbons and a liquid phase comprising predominantly non-volatile hydrocarbons. In one embodiment, the vapor phase stream 1722 is preferably removed from the flash/separation vessel as an overhead vapor stream 1722. The vapor phase, preferably, is fed back to the lower convection section 1748 of the furnace 1701 for optional heating and conveyance by crossover pipes 1728 to the radiant section 1703 of the furnace 1701 for cracking. The liquid phase of the separation is removed from the separation vessel 1716 as a bottoms stream 1730.

As previously discussed, it is preferred to maintain a predetermined constant ratio of vapor to liquid in the separation vessel 1716. But such ratio is difficult to measure and control. As an alternative, the temperature B of the hot mixture stream 1712 before entering the separation vessel 1716 can be used as an indirect parameter to measure, control, and maintain the constant vapor-to-liquid ratio in the separation vessel 1716. Ideally, when the hot mixture stream 1712 temperature is higher, more volatile hydrocarbons will be vaporized and become available, as a vapor phase, for cracking. However, when the hot mixture stream 1712 temperature is too high, more heavy hydrocarbons will be present in the vapor phase and carried over to the convection section 1702 furnace tubes, eventually coking the tubes. If the hot mixture stream 1712 temperature is too low, hence a low ratio of vapor to liquid in the separation vessel 1716, more volatile hydrocarbons will remain in liquid phase and thus will not be available for cracking.

The hot mixture stream 1712 temperature optimized to maximize recovery/vaporization of volatiles in the heavy hydrocarbon feedstock while avoiding excessive coking in the furnace tubes or coking in piping and vessels conveying the mixture from the separation vessel 1716 to the furnace 1701. The pressure drop across the piping and vessels conveying the mixture to the lower convection section 1748, and the crossover piping 1728, and the temperature rise across the lower convection section 1748 may be monitored to detect the onset of coking. For instance, if the crossover pressure and process inlet pressure to the lower convection section 1748 begins to increase rapidly due to coking, the temperature in the separation vessel 1716 and the hot mixture stream 1712 should be reduced. If coking occurs in the lower convection section 1748, the temperature of the flue gas to the superheater section 1756 increases, requiring more desuperheater water 1780 to control the temperature in lines 1718 and 1720.

Typically, the temperature of the hot mixture stream 1712 is set and controlled at between 310 and 560° C. (600 and 1040° F.), preferably between 370 and 490° C. (700 and 920° F.), more preferably between 400 and 480° C. (750 and 900° F.), and most preferably between 430 and 475° C. (810 and 890° F.). These values will change with the volatility of the feedstock as discussed above.

As previously noted, the furnace draft is continuously measured by pressure differential instruments and periodically adjusted to control the temperature (B, D, and C, respectively) of at least one of the hot mixture stream 1712, the vapor stream 1722 and the flash stream 1726. FIG. 17 illustrates the control system 1798 which comprises a temperature sensor that periodically adjusts the temperature for the mixture stream 1712 in connection with the furnace draft measurement. In this embodiment, the control system 1798 comprises at least a temperature sensor and any known control device, such as a computer application. The furnace 1701 draft is the difference in the pressure of the flue gas in the furnace 1701. For safety reasons, draft measurement is extremely important. If the draft is too low or non-existent, it may result in extremely dangerous operations where the hot radiant flue gas flows from the radiant section 1703 to the environment. To ensure that the flue gas only exits the furnace 1701 at the top of the stack 1764, it is measured at the location where it is a minimum. Typically, the minimum draft location, measured at points $A_1$, $A_2$ or $A_3$, can be anywhere between the top of the radiant section 1703 and the first row of tubes in the lower convection section 1748. The location of minimum draft moves depending on furnace 1701 operations. To ensure safe operation of the furnace 1701, the draft set point is higher than required for optimal thermal efficiency of furnace 1701. This ensures that the furnace 1701 will run safely during upsets in operation of the furnace 1701.

The inventive process and draft control system for controlling the temperature of at least one of the hot mixture stream 1712, vapor stream 1722, and flash stream 1726 in order to achieve an optimum vapor/liquid separation in separation vessel 1716 is determined based on the volatility of the feedstock as described above. In typical operations with heavy hydrocarbon feedstocks, the draft is set at about 0.15 to 0.25" wc (35 to 65 Pa). Water column (wc) is a convenient measure of very small differences in pressure.

Once the furnace 1701 is operating, the temperature B of the hot mixture stream 1712 is measured (alternatively, the temperature C of the flash stream 1726 or the temperature D of the vapor stream 1722 is measured) and if that temperature is lower than the desired temperature, then the set point of the draft will be increased. An increase in the set-point draft will, through the means for adjusting the draft, cause an increase in the excess flue gas oxygen in the furnace, which will cause the temperature in the furnace 1701 to increase. This will ultimately result in an increase in the temperature B of the hot mixture stream 1712 (and thus an increase in the temperature C of the flash stream 1726 and the temperature D of the vapor stream 1722).

Figure 17:
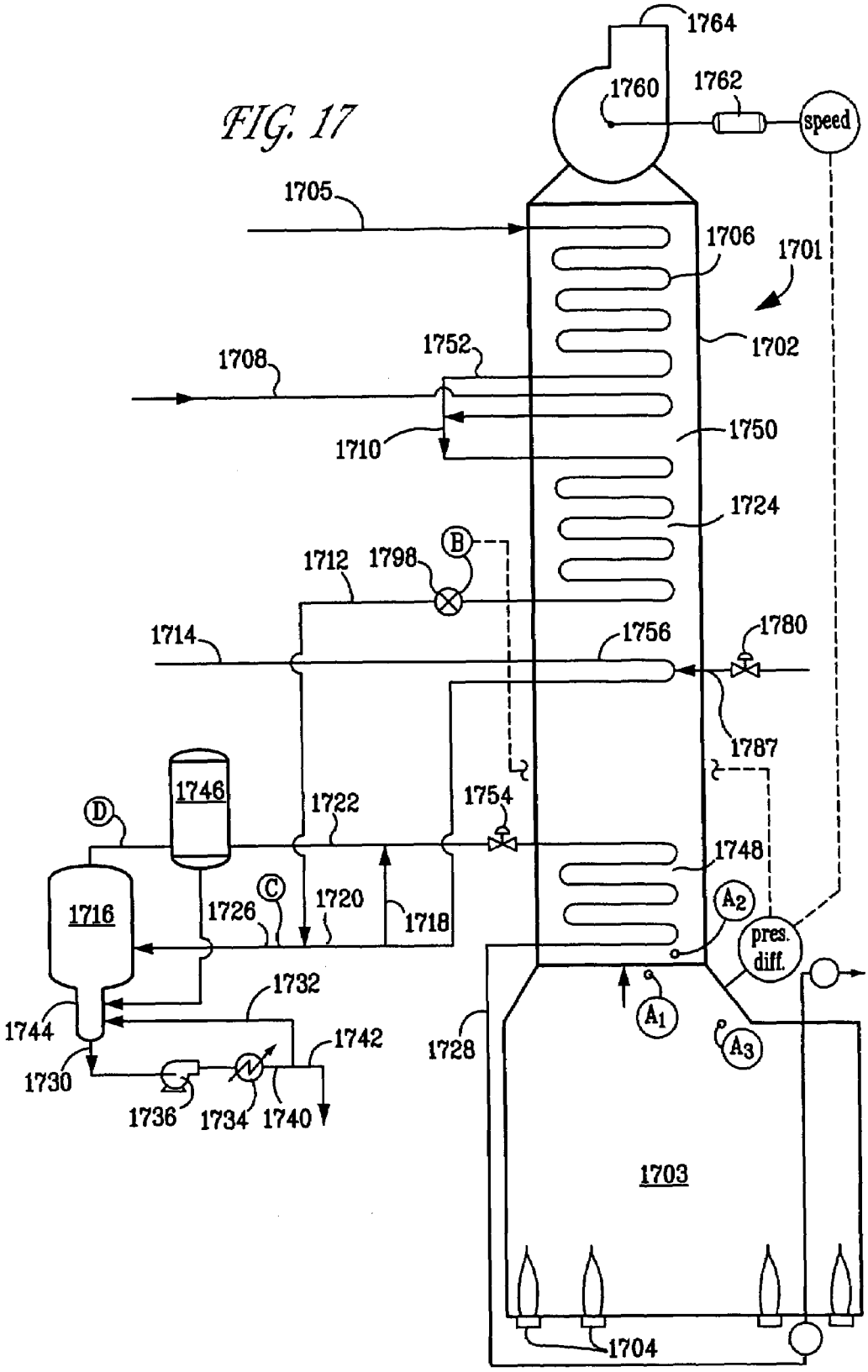
FIG. 17 illustrates a schematic flow diagram of a process and control system of one embodiment of the present invention employing at least one furnace fan.

As shown in FIG. 17, the speed of the furnace fan 1760 is varied in response to the change in the draft. For example, an increase in the speed of the furnace fan 1760 will cause an increase in the draft, which will increase flue gas oxygen and thus will increase the temperature in the convection section 1702. Other means comprise dampers to the burners (not illustrated), furnace stack dampers (see dampers 1765, illustrated in FIG. 17) or any combination of the above. The speed of the furnace fan 1760 is the fine tuning means for adjusting the draft and thus the excess oxygen in the furnace 1701. If it becomes necessary to significantly increase the flue gas excess oxygen, then the furnace fan 1760 speed can be increased to its maximum speed, which can result in too much draft, but may still not result in enough flue gas oxygen. In this case, the dampers can be opened (this is typically done manually) at the burners 1704 or at the fan 1760 (see dampers 1765 in FIG. 17), thus increasing excess oxygen in the flue gas and possibly reducing the draft in the furnace 1701 and the required fan speed.

Use of the draft measurement as part of the control system is a very quick, "real-time" way to periodically adjust and control the temperature B of the hot mixture stream 1712 (and the temperature C of the flash stream 1726) and thus indirectly the ratio of vapor to liquid separated in the separation vessel 1716. A change in the furnace fan 1760 speed will almost immediately result in a change in the draft measurement because the pressure of the radiant section 1703 responds rapidly to change in furnace fan 1760 speed. Draft differential pressure instruments respond very quickly. On the other hand, measuring the excess oxygen is a problem because instruments for measuring excess oxygen respond more slowly to changes in furnace fan 1760 speed because it takes a relatively long time for the higher oxygen flue gas to reach oxygen measuring instrument. Therefore, the immediately measurable draft response allows for the control system to quickly react to changes in furnace fan 1760 speed which not only mitigates oscillations in the furnace operations, but also allows for a quick way to periodically adjust the temperature D in the hot mixture stream 1712 (and the temperature C in the flash stream 1726) and thus the vapor/liquid separation occurring in the separation vessel 1716.

In addition to maintaining a constant temperature B of the hot mixture stream 1712 (and the temperature C and D of the flash stream 1726 and the vapor stream 1722, respectively) entering the separation vessel 1716, it is also desirable to maintain a constant hydrocarbon partial pressure of the separation vessel 1716 in order to maintain a constant ratio of vapor to liquid separation. By way of examples, the constant hydrocarbon partial pressure can be maintained by maintaining constant separation vessel 1716 pressure through the use of control valves 1754 on the vapor phase line 1722, and by controlling the ratio of steam-to-hydrocarbon feedstock in flash stream 1726. Typically, the hydrocarbon partial pressure of the flash stream 1726 in the present invention is set and controlled at between 4 and 25 psia (25 and 175 kPa), preferably between 5 and 15 psia (35 to 100 kPa), most preferably between 6 and 11 psia (40 and 75 kPa).

The separation of the vapor phase from the liquid phase is conducted in at least one separation vessel 1716. Preferably, the vapor/liquid separation is a one-stage process with or without reflux. The separation vessel 1716 is normally operated at 40 to 200 psia (275 to 1400 kPa) pressure and its temperature is usually the same or slightly lower than the temperature of the flash stream 1726 before entering the separation vessel 1716. Typically, for atmospheric resids, the pressure of the separation vessel 1716 is about 40 to 200 psia (275 to 1400 kPa) and the temperature is about 310 to 510° C. (600 to 950° F.). Preferably, the pressure of the separation vessel 1716 is about 85 to 155 psia (600 to 1100 kPa) and the temperature is about 370 to 490° C. (700 to 920° F.). More preferably, the pressure of the separation vessel 1716 is about 105 to 145 psia (700 to 1000 kPa) and the temperature is about 400 to 480° C. (750 to 900° F.). Most preferably, the pressure of the separation vessel 1716 is about 105 to 125 psia (700 to 760 kPa) and the temperature is about 430 to 480° C. (810 to 890° F.). Depending on the temperature of the flash stream 1726, usually 40 to 98% of the mixture entering the flash/separation vessel 1716 is vaporized to the upper portion of the flash/separation vessel, preferably 60 to 90% and more preferably 65 to 85%, and most preferably 70 to 85%.

The flash stream 1726 is operated, in one aspect, to minimize the temperature of the liquid phase at the bottom of the separation vessel 1716 because too much heat may cause coking of the non-volatiles in the liquid phase. Use of the optional secondary dilution steam stream 1714 in the flash stream 1726 entering the separation vessel 1716 lowers the vaporization temperature because it reduces the partial pressure of the hydrocarbons (i.e., larger mole fraction of the vapor is steam), and thus lowers the required liquid phase temperature. Alternatively, rather than using a secondary dilution steam stream 1714, it may be possible to achieve the same result by adding more steam in the primary dilution steam stream 1708.

It may also be helpful to recycle a portion of the externally cooled flash/separation vessel bottoms liquid 1732 back to the separation vessel 1716 to help cool the newly separated liquid phase at the bottom of the separation vessel 1716. Liquid stream 1730 is conveyed from the bottom of the separation vessel 1716 to the cooler 1734 via pump 1736. The cooled stream 1740 is split into a recycle stream 1732 and export stream 1742. The temperature of the recycled stream 1732 is ideally 260 to 320° C. (500 to 600° F.). The amount of recycled stream 1732 should be about 80 to 250% of the amount of the newly separated bottom liquid inside the separation vessel 1716.

The separation vessel 1716 is also operated, in another aspect, to minimize the liquid retention/holding time in the separation vessel 1716. Preferably, the liquid phase is discharged from the vessel through a small diameter "boot" or cylinder 1744 on the bottom of the separation vessel 1716. Typically, the liquid phase retention time in the separation vessel 1716 is less than 75 seconds, preferably less than 60 seconds, more preferably less than 30 seconds, and most preferably less than 15 seconds. The shorter the liquid phase retention/holding time in the separation vessel 1716, the less coking occurs in the bottom of the separation vessel 1716.

In the vapor/liquid separation, the vapor phase usually contains less than 100 ppm, preferably less than 80 ppm, and most preferably less than 50 ppm of non-volatiles. The vapor phase is very rich in volatile hydrocarbons (for example, 55-70%) and steam (for example, 30-45%). The boiling end point of the vapor phase is normally below 760° C. (1400° F.), preferably below 675° C. (1250° F.). The vapor phase is continuously removed from the separation vessel 1716 through an overhead pipe which conveys the vapor to an optional centrifugal separator 1746 which removes trace amounts of entrained or condensed liquid. The vapor then flows into a manifold that distributes the flow to the lower convection section 1748 of the furnace 1701. The vapor phase stream 1722 removed from the separation vessel 1716 can optionally be mixed with a bypass steam 1718 before being introduced into the lower convection section 1748. The vapor phase stream 1722 continuously removed from the separation vessel 1716 is preferably superheated in the lower convection section 1748 of the furnace 1701 to a temperature of, for example, about 430 to 700° C.) (800 to 1300° F. by the flue gas from the radiant section 1703 of the furnace 1701. The vapor is then introduced to the radiant section 1703 of the furnace 1701 to be cracked.

The bypass steam stream 1718 is a split steam stream from the secondary dilution steam 1714. As previously noted, it is preferable to heat the secondary dilution steam 1714 in the furnace 1701 before splitting and mixing with the vapor phase stream removed from the separation vessel 1716. In some applications, it may be possible to superheat the bypass steam stream 1718 again after the splitting from the secondary dilution steam 1714 but before mixing with the vapor phase. The superheating after the mixing of the bypass steam 1718 with the vapor phase stream 1722 ensures that all but the heaviest components of the mixture in this section of the furnace 1701 are vaporized before entering the radiant section 1703. Raising the temperature of vapor phase to 430 to 700° C. (800 to 1300° F.) in the lower convection section 1748 also helps the operation in the radiant section 1703 since radiant tube metal temperature can be reduced. This results in less coking potential in the radiant section. The superheated vapor is then cracked in the radiant section 1703 of the furnace 1701.

Figure 18:
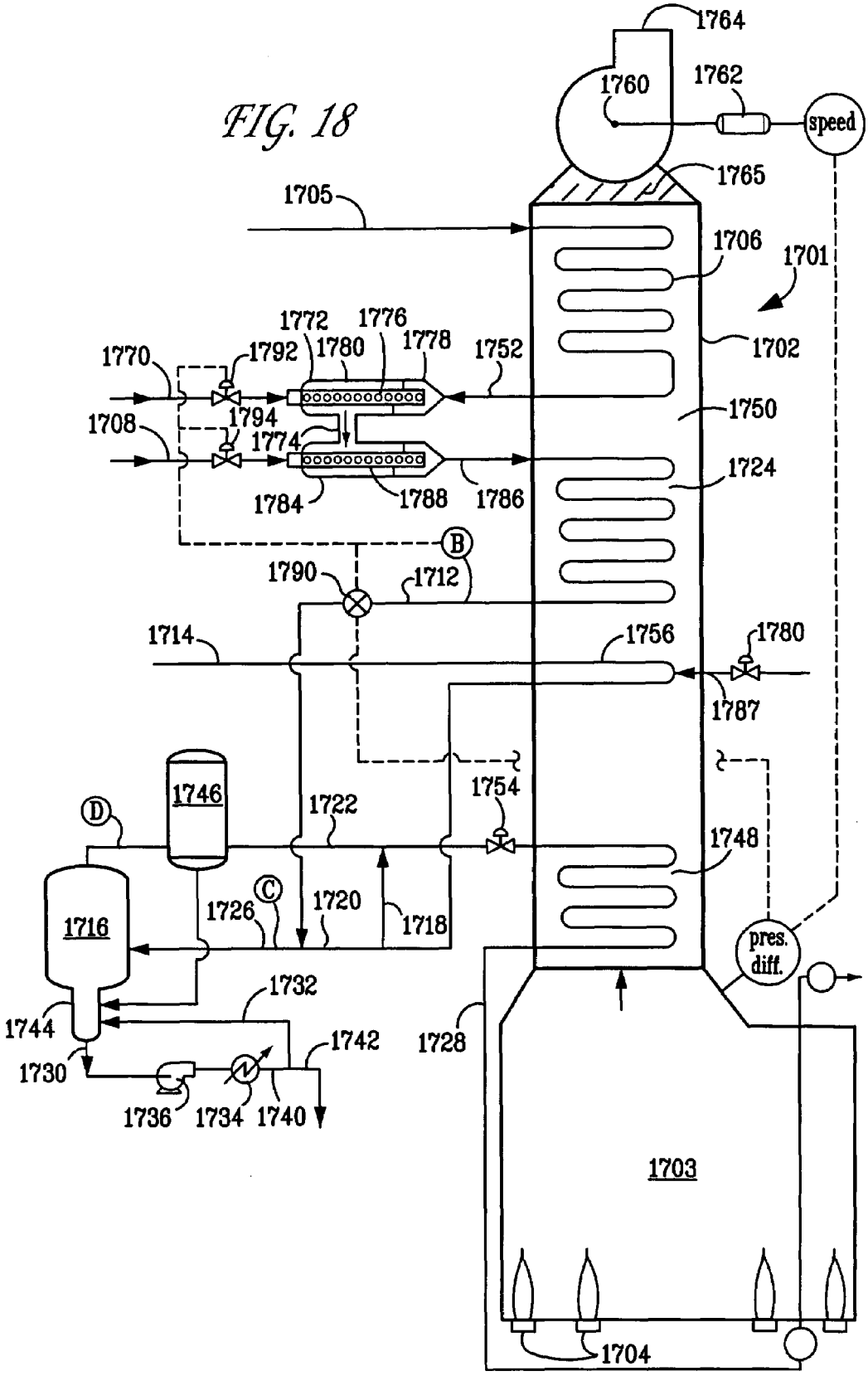
FIG. 18 illustrates a schematic flow diagram of a process and control system of one embodiment of the present invention employing at least one furnace fan, at least one furnace damper and a primary dilution steam stream and a fluid mixed with the heated hydrocarbon feedstock.

In another embodiment of the present invention, as illustrated in FIG. 18, the heated heavy hydrocarbon feedstock stream 1752 is also mixed with a fluid 1770. It is possible during start-up of the furnace 1701 or during a change in the feedstock that it may be necessary to use the fluid 1770 stream and the primary dilution steam stream 1708 along with the draft control system described in connection with FIG. 17 to control the temperature B for the hot mixture stream 1712 (optionally mixing with the flash steam stream 1720) entering the separation vessel 1716 to achieve a constant ratio of vapor to liquid in the separation vessel 1716, and to avoid substantial temperature and flash vapor-to-liquid ratio variations.

This may be necessary because, for example, at start-up, very volatile feeds require a separation vessel 1716 temperature that is substantially lower than during steady-state operations since the steam-to-hydrocarbon ratio of the hot mixture stream 1712 is higher than during steady-state operations. At minimum flue gas oxygen, fluid 1770 may be necessary to achieve the low separation vessel 1716 temperature. Also after start-up, during change in feedstock, the lighter feed dilutes the heavy feed resulting in too high a fraction of the hydrocarbon vaporized in separation vessel 1716 without fluid 1770. Addition of fluid 1770 reduces the temperature of hot mixture stream 1712 and the fraction of hydrocarbon vaporized in separation vessel 1716.

The fluid 1770 can be a liquid hydrocarbon, water, steam, or mixture thereof. The preferred fluid is water. The temperature of the fluid 1770 can be below, equal to, or above the temperature of the heated feedstock stream 1752. The mixing of the heated heavy hydrocarbon feedstock stream 1752 and the fluid stream 1770 can occur inside or outside the furnace 1701, but preferably it occurs outside the furnace 1701. The mixing can be accomplished using any mixing device known within the art. However it is preferred to use a first sparger 1772 of a double sparger assembly 1774 for the mixing. The first sparger 1772 preferably comprises an inside perforated conduit 1776 surrounded by an outside conduit 1778 so as to form an annular flow space 1780 between the inside and outside conduit. Preferably, the heated heavy hydrocarbon feedstock stream 1752 flows in the annular flow space 1780 and the fluid 1770 flows through the inside conduit 1776 and is injected into the heated heavy hydrocarbon feedstock through the openings 1782 in the inside conduit 1776, preferably small circular holes. The first sparger 1772 is provided to avoid or to reduce hammering, caused by sudden vaporization of the fluid 1770, upon introduction of the fluid 1770 into the heated heavy hydrocarbon feedstock.

In addition to the fluid 1770 mixed with the heated heavy feedstock 1752, the primary dilution steam stream 1708 is also mixed with the heated heavy hydrocarbon feedstock 1752. The primary dilution steam stream 1708 can be preferably injected into a second sparger 1784. It is preferred that the primary dilution steam stream 1708 is injected into the heavy hydrocarbon fluid mixture 1752 before the resulting stream mixture 1786 enters the convection section 1702 for additional heating by radiant section 1703 flue gas. More preferably, the primary dilution steam stream 1708 is injected directly into the second sparger 1784 so that the primary dilution steam stream 1708 passes through the sparger 1784 and is injected through small circular flow distribution holes 1788 into the hydrocarbon feedstock fluid mixture.

The mixture of fluid 1770, feedstock and primary dilution steam stream (along with the flash stream 1720) is then introduced into a separation vessel 1716 for, as previously described, separation into two phases: a vapor phase comprising predominantly volatile hydrocarbons and a liquid phase comprising predominantly non-volatile hydrocarbons. The vapor phase is preferably removed from the separation vessel 1716 as an overhead vapor stream 1722. The vapor phase, preferably, is fed back to the lower convection section 1748 of the furnace 1701 for optional heating and is conveyed through crossover pipe 1728 to the radiant section 1703 of the furnace 1701 for cracking. The liquid phase of the separation is removed from the separation vessel 1716 as a bottoms stream 1730.

As previously discussed, the selection of the hot mixture stream 1712 temperature B is also determined by the composition of the feedstock materials. When the feedstock contains higher amounts of lighter hydrocarbons, the temperature of the hot mixture stream 1712 can be set lower. As a result, the amount of fluid used in the first sparger 1772 is increased and/or the amount of primary dilution steam used in the second sparger 1784 is decreased since these amounts directly impact the temperature of the hot mixture stream 1712. When the feedstock contains a higher amount of non-volatile hydrocarbons, the temperature of the mixture stream 1712 should be set higher. As a result, the amount of fluid used in the first sparger 1772 is decreased while the amount of primary dilution steam 1708 used in the second sparger 1784 is increased.

In this embodiment, when a temperature for the mixture stream 1712 before the separation vessel 1716 is set, the control system 1790 automatically controls the fluid valve 1792 and the primary dilution steam valve 1794 on the two spargers. When the control system 1790 detects a drop of temperature of the hot mixture stream 1712, it will cause the fluid valve 1792 to reduce the injection of the fluid into the first sparger 1772. If the temperature of the hot mixture stream 1712 starts to rise, the fluid valve 1792 will be opened wider to increase the injection of the fluid 1770 into the first sparger 1772. As described further below, FIG. 18 also illustrates combined control of furnace draft with sparger fluid (preferably water) 1770 and primary dilution steam stream 1708 using the control system 1790 which in addition to communicating with the spargers can also communicate with the draft (pressure differential) measurement device.

In this embodiment, the control system 1790 comprises at least a temperature sensor and any known control device, such as a computer application. Preferably, the temperature sensors are thermocouples. The control system 1790 communicates with the fluid valve 1792 and the primary dilution steam valve 1794 so that the amount of the fluid 1770 and the primary dilution steam stream 1708 entering the two spargers is controlled. In a preferred embodiment in accordance with the present invention, the control system 1790 can be used to control both the amount of the fluid and the amount of the primary dilution steam stream to be injected into both spargers. In the preferred case where the fluid is water, the controller varies the amount of water and primary dilution steam to maintain a constant mixture stream temperature 1712, while maintaining a constant ratio of water-to-feedstock in the mixture 1711.

When the primary dilution steam stream 1708 is injected to the second sparger 1784, the temperature control system 1790 can also be used to control the primary dilution steam valve 1794 to adjust the amount of primary dilution steam stream 1708 injected to the second sparger 1784. This further reduces the sharp variation of temperature changes in the separation vessel 1716. When the control system 1790 detects a drop of temperature of the hot mixture stream 1712, it will instruct the primary dilution steam valve 1794 to increase the injection of the primary dilution steam stream 1708 into the second sparger 1784 while valve 1792 is closed more. If the temperature starts to rise, the primary dilution steam valve 1794 will automatically close more to reduce the primary dilution steam stream 1708 injected into the second sparger 1784 while valve 1792 is opened wider.

To further avoid sharp variation of the flash temperature, the present invention also preferably utilizes an intermediate desuperheater 1780 in the superheating section 1756 of the secondary dilution steam stream 1714 in the furnace 1701. This allows the superheater outlet temperature to be controlled at a constant value, independent of furnace load changes, coking extent changes, excess oxygen level changes. Normally, this desuperheater 1780 ensures that the temperature of the secondary dilution steam stream 1714 is between 430 and 590° C. (800 to 1100° F.), preferably between 450 and 540° C. (850 to 1000° F.), more preferably between 450 and 510° C. (850 to 950° F.), and most preferably between 470 and 500° C. (875 to 925° F.).

The desuperheater 1780 preferably is a control valve and water atomizer nozzle. After partial preheating, the secondary dilution steam stream 1714 exits the convection section, and a fine mist of water 1787 is added which rapidly vaporizes and reduces the temperature. The steam is then further heated in the convection section. The amount of water added to the superheater controls the temperature of the flash steam stream 1720 which is mixed with hot mixture stream 1712.

Although it is preferred to adjust the amounts of the fluid and the primary dilution steam stream injected into the heavy hydrocarbon feedstock in the two spargers 1772 and 1784, according to the predetermined temperature of the mixture stream 1712 before the flash/separation vessel 1716, the same control mechanisms can be applied to other parameters at other locations. For instance, the flash pressure and the temperature and the flow rate of the flash steam 1726 can be changed to effect a change in the vapor-to-liquid ratio in the flash.

Combined control of furnace draft, damper position, sparger fluid (preferably water), secondary dilution bypass flow rate, secondary dilution steam desuperheater water, and to a lesser extent, separator pressure can effect the optimal separator temperature and gas/liquid split for light, but hot feeds such as preheated light crude. In one embodiment, the steps to reach the target separator gas/liquid ratio may be as follows: First, the draft and position of the fan damper(s) 1765 and/or flue gas damper(s) can be controlled to minimum flue gas oxygen of about 2%. Second, sparger fluid 1770, water, can be maximized with no primary steam 1708 flow. Third, water to the secondary dilution steam stream 1714 desuperheater 1780 can be maximized to maximize heat absorbed. Fourth, all of the superheated secondary dilution steam stream 1714 can bypass the separation vessel 1716. Fifth, the separation vessel 1716 pressure can be raised.

The furnace 1701 can also crack hydrocarbon feedstocks which do not contain non-volatiles, such as HAGO, clean condensates, or naphtha. Because no non-volatiles deposit as coke in tube bank 1724, these feeds are completely vaporized upstream of line 1712. Thus, the separation vessel 1716 has no vapor/liquid separation function and is simply a wide spot in the line. Typically, the separation vessel 1716 operates at 425 to 480° C. (800 to 900° F.) during HAGO, condensate, and naphtha operations.

Without further elaboration, it is believed that one skilled in the art can, using the preceding description, utilize the present invention to its fullest extent. While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. An apparatus for cracking a hydrocarbon feedstock comprising resid, comprising:

(a) a heating zone for heating said hydrocarbon feedstock to provide heated hydrocarbon feedstock;

(b) a mixing zone for mixing a primary dilution steam stream with said heated hydrocarbon feedstock to provide a heated two-phase stratified open channel flow mixture stream;

(c) a vapor/liquid separation zone for treating vapor/liquid mixtures of hydrocarbons and steam to provide a vapor overhead and liquid bottoms;

(d) a pyrolysis furnace comprising a convection section, and a radiant section for cracking the vapor phase from the overhead vapor outlet to produce an effluent comprising olefins;

(e) a means for quenching the effluent;

(f) a recovery train for recovering cracked product from the quenched effluent; and (g) said apparatus further comprising at least two of the following:

(1) said vapor/liquid separation zone further comprising:

(i) a substantially cylindrical vessel having an upper cap section, a middle section comprising a circular wall, and a lower cap section;

(ii) an overhead vapor outlet extending upwardly from said upper cap section;

(iii) at least one inlet in the circular wall of said middle section for introducing said flow;

(iv) a substantially concentrically positioned, substantially cylindrical boot extending downwardly from said lower cap section for receiving separated liquid, said boot being of less diameter than said middle section and communicating with said lower cap section, and further comprising a liquid outlet at its lower end; and further comprising at least one of:

(v) a means for introducing heat directly to said lower cap section and/or said boot; and (vi) a means to regulate residence time of liquid present in said lower cap and/or boot;

(2) said vapor/liquid separation zone further comprising:

a flash/separation vessel for treating said mixture stream to form (i) a vapor phase at its dew point which partially cracks causing a temperature decrease and partial condensation of said vapor phase in the absence of added heat and (ii) a liquid phase; said vessel further comprising:

(I) a means for reducing or eliminating said partial condensation comprising an inlet for adding heated vaporous diluent to said flash/separation vessel to an extent sufficient to at least partially compensate for said temperature decrease and dilute and superheat said vapor phase;

(II) a flash/separation vessel overhead outlet for removing the vapor phase as overhead;

(III) a flash/separation vessel liquid outlet for removing said liquid phase as bottoms from said flash/separation vessel;

(3) said vapor/liquid separation zone further comprising:

(i) a substantially cylindrical vertical vessel having an upper cap section, a middle section comprising a circular wall, and a lower cap section;

(ii) an overhead vapor outlet attached to said upper cap section;

(iii) at least one substantially tangentially positioned inlet in the wall of said middle section for introducing said flow mixture stream along said wall under flashing conditions where the flow mixture stream undergoes an initial flashing to form (A) a vapor phase at its dew point which contains a lesser portion of coke precursors, and (B) a liquid phase which contains a greater portion of coke precursors;

(iv) a partial condenser for contacting the vapor phase within said vessel for at least partially condensing at least some of said lesser portion of coke precursors, which adds to said liquid phase, said condensing providing a vapor phase of reduced coke precursors content;

(v) a vessel overhead outlet for removing the vapor phase of reduced precursors content as overhead;

(vi) a vessel liquid outlet for removing said liquid phase as bottoms from said vessel; and (vii) a substantially concentrically positioned, substantially cylindrical boot of less diameter than said middle section, said boot communicating with said lower cap section, and further comprising an inlet for quench oil and a liquid outlet at its lower end;

(4) said flash zone further comprising a flash/separation vessel for flashing said mixture stream to form a coke precursor depleted vapor phase and a coke precursor rich liquid phase, said vessel comprising:

(i) a bottom outlet in the flash/separation vessel which comprises internal surfaces and associated outlet piping, which surfaces and piping during operation become coated with said liquid phase and thereafter at least partially coked;

(ii) an overhead outlet for removing the vapor phase and a trace of condensed vapor phase, which overhead outlet comprises internal surfaces and associated outlet piping, which surfaces and piping during operation become coated with condensed vapor phase and thereafter at least partially coked;

(iii) an inlet for introducing sufficient purging steam to said flash/separation vessel to remove said vapor phase from said vessel and said liquid phase from said internal surfaces and/or outlet piping; and (iv) an inlet for introducing an air/steam mixture through said flash/separation vessel under conditions sufficient to at least partially combust coke on said internal surfaces and/or outlet piping;

(5) said vapor/liquid separation zone further comprising:

(i) a substantially cylindrical vertical vessel having an upper cap section, a middle section comprising a circular wall, and a lower cap section;

(ii) an overhead vapor outlet attached to said upper cap section;

(iii) at least one substantially tangentially positioned inlet in the wall of said middle section for introducing said flow along said wall;

(iv) an annular structure located in the middle section, comprising (A) an annular ceiling section extending from the circular wall and (B) an internal vertical side wall to which said ceiling section extends, said side wall being positioned substantially concentrically to, but away from, said circular wall, said annular structure blocking the upward passage of said vapor/liquid mixtures along the circular wall beyond said ceiling section, and said annular structure circumscribing an open core having sufficient cross-sectional area to permit vapor velocity low enough to avoid significant entrainment of liquid; and (v) a substantially concentrically positioned, substantially cylindrical boot of less diameter than said middle section, said boot communicating with said lower cap section, and further comprising an inlet for quench oil and a liquid outlet at its lower end;

(6) said pyrolysis furnace further comprises:

(I) a convection zone containing:

(A) a first tube bank comprising (1) an upper hydrocarbon feed inlet, (2) an optional lower hydrocarbon feed inlet, (3) one or more inlets for introducing water and steam, and (4) an outlet for a heated mixture stream;

at least one of:

(B) a second tube bank positioned beneath said first tube bank comprising an economizer inlet for introducing high pressure boiler feed water and an economizer outlet for withdrawing boiler feed water of greater heat content; and (C) a third tube bank positioned beneath said first tube bank comprising an inlet for high pressure steam which is heated in a section of said third tube bank, an inlet for mixing desuperheater water with said high pressure steam to cool the high pressure steam, a section for reheating said high pressure steam, and an outlet for withdrawing superheated high pressure steam;

and further comprising:

(D) a bypass line for receiving said heated mixture stream from said first tube bank;

(E) a fourth tube bank positioned beneath said second tube bank and said third tube bank which comprises an inlet connected to said bypass line and an outlet for directing effluent to a vapor/liquid separator; and (F) a fifth tube bank positioned beneath said fourth tube bank with an inlet for receiving overhead from said vapor/liquid separator and an outlet; and (II) a radiant zone beneath said convection zone which includes a plurality of burners producing flue gas passing upwards through the radiant zone and convection tube banks, which radiant zone receives effluent from said fifth tube bank and further comprises an outlet for removing cracked effluent.

2. The apparatus of claim 1, wherein said radiant zone includes a means for adjusting excess oxygen content of said flue gas.

3. The apparatus of claim 1, which further comprises an additional heating zone between said mixing zone and said vapor/liquid separation zone.

4. The apparatus of claim 1, which further comprises:

an inlet for introducing purging steam into said lower cap and/or said boot at a steam velocity sufficiently low to avoid entrainment of said liquid present in said lower cap and/or said boot.

5. The apparatus of claim 1, wherein said lower cap section is at least one of substantially hemispherical and substantially semi-elliptical in longitudinal section.

6. The apparatus of claim 1, wherein said lower cap section is conical.

7. The apparatus of claim 6, wherein said conical lower cap section is pitched to an extent sufficient to provide downward plug flow of said separated liquid.

8. The apparatus of claim 1, wherein said means to regulate said residence time comprises a control valve to regulate removal of said separated liquid from said boot.

9. The apparatus of claim 1, wherein said means to regulate said residence time comprises a means to provide a liquid level above said boot and within said lower cap.

10. The apparatus of claim 1, wherein said at least one inlet in the circular wall of said middle section for introducing said flow is a substantially tangential inlet for introducing said flow along said wall.

* * * * *